US010131149B2

(12) United States Patent
Reder et al.

(10) Patent No.: US 10,131,149 B2
(45) Date of Patent: Nov. 20, 2018

(54) PRINTING ASSEMBLY

(71) Applicant: KOENIG & BAUER AG, Würzburg (DE)

(72) Inventors: Wolfgang Reder, Veitshöchheim (DE); Karl Schäfer, Kürnach (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 15/752,656

(22) PCT Filed: Aug. 4, 2016

(86) PCT No.: PCT/EP2016/068602
§ 371 (c)(1),
(2) Date: Feb. 14, 2018

(87) PCT Pub. No.: WO2017/029115
PCT Pub. Date: Feb. 23, 2017

(65) Prior Publication Data

US 2018/0250939 A1 Sep. 6, 2018

(30) Foreign Application Priority Data

Aug. 18, 2015 (DE) ..... 10 2015 215 723

(51) Int. Cl.
*B41J 2/165* (2006.01)
*B41J 2/155* (2006.01)
(Continued)

(52) U.S. Cl.
CPC ..... *B41J 2/16585* (2013.01); *B41J 2/155* (2013.01); *B41J 2/16552* (2013.01); *B41J 2/215* (2013.01);
(Continued)

(58) Field of Classification Search
CPC .. B41J 2/16585; B41J 25/3088; B41J 25/304; B41J 25/308; B41J 13/00; B41J 2/16552;
(Continued)

(56) References Cited

U.S. PATENT DOCUMENTS 6,419,334 B1 7/2002 Akuzawa et al.
6,550,882 B2 4/2003 Koitabashi et al.
(Continued)

FOREIGN PATENT DOCUMENTS

DE 60305366T2 T2 3/2007
DE 102010037829 A1 3/2012
(Continued)

OTHER PUBLICATIONS

International Search Report dated Nov. 10, 2016.
Jul. 2, 2018 Japanese Office Action issued in Japanese Patent Application No. 2018-508655.

*Primary Examiner* — Justin Seo
(74) *Attorney, Agent, or Firm* — Mattingly & Malur, PC

(57) ABSTRACT

A printing assembly has at least one frame, which frame has at least two side walls, between which two side walls a transport path, provided for the transport of printing material, at least partially extends. At least one transport direction is defined by the transport path provided for the transport of printing material. The printing assembly has at least two cross members which are spaced apart from each other in the transport direction and which each extend from one of the side walls to another of the side walls. Each of the at least two cross members has at least one first cross beam and at least one second cross beam spaced apart therefrom, which jointly bound at least one interior of the particular cross member at least partially in and against the transport direction. At least one component of one of a gas transport device and at least one additional device for supplying at least one printing head with one of energy and operating media and
(Continued)

printing fluid and data and at least one gas and at least one inner device for one of cleaning and maintaining and covering at least one printing head is arranged in the at least one interior in each case. The printing assembly has at least one supporting body which can be moved, in relation to the frame, in at least one parking direction and which extends at least in a transverse direction between side walls. At least one printing head is arranged on the at least one supporting body and can be moved jointly with the at least one supporting body.

15 Claims, 27 Drawing Sheets

(51) Int. Cl.

| | |
|---|---|
| ***B41J 29/377*** | (2006.01) |
| ***B41J 2/215*** | (2006.01) |
| ***B41J 13/00*** | (2006.01) |
| ***B41J 25/308*** | (2006.01) |
| ***B41J 25/304*** | (2006.01) |

(52) U.S. Cl.
CPC ..... *B41J 13/00* (2013.01); *B41J 25/304* (2013.01); *B41J 25/308* (2013.01); *B41J 25/3088* (2013.01); *B41J 29/377* (2013.01); *B41J 2002/16555* (2013.01)

(58) Field of Classification Search
CPC . B41J 2/215; B41J 29/377; B41J 2/155; B41J 2002/16555
See application file for complete search history.

(56) References Cited

U.S. PATENT DOCUMENTS

| | | | | |
|---|---|---|---|---|
| 6,783,227 | B2 | 8/2004 | Suzuki et al. | |
| 6,945,628 | B2 | 9/2005 | Koitabashi et al. | |
| 8,454,151 | B2 | 6/2013 | Kanome et al. | |
| 9,643,436 | B2 | 5/2017 | Hacker et al. | |
| 2003/0039499 | A1 | 2/2003 | Kelley et al. | |
| 2003/0043246 | A1* | 3/2003 | Codos | B41J 3/28 347/102 |
| 2009/0122107 | A1 | 5/2009 | Ray et al. | |
| 2009/0244124 | A1 | 10/2009 | Kondo | |
| 2011/0043554 | A1 | 2/2011 | Silverbrook et al. | |
| 2011/0181658 | A1 | 7/2011 | Hideo et al. | |
| 2012/0007916 | A1 | 1/2012 | Kumagai | |
| 2014/0240397 | A1 | 8/2014 | Masuda | |
| 2015/0085015 | A1 | 3/2015 | Miyakoshi et al. | |
| 2016/0107455 | A1 | 4/2016 | Izawa et al. | |

FOREIGN PATENT DOCUMENTS

| | | | |
|---|---|---|---|
| DE | 102010060406 | A1 | 5/2012 |
| DE | 102013208754 | A1 | 11/2014 |
| EP | 1208990 | A2 | 5/2002 |
| EP | 1787816 | A2 | 5/2007 |
| EP | 2357086 | A1 | 8/2011 |
| EP | 2433800 | A1 | 3/2012 |
| GB | 2357996 | A | 7/2001 |
| JP | 2010-005850 | A | 1/2010 |
| JP | 2012-000932 | A | 1/2012 |
| JP | 2013-111954 | A | 6/2013 |

* cited by examiner

300

318
317
302
344
⊗A
S, N
346
318
351
347
343
348
303
306

PRINTING ASSEMBLY

CROSS REFERENCE TO RELATED APPLICATIONS

This application is the U.S. National Phase, under 35 U.S.C. § 371, of PCT/EP2016/068602, filed Aug. 4, 2016; published as WO2017/029115A1 on Feb. 23, 2017 and claiming priority to DE 10 2015 215 723.7, filed Aug. 18, 2015, the disclosures of which are expressly incorporated herein by reference in their entireties.

FIELD OF THE INVENTION

The present invention relates to a printing assembly.

BACKGROUND OF THE INVENTION

Various printing methods are used in printing machines. Non-impact printing methods (NIP) are understood to be printing methods that do not require a fixed, i.e., physically invariable, printing forme. Such printing methods produce different print images in each printing operation. Examples of non-impact printing methods include ionographic methods, magnetographic methods, thermographic methods, electrophotography, laser printing and in particular inkjet printing methods. Such printing methods usually have at least one image-generating device, for example, at least one print head. In the case of the inkjet printing method, such a print head is embodied as an inkjet print head, for example, and has at least one nozzle, preferably a plurality of nozzles, by means of which at least one printing fluid in the form of ink droplets, for example, can be transferred to a printing substrate in a targeted manner. The printing substrate should preferably be at the most constant possible distance from the image-generating device, in order to be able to coordinate the generation of images in time while at the same time avoiding damage to the image-generating device.

In inkjet printing methods, in particular in conjunction with water-based ink, for example, it may happen that the printing substrate becomes deformed, forming ripples, for example. Such ripples may entail the risk of damage to both print heads and the printing substrate, on the one hand, while resulting in a low print quality, on the other hand, due to different printing fluid droplet flight times, for example.

DE 10 2013 208754 A1 discloses a printing assembly having movable print heads.

GB 2 357 996 A discloses a suctioning of air in conjunction with inkjet printing.

US 2012/0 007 916 A1 discloses a printing assembly, in which suction boxes, each extending over the total working width of the printing assembly, are arranged. Each suction box has a fan blowing air to the outside.

US 2014/0 240 397 A1 discloses a printing assembly having suction boxes, in each of which spacers are arranged to reduce the flow cross section and to increase the velocity of flow, so that condensed solvent cannot collect in vertically extending sections and drop back downward.

JP 2012-000 932 A discloses a printing assembly having a plurality of suction boxes, which together extend over the working width of the printing assembly.

JP 2013-111 954 A discloses a printing assembly having a suction box with internal separation devices, which ultimately open into a single outlet of the suction box.

US 2009/0 122 107 A1 discloses a printing assembly having a plurality of print heads arranged one after the other in the direction of transport, wherein multiple crossbars are arranged, one after the other, in the direction of transport, extending between the side walls of a frame.

US 2009/0 244 124 A1 discloses a printing assembly having a framework and a frame pivotable thereto, to which print heads are attached by means of adjusting devices, and which has an alignment device for print heads, wherein an operating element may optionally be used for this, to influence alignment units arranged upstream of this operating element or downstream of this operating element with respect to a direction of transport. The print heads are arranged on a plurality of crossbars arranged one after the other.

DE 603 05 366 T2 discloses dryers, wherein interspaces, in which print heads are arranged, are themselves arranged between these dryers as seen in the direction of transport.

US 2011/0 043 554 A1 discloses a printing assembly having a frame with two side walls, between which a transport path for printing substrate runs at least partially, and having at least two crossbars, each extending from one side wall to the other side wall.

JP 2010-5 850 A discloses a printing assembly having a cleaning and covering device for print heads, wherein this device can be arranged temporarily between print heads in the direction of transport.

U.S. Pat. No. 6,419,334 B1 discloses a supporting body, which supports print heads and can be supported from above on journals of a frame. A precise position is ensured by three journals.

DE 10 2010 060 406 A1 discloses a printing assembly having supporting bodies, on which print heads are arranged and which can be retracted vertically upward relative to a frame of the printing assembly.

DE 10 2010 037 829 A1 discloses a printing assembly, in which print heads are arranged on crossbars and are movable vertically and/or in a transverse direction together with the crossbars to bring them into contact with closure devices.

US 2003/0 039 499 A1 discloses a device, with which print heads are moved on crossbars orthogonally to a transport direction for the printing substrate during a printing operation. For this purpose, the print heads are arranged on a suitably movable supporting body, which is therefore suitably short in the transverse direction.

EP 2 357 086 A1 discloses a printing assembly having crossbars that extend from one side wall of a frame to another side wall of the frame. On these crossbars, supporting bodies are pivotably arranged, which in turn support print heads, and which protrude downward together with these print heads through respective openings in the crossbars. Additionally, a gas pumping device is provided on each crossbar.

EP 1 787 816 A2 discloses a printing assembly having crossbars that extend from one side wall of a frame to another side wall of the frame. On these crossbars, fastening devices are provided, which serve to align the print heads. Print head spaces with print heads are located between the crossbars.

SUMMARY OF THE INVENTION

The object of the present invention is to create a printing assembly.

This object is achieved according to the invention by the provision of a printing assembly which has at least one frame which frame has at least two side walls, between which two side walls a transport path provided for the transport of printing substrate extends at least partially. At least one transport direction is defined by the transport path provided for the transport of printing substrate. The printing assembly has at least two cross bars that are spaced at a distance from one another in the transport direction, each of which at least two cross bars extends from one of the side walls to another of the side walls. Each of the at least two cross bars had at least one first cross beam and at least one second cross beam, which second cross beam is spaced at a distance from the first cross beam, and which together decimit at least one interior space of the respective cross bar, at least partially in, and opposite the transport direction. At least one component of a gas transport device and at least one accessory device for supplying at least one print head with one of energy and process materials and printing fluid and data and at least one gas, and at least one internal accessory device for one of cleaning and for maintenance and for coverage of at least one print head is located in the respective at least one interior space. The printing assembly has at least one supporting body that is movable relative to the frame in at least one throw-off direction, that supporting body extending between the side walls at least in the transverse direction. At least one print head is located on the at least one supporting body and is movable together with the at least one supporting body.

A printing machine has at least one printing assembly. The printing assembly preferably has at least one transport path, which is provided for transporting web-type printing substrate in particular, and by means of which at least one direction of transport is defined. The printing assembly preferably has at least one print head. A print head is preferably an image-generating device for a non-impact printing method, i.e., a printing method without a fixed printing forme. The printing assembly preferably has at least two, and more preferably even more, print heads, in particular inkjet print heads, arranged one after the other with respect to the direction of transport, which is defined by the transport path provided for transport of web-type printing substrate in particular. The printing assembly preferably has at least one protective cover, which is embodied to be movable between at least one respective covering position and at least one respective access position. The at least one protective cover preferably has at least one tread surface, which is embodied in particular to be tread upon by at least one operator and/or is movable jointly with the at least one protective cover. The at least one tread surface of the at least one protective cover is preferably arranged at least partially in the vertical direction above at least one of the print heads of the printing assembly and more preferably on a side of the at least one protective cover that faces away from the at least one print head, at least with the at least one protective cover disposed in its respective covering position.

In the case of a curved transport path, the transport direction is preferably the direction running tangentially to a partial segment and/or a point on the provided transport path that is next to a respective reference point. This respective reference point is preferably located at the point and/or on the component that is set in reference to the transport direction.

Alternatively or additionally, the printing assembly is preferably characterized in that the printing assembly has at least three tread surfaces, embodied in particular for being tread upon by at least one operator and/or being movable jointly with the at least one protective cover, each being embodied to be movable at least between a respective treading position and a respective access position. The at least one and more preferably each one of the at least three tread surfaces, in its respective treading position, is preferably disposed at least partially in the vertical direction above at least one of the print heads of the printing assembly, and more preferably on a side of the at least one protective cover that faces away from the at least one print head. The at least one and more preferably each one of the at least three tread surfaces preferably has a width corresponding to at least 60% of the working width of the printing assembly and/or amounting to at least 40 cm.

Alternatively or additionally, the printing assembly is preferably characterized in that a sequence of functional units extending in the transport direction is arranged opposite the transport path provided in a direction having at least one component facing vertically upward. Within this sequence of functional units, preferably at least one first gas supply opening, followed by at least one first section of a shielding device permeated by print head recesses, followed by at least one first gas suction opening, followed by at least one flow shield, followed by at least one second gas supply opening, followed by at least one second section of the shielding device permeated by print head recesses, followed by at least one second gas suction opening are arranged one after the other in the transport direction.

Alternatively or additionally, the printing assembly is preferably characterized in that the printing assembly has at least one suction box. The at least one suction box preferably has at least one inlet opening, which points at least partially toward the transport path provided for the printing substrate. The at least one suction box preferably has at least one, more preferably exactly one, outlet opening, which is connected in particular to a respective connecting opening of a suction line by an outlet connection, which is sealed by means of a sealing element embodied in particular as a sealing ring, the suction line more preferably in turn being connected to a suction device. The at least one suction box is preferably removable from the suction line and/or from the printing assembly in particular in a non-destructive manner, in particular while retaining the installed position of the suction line and/or in a removal direction.

Alternatively or additionally, the printing assembly is preferably characterized in that the printing assembly has at least two and more preferably at least three suction boxes, each having respective inlet openings, which face at least partially toward the transport path provided for printing substrate. The at least two and more preferably at least three suction boxes are preferably connected to the same common suction line, in particular with their respective outlet openings each at flow connections. The inlet openings of the at least two and more preferably at least three suction boxes preferably extend together over an inlet length in a transverse direction corresponding to at least 80% of the working width of the printing assembly. The inlet opening preferably extends in a transverse direction. The transverse direction is preferably oriented orthogonally to each transport direction that is defined by the transport path provided for the printing substrate, and is also preferably oriented horizontally.

Alternatively or additionally, the printing assembly is preferably characterized in that the at least two and more preferably at least three suction boxes can be removed from the common suction line and/or from the printing assembly, each individually and independently of others of these at least two and more preferably at least three suction boxes, which are arranged in the transverse direction next to the respective one of the at least two suction boxes.

Alternatively or additionally, the printing assembly is preferably characterized in that multiple rows of suction boxes are arranged one after the other as seen in the direction of transport, each row having at least two suction boxes, which are arranged side by side in the transverse direction.

Alternatively or additionally, the printing assembly is preferably characterized in that the printing assembly has at least one frame with at least two side walls. The transport path provided for the transport of web-type printing substrate in particular preferably runs at least partially between these side walls. The printing assembly preferably has at least one crossbar extending at least in the transverse direction between the side walls and more preferably being connected to both of the two side walls of the frame, in particular being rigidly connected thereto. More preferably, the printing assembly has at least two, more preferably at least three, even more preferably at least four, even more preferably at least five, even more preferably at least six, even more preferably at least seven and even more preferably at least 13 crossbars, each at least extending in the transverse direction between the side walls and more preferably each being connected to both of the two side walls of the frame, in particular being rigidly connected. The printing assembly preferably has at least one supporting body that is movable in particular by means of at least one throw-off drive, preferably being linearly movable and at any rate movable relative to the frame in at least one throw-off direction, said supporting body extending at least in the transverse direction between the side walls and in particular from one side wall to another side wall. The throw-off direction preferably has at least one component facing vertically upward.

At least one print head is preferably arranged on the at least one supporting body and is movable jointly with the at least one supporting body. Preferably, at least two print heads are arranged on the at least one supporting body and more preferably are movable jointly with the respective at least one supporting body. At least one first contact point located on the at least one supporting body and at least one second contact point located on the at least one crossbar preferably form at least one first pair of contact points, which are opposite one another in the throw-off direction and are in contact with one another and/or can be brought into contact with one another. At least one third contact point located on the at least one supporting body and at least one fourth contact point located on the at least one crossbar and on another of at least two crossbars, for example, preferably form at least one second pair of contact points, which are at least temporarily opposite one another at least also in a supporting direction that is orthogonal to the throw-off direction and is orthogonal to the transverse direction, and which are in contact with one another and/or can be brought into contact with one another.

Alternatively or additionally, the printing assembly is characterized in that the printing assembly has at least two crossbars spaced a distance apart from one another in the transport direction, each extending from one of the side walls to another one of the side walls, wherein each of the at least two crossbars has at least one first crossbeam and at least one second crossbeam arranged at a distance from the former, jointly bordering at least one interior space of the respective crossbar at least partially in and opposite the direction of transport. Preferably, at least one component of a gas transport device and/or at least one accessory device for supplying at least one print head with energy and/or process materials and/or printing fluid and/or data and/or at least one gas and/or at least one internal accessory device for cleaning and/or for maintenance and/or for coverage of at least one print head is/are preferably arranged in the respective at least one interior space. The at least one suction box is in particular a component of the gas transport device.

Alternatively or additionally, the printing assembly is preferably characterized in that the printing assembly has at least three crossbars spaced a distance apart from one another in the transport direction, each extending at least in a transverse direction between the side walls, wherein the printing assembly has at least three print heads or preferably even more print heads arranged one after the other with respect to the transport direction, and wherein at least one first accessory device different from each print head is arranged on each of the at least three crossbars, the first accessory device being associated with at least one front print head arranged in front of this respective one of the at least three crossbars in the transport direction, and/or wherein at least one second accessory device in particular different from each print head is preferably arranged on each of the at least three crossbars, the second accessory device being associated with at least one rear print head arranged behind this respective one of the at least three crossbars in the transport direction.

Alternatively or additionally, the printing assembly is preferably characterized in that the at least one printing assembly has at least two image-generating devices embodied in particular as print heads. Alternatively or additionally, the printing assembly is preferably characterized in that the at least one printing assembly has at least one inkjet print head and more preferably at least two inkjet print heads. Alternatively or additionally, the printing assembly is preferably characterized in that the at least one printing assembly has at least two inkjet print heads, which define the respective application sites for printing fluid, and in that a transport path through the printing assembly provided for printing substrate is defined by at least two stationary guide elements of the at least one printing assembly, and in that a printing section of the transport path provided for the printing substrate begins at a first application site of the printing assembly along this transport path provided and ends at the last application site of the printing assembly along this transport path provided. For example, at least five fixed guide elements that define the transport path provided are arranged one after the other along the printing section of this transport path provided.

The printing assembly is preferably characterized in that at least two, preferably at least five, more preferably at least eight, even more preferably at least 10, even more preferably at least 14 and even more preferably at least 28 stationary guide elements, which together also define the transport path provided, are arranged one after the other along the printing section of this transport path provided. This yields in particular the advantage that a particularly large number of print heads and thus a high printing speed and a high print quality can be achieved. A stationary guide element is understood in particular to be a guide element that is immovable and/or stationary during a printing operation and/or that is not rotatable either by its own drive or by contact with printing substrate, and/or that is provided at most for pivoting movements jointly with other guide elements about at least one common pivot axis with respect to rotational movements and/or rotary movements and/or pivoting movements about axes that are orthogonal to the transport direction of the transport path intended for the printing substrate. In particular, the at least one printing assembly is preferably characterized in that the at least two, and more preferably the at least five, in particular stationary guide elements are guide elements that are stationary with respect to rotational movements or pivoting movements about axes other than at least one pivot axis they have in common. Preferably, the stationary guide elements are in particular guide elements that are stationary relative to one another.

Alternatively or additionally, the printing assembly is preferably characterized in that these at least two and preferably at least five guide elements, which jointly define this provided transport path in the area of the printing section, are arranged to be pivotable about at least one pivot axis they have in common, in particular to move these at least two and preferably at least five guide elements between a respective working position and a respective maintenance position. These at least two and preferably at least five guide elements that jointly define this transport path provided in the area of the printing section are preferably arranged to be pivotable about the at least one pivot axis they have in common by means of at least one pivot drive and/or in at least one joint movement and/or relative to the at least two print heads. This yields the advantage, in particular, that a maintenance space in particular for cleaning a shielding device and/or the guide elements can be created. Alternatively or additionally, the printing assembly is preferably characterized in that these at least two and more preferably at least five guide elements are arranged so as to pivot about the at least one pivot axis they have in common, with a pivot angle that amounts to at least 10°, more preferably at least 20° and even more preferably at least 30°.

Alternatively or additionally, the printing assembly is preferably characterized in that a main direction of conveyance defined by a straight line connection between a first guide element with respect to the printing section of the transport path provided for the printing substrate and a last guide element with respect to the printing section of the transport path provided for the printing substrate is oriented orthogonally to the transverse direction, and in that the main direction of conveyance with guide elements disposed in their maintenance position is arranged at an angle of at most 30°, more preferably at most 20° and even more preferably at most 10° to a vertical direction. This yields the advantage, in particular, that the maintenance space is especially large and the guide elements are especially accessible in their maintenance position. This makes it possible, in particular, to implement large widths of printing substrate and/or working widths of the printing assembly.

Alternatively or additionally, the printing assembly is preferably characterized in that the transport path provided for the printing substrate along the printing section is curved exclusively in one direction, in particular downward and/or in a convex curve with respect to the side of the printing substrate that is imprinted in at least one printing assembly. A downward curvature here is not in contradiction to a transport path running upward, but instead indicates a continuously or stepwise flatter rise, for example, in the course of the transport path. Alternatively or additionally, the printing assembly is preferably characterized in that the transport path provided for printing substrate along the printing section is bordered and/or contacted by and/or is tangential to components of the printing assembly exclusively on exactly one side.

Alternatively or additionally, the printing assembly is preferably characterized in that the at least two print heads each have a plurality of nozzles, and more preferably in that at least one nozzle per print head has a target region, which intersects at least one and more preferably exactly one of the in particular at least two and more preferably at least five preferably stationary guide elements. This is preferably true in particular of each respective print head arranged in its printing couple and each respective guide element arranged in its working position. Alternatively or additionally, this is preferably also true of multiple or more preferably all nozzles of the respective print head. This yields in particular the advantage that the printing fluid is applied to the printing substrate in an area where this printing substrate is particularly flat because it is pulled by the deflection angle against the corresponding guide element.

Alternatively or additionally, the printing assembly is preferably characterized in that at least one of the at least two and preferably at least five guide elements that jointly define this transport path provided in the area of the printing assembly is in contact with a total of at least two lateral supporting elements and at least one inner supporting element, at three locations preferably embodied as contact regions spaced a distance apart from one another in the transverse direction, the position of said guide element thereby being defined. Alternatively or additionally, the printing assembly is more preferably characterized in that multiple, or more preferably all of the at least two and preferably at least five guide elements that jointly define this transport path provided in the area of the printing assembly are in contact with a total of at least two lateral supporting elements and at least one inner supporting element at three locations preferably embodied as contact regions spaced a distance apart from one another in the transverse direction, and are thereby defined in their position, wherein preferably the multiple or more preferably all of the guide elements are each in contact with the same lateral and/or inner supporting element. Alternatively or additionally, the printing assembly is preferably characterized in that the at least one inner supporting element is in contact with the at least one guide element at a location preferably embodied as a contact region, the position of the guide element with respect to the transverse direction corresponding to the position of at least one nozzle of at least one print head of the printing assembly.

Alternatively or additionally, the printing assembly is preferably characterized in that the printing assembly has at least one frame or machine frame, in particular a stationary frame. For example, the printing assembly has the at least one first transport path, which is provided for printing substrate webs and is jointly defined by at least two guide elements, and which has at least one supporting element that is movable relative to the frame, in particular pivotable, and at least one first web fixation device for fixing a first section of a printing substrate web relative to the first web fixation device and/or relative to the frame is arranged along this first provided transport path. Fixation is understood in particular to refer not merely to support against the force of gravity but rather to a relative immobility, in particular with respect to any movement in any direction. Alternatively or additionally, the printing assembly is characterized in that at least one second web fixation device, which is connected to the at least one supporting element that is movable relative to the frame and is likewise movable relative to the frame at least jointly with this at least one supporting element that is movable relative to the frame, is arranged along this first provided transport path, in particular downstream of the at least one first web fixation device, for fixation of a second section of a printing substrate web relative to the second web fixation device and/or relative to the at least one movable supporting element. The at least one first web fixation device is preferably arranged on the frame. A joint movement of two objects should preferably be understood in particular to refer to a movement in which the centers of gravity of these objects move relative to another object, for example the frame, but in which the distance between these centers of gravity remains the same.

Alternatively or additionally, the printing assembly is preferably characterized in that the at least two guide elements that jointly define the first transport path provided for printing substrate are arranged, preferably on the at least one supporting element, so as to move, in particular pivot, together with this at least one supporting element, relative to the frame. The at least two guide elements are preferably stationary guide elements relative to the at least one supporting element. Alternatively or additionally, the printing assembly is preferably characterized in that the at least one supporting element is arranged to be pivotable about the at least one common pivot axis together with the at least one second web fixation device and/or together with the at least two guide elements, in particular being pivotable by means of at least one common pivot drive and/or in a joint movement. The at least one second web fixation device is preferably arranged so as to move independently of the at least one first web fixation device. Alternatively or additionally, the printing assembly is preferably characterized in that the second web fixation device is movable relative to the first web fixation device in particular jointly with the at least two guide elements, and in that a distance between the at least one second web fixation device and the at least one first web fixation device is variable. Alternatively or additionally, the printing assembly is preferably characterized in that the at least one first web fixation device is arranged on the frame of the printing assembly. Alternatively or additionally, the printing assembly is preferably characterized in that a maximum adjustment path, which is optionally provided for the at least one first web fixation device, is smaller than one-tenth of a maximum adjustment path of the at least one second fixation device.

Alternatively or additionally, the printing assembly is preferably characterized in that the at least one second web fixation device may be arranged, in particular jointly with the part of the second section of the at least one printing substrate web fixed thereto, at different distances from the at least one image-producing device, which is preferably embodied as a print head.

Alternatively or additionally, the printing assembly is preferably characterized in that the printing assembly has at least two image-generating devices, by means of which respective application sites for printing fluid are defined, and in that a printing section of the first transport path provided for printing substrate begins at a first application site of the printing assembly along this provided transport path and ends at a last application site of the printing assembly along this provided transport path, and in that along this provided transport path, the at least two guide elements that jointly define the provided transport path are arranged one after the other along the printing section of this first provided transport path.

Alternatively or additionally, the printing assembly is preferably characterized in that at least one separating device and/or at least one connecting device is arranged along the provided transport path between the at least one first web fixation device and the at least one second web fixation device. Alternatively or additionally, the printing assembly is preferably characterized in that the first section of the printing substrate web and the second section of the printing substrate web belong to the same printing substrate web at least prior to a possible separation.

The invention is preferably applicable to various non-impact printing methods, in particular to ionographic methods, magnetographic methods, thermographic methods, electrophotography, laser printing and in particular inkjet printing methods. In both the preceding discussion and the following discussion, the embodiments and variants presented for "printing inks"—inasmuch as no obvious contradiction is apparent—are to be applied to any type of free-flowing printing fluids, including, in particular, colored or colorless varnishes and relief-forming materials such as, for example, pastes, and are considered conveyed by the—either actual or merely theoretical—replacement of the expression "printing ink" with the more generalized expression "printing fluid" or with a specific expression such as "varnish," "high-viscosity printing ink," "low-viscosity printing ink" and/or "ink" or "paste" and/or "pasty material."

BRIEF DESCRIPTION OF THE DRAWINGS

Exemplary embodiments of the invention are illustrated in the drawings and are described in greater detail below.

The figures show.

DESCRIPTION OF PREFERRED EMBODIMENTS

Figure 1:
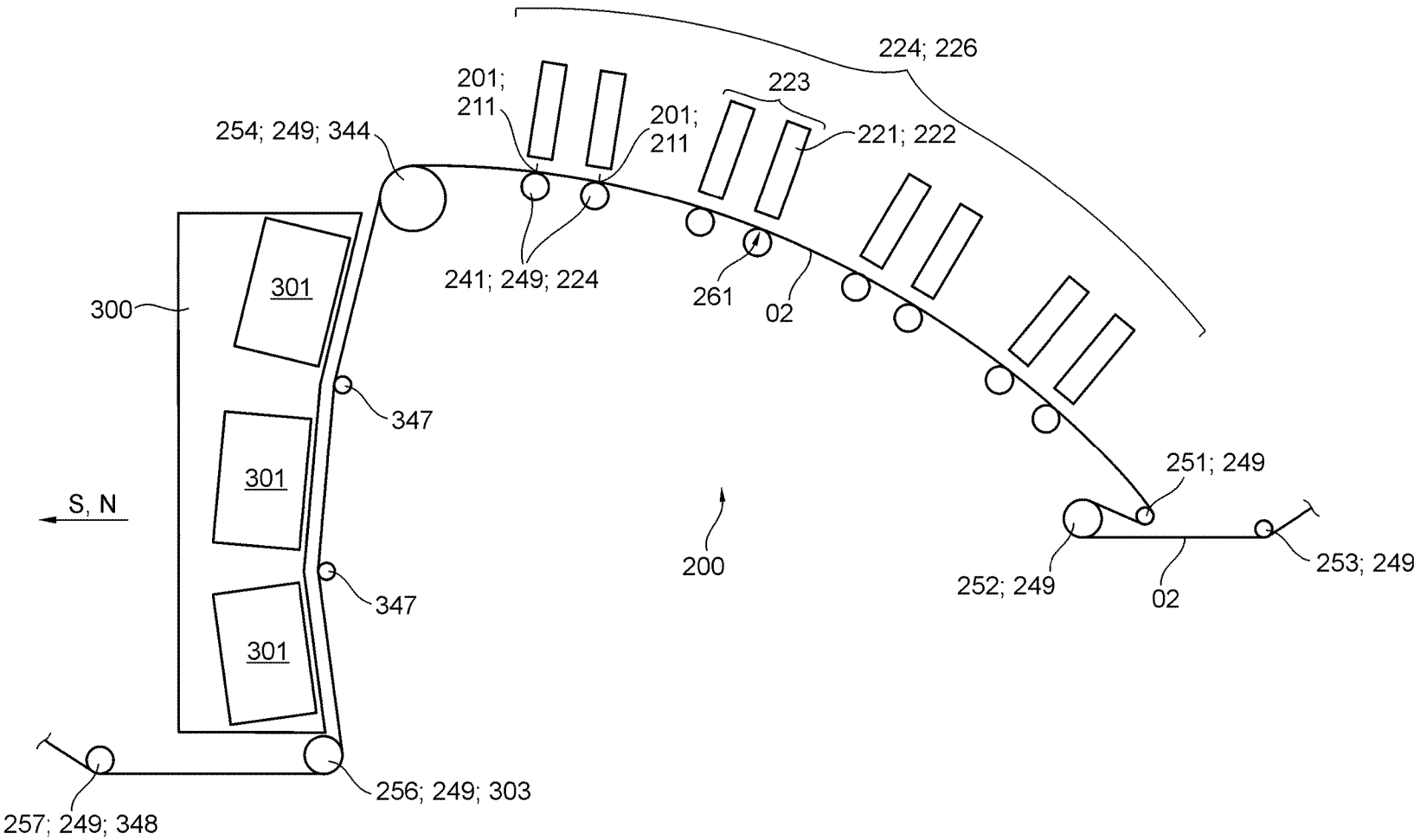
FIG. 1 a schematic diagram of a transport path for printing substrate through a printing assembly and a dryer.

In the preceding discussion as well as the following discussion, the concept of a printing fluid covers inks and printing inks as well as varnishes and pasty materials. Printing fluids are preferably materials that are and/or can be transferred by a printing machine 01 or at least one printing assembly 200 of the printing machine 01 to a printing substrate 02 and in doing so form a texture that is preferably visible and/or perceptible by sensory impression and/or machine detectable on the printing substrate 02 in a finely structured form and/or not merely over a large area. Inks and printing inks are preferably solutions or dispersions of at least one coloring agent in at least one solvent. Solvents include, for example, water and/or organic solvents. Alternatively or additionally, the printing fluid may be embodied as a printing fluid that crosslinks under UV light. Inks are relatively low-viscosity printing fluids and printing inks are relatively high-viscosity printing fluids. Inks preferably do not contain a binder or contain relatively little binder, whereas printing inks preferably contain a relatively large amount of binder and more preferably contain additional additives. Coloring agents may be pigments and/or dyes, pigments being insoluble in the application medium, whereas dyes are soluble in the application medium.

For the sake of simplicity, unless differentiated explicitly and named accordingly, the term "printing ink" or "printing fluid" is to be understood in the preceding discussion as well as the following discussion as a liquid or at least a free-flowing coloring fluid which is used for printing in the printing machine and which includes not only the higher-viscosity coloring fluids more associated in the vernacular with the term "printing ink" for use in rotary printing machines, but in particular also low-viscosity coloring fluids such as "inks" in particular inkjet inks but also powdered coloring fluids, for example, toner, in addition to these higher-viscosity coloring fluids. Thus when printing fluids and/or inks and/or printing inks are mentioned in the preceding discussion as well as in the following discussion, they also refer in particular to colorless varnishes. In particular agents for pretreatment (so-called precoating) of the printing substrate 02 are also intended in the preceding discussion and in the following discussion when reference is made to printing fluids and/or inks and/or printing inks. As an alternative to the term "printing fluid," the concept of a coating agent is to be understood as synonymous.

A printing machine 01 is understood here to be a machine, which applies or is capable of applying a printing fluid to a printing substrate 02. A printing machine 01 preferably has at least one printing substrate source 100, preferably at least one first printing assembly 200, preferably at least one first means that supports drying, i.e., a first auxiliary drying means 301, for example, a first dryer 301 and preferably at least one post-processing device. The printing machine 01 optionally has, for example, at least one second printing assembly and, for example, at least one second means to support drying, i.e., an auxiliary drying means, for example, a second dryer. The printing machine 01 is preferably embodied as an inkjet printing machine 01. The printing machine 01 is preferably embodied as a rotary printing machine 01, more preferably as a rotary inkjet printing machine 01. The printing machine 01 may be embodied as a printing machine 01 that operates according to the inkjet printing method, in particular as an inkjet printing machine 01—on the whole or optionally in addition to other non-impact printing methods and/or printing forme-based methods. The at least one first printing assembly 200 is preferably embodied as at least one first inkjet printing assembly 200. The printing assembly 200 is preferably a printing assembly 200 for processing web-type printing substrate 02 in particular.

In the case of a rotary printing machine 01, the printing substrate source 100 is embodied as a roll unwinding device 100. At least one printing substrate 02 is preferably aligned in the printing substrate source 100, preferably at least with respect to one edge of this printing substrate 02. In the roll unwinding device 100 of a rotary printing machine 01, at least one web-type printing substrate 02, i.e., a printing substrate web 02, preferably a paper web 02, is unwound from a printing substrate roll 101 and preferably aligned with respect to its edges in an axial direction A. The axial direction A is preferably a direction A extending parallel to an axis of rotation of a printing substrate roll 101 in a transverse direction A. The transverse direction A is preferably a direction A running horizontally. The transverse direction A is oriented orthogonally to a transport direction provided for the transport of web-type printing substrate 02 in particular and/or orthogonally to a transport path provided for the printing substrate 02 through the at least one first printing assembly 200. Downstream of the at least one printing substrate source 100, the transport path provided for transport of the at least one printing substrate 02 and in particular the printing substrate web 02 preferably runs through the at least one first printing assembly 200, where the printing substrate 02 and in particular the printing substrate web 02 are preferably provided with a print image on one side by means of at least one printing ink.

In the case of a curved transport path, the transport direction is preferably the direction that runs tangentially to the partial piece and/or point of the provided transport path that is closest to a respective reference point. This respective reference point is preferably located at the point and/or on the component to which the transport direction is referenced.

The invention is described in greater detail below on the basis of an inkjet printing machine 01. However, the invention can also be used for other non-impact printing methods or completely different printing methods such as, for example, rotary printing, offset printing, planographic printing, letterpress printing, screen printing or intaglio printing inasmuch as this does not result in any contradictions. The invention is described below in conjunction with a web-type printing substrate 02, i.e., a printing substrate web 02. However, corresponding features are preferably equally applicable to printing machines 01 for sheet-type printing substrate 02 inasmuch as this does not result in any contradictions.

At least one printing substrate roll 101 is arranged rotatably in the roll unwinding device 100. In a preferred embodiment, roll unwinding device 100 is embodied to be suitable for accommodating a printing substrate roll 101, so it has only one storage position for a printing substrate roll 101. In another embodiment, roll unwinding device 100 is embodied as a reel changer 100 and has storage positions for at least two printing substrate rolls 101. Reel changer 100 is preferably embodied such that it permits a flying reel change, i.e., a first printing substrate web 02 of a printing substrate roll 101 currently being processed is connected to a second printing substrate web 02 of a printing substrate roll 101 to be subsequently processed, while both the printing substrate roll 101 currently being processed and the printing substrate roll 101 to be processed subsequently are rotating.

Downstream from a roll holding device along the transport path provided for printing substrate web 02, roll unwinding device 100 preferably has a dancer roller, preferably arranged deflectably on a dancer lever, and/or a first web edge aligner and/or an infeed unit including an infeed nip formed by a draw roller and a draw impression roller and a first measuring device embodied as a first measuring roller, in particular an infeed measuring roller. This draw roller preferably has its own drive motor embodied as a pulling drive motor, which is preferably connected to a machine controller. The web tension is adjustable by means of the dancer roller and can be kept within limits and/or the web tension is preferably kept within limits. The roll unwinding device may have a gluing and cutting device if necessary, by means of which a reel change can proceed as a flying operation, i.e., without stoppage of printing substrate web 02. The infeed unit is preferably arranged downstream of the first web edge aligner. The at least one draw roller, which together with the draw impression roller preferably forms the infeed nip, is preferably provided as a component of the infeed unit. The infeed nip serves to regulate web tension and/or to transport printing substrate 02.

A printing assembly 200 is understood to be a device, by means of which a web-type or sheet-type printing substrate 02 is or can be provided with at least one printing fluid on at least one side. The at least one first printing assembly 200 of printing machine 01 preferably has at least one printing couple 201. A printing couple 201 is understood to be preferably an entire region in which contact is or can be established between a respective same printing fluid and a printing substrate 02. The term printing couple 201 should also be used when the printing fluid is applied to printing substrate 02 without pressure between the printing substrate 02, on the one hand, and a component transferring the printing fluid, on the other hand, for example, by impact of freely mobile printing fluid on the printing substrate 02, for example, flying droplets of the printing fluid. A printing couple 201 preferably includes all regions provided for impact of a certain printing fluid assigned in particular to said printing couple 201 on the printing substrate 02. In the case of a printing assembly 200 operating according to the inkjet printing method, a printing couple 201 preferably comprises all regions intended for impact of a black ink on a first side of printing substrate 02.

The at least one first printing assembly 200 preferably has a plurality of printing couples 201, each of which is assigned a respective printing fluid, for example, at least four printing couples 201 preferably at least five printing couples 201, more preferably at least six printing couples 201 and even more preferably at least seven printing couples 201.

A working width of printing machine 01 and/or the at least one printing assembly 200 is a dimension that preferably extends orthogonally to the provided transport path of printing substrate 02 through the at least one first printing assembly 200, more preferably in transverse direction A. Transverse direction A is preferably a direction running horizontally. Transverse direction A is oriented orthogonally to the designated transport direction of printing substrate 02 and/or orthogonally to the provided transport path of printing substrate 02 through the at least one printing assembly 200. The working width of printing machine 01 preferably corresponds to a maximum width allowed for a printing substrate 02 in order to be able to be processed with printing machine 01, i.e., a maximum printing substrate width that can be processed with printing machine 01. The working width of printing machine 01 preferably corresponds to the working width of the at least one first printing assembly 200. More particularly, the working width of printing assembly 200 preferably corresponds to the maximum width allowed for printing substrate 02 in order to be processable with printing assembly 200, i.e., a maximum printing substrate width that can be processed with printing assembly 200.

Each printing couple 201 preferably has at least one application position 211. Each application position 211 is preferably associated with at least one image-generating device 221, in particular at least one print head 221 and more preferably at least one print head row 222. Each application position 211 preferably extends in the transverse direction A, more preferably over the total working width of printing machine 01. In the case of an inkjet printing machine 01, the at least one image-generating device 221 is preferably embodied as at least one print head 221, in particular inkjet print head 221. The at least one printing assembly 200 preferably has at least two print heads 221. For example, the at least one printing assembly 200 is characterized in that the at least two print heads 221 are embodied as print heads 221 configured for a non-impact printing method and more preferably in that the at least two print heads 221 are embodied as inkjet print heads 221. Image-generating devices 221 such as print heads 221, for example, usually have limited dimensions, in particular in transverse direction A. This results in a limited region of printing substrate 02 to which printing fluid can be applied by a respective print head 221. Therefore, a plurality of image-generating devices 221 or print heads 221 are typically arranged one after the other in transverse direction A. Such print heads 221 arranged one after the other with respect to transverse direction A are referred to as a print head row 222. Interrupted print head rows 222 and continuous print head rows 222 are described in the following discussion. In the special case of a print head 221 extending over the total working width, this should likewise be considered as a print head row 222, in particular as a continuous print head row 222.

Such individual print heads 221 typically are not provided with nozzles up to the edge of their housing. For that reason, preferably at least two and more preferably exactly two print head rows 222 extending in transverse direction A are arranged offset relative to one another along the transport path provided for printing substrate 02. Such print head rows 221 are interrupted print head rows 222, for example. Two such interrupted print head rows 222, in particular, together form a double row 223 of print heads 221. The total working width of the printing machine 01 and/or of the at least one first printing assembly 200 can preferably be reached by nozzles of the print heads with a correspondingly offset arrangement of print heads 221 of the two interrupted print head rows 222. A plurality of print head rows 222, more preferably at least four double rows 223 and even more preferably at least eight double rows 223 of print heads 221 are preferably arranged one after the other in a direction orthogonal to transverse direction A, in particular in the transport direction along the provided transport path of printing substrate 02, in particular being aligned with the transport path provided for the transport of printing substrate 02. A printing fluid, in particular an ink of a certain color, preferably is and/or can be associated with each double row 223 of print heads 221, for example, one of the colors black, cyan, yellow and magenta, or a varnish, for example, a clear varnish, or an agent or a substance mixture for a pretreatment (precoating) of printing substrate 02, or a special color. With a corresponding configuration of print heads 221, it is also alternatively conceivable to arrange a continuous print head row 222, the nozzles of which jointly cover the entire working width of printing machine 01.

Each nozzle is preferably assigned an unambiguously defined target region in direction A along the width of printing substrate web 02 and preferably along transverse direction A. Each target region of a nozzle is preferably defined unambiguously at least in the printing operation. The target region of a nozzle is, in particular, the substantially rectilinear spatial region that extends, in particular, in the ejection direction of that nozzle. An impact region is preferably a region provided for contact of printing fluid with printing substrate 02, in particular for droplets of printing fluid with printing substrate 02. An impact region is preferably associated with each nozzle of a print head 221, in particular in a direct inkjet printing method. An impact region of a print head 221 is preferably the sum of all impact regions of nozzles of that print head 221. An application position 211 is preferably the sum of application regions of print heads 221 that are functionally combined, in particular, and that together span the total working width of printing machine 01. In the case of pairs of interrupted print head rows 222 embodied as double rows 223, an application position 211 is preferably the sum of impact regions of print heads 221 that together form the double row. In the case of continuous print head rows 222 an application position 211 is preferably the sum of impact regions of print heads 221 that together form the continuous print head row 222.

For example, a plurality of application positions 211 are associated with at least one printing fluid, for example in such a way that two double rows 223 of print heads 221 eject or are capable of ejecting the same printing medium. This is expedient, for example, for increasing the resolution of a print image and/or for increasing the speed of a printing operation. This plurality of application positions 211 then together form the printing couple 201 associated with this printing medium.

For example, a first printing couple 201 and/or a first application position 211 along the provided transport path is/are used for applying an agent or a substance mixture for pretreatment (precoating) of the printed substrate 02. This agent or substance mixture can thereby be applied selectively and in a targeted manner to printing substrate 02, in particular only in locations where there is to be another treatment of the printing substrate 02 necessitating such a pretreatment, for example, application of another printing fluid.

A printing assembly 200 comprises, for example, just one printing couple 201, for example, for the color black. However, as already described, the at least one first printing assembly 200 preferably has a plurality of printing couples 201. The printing couples 201 may be connected directly to one another spatially or may be spaced a distance apart from one another, for example, being separated according to colors. The concept of a printing couple 201 is also meant to include a section that includes multiple successive application positions 211 of the same color—for example, without being interrupted by another color. However, if one or more application positions 211 of a color, as seen along the transport path provided for printing substrate 02, are separated by at least one single or multiple application position (s) 211 of at least one other color, then these represent two different printing couples 201 in this sense. In the case of just one printing couple 201, this represents the first and last printing couples 201 of the respective printing assembly 200 at the same time. In the case of an indirect inkjet printing method, for example, a printing couple is a contact region between a transfer body and the printing substrate 02.

The at least one printing assembly 200 preferably has at least one print head 221, which is more preferably embodied as at least one inkjet print head 221. Each print head 221 preferably has a plurality of nozzles, from which droplets of printing fluid, in particular ink droplets, are and/or can be ejected. The at least one printing assembly 200 preferably has at least one nozzle bar 231. A nozzle bar 231 is a component preferably extending over at least 80%, and more preferably at least 100% of the working width of printing machine 01 and/or preferably serving as a holder of the at least one print head 221. For example, a single nozzle bar or preferably a plurality of nozzle bars 231 are provided per printing assembly 200. More preferably, the at least one printing assembly 200 has at least three nozzle bars 231, even more preferably at least five nozzle bars 231, and more preferably still at least fourteen (14) nozzle bars 231.

The at least one first nozzle bar 231 preferably extends orthogonally to the provided transport path of printing substrate 02 over the entire working width of printing machine 01, in particular in transverse direction A. The at least one nozzle bar 231 preferably has at least one row of nozzles, in particular due to the fact that at least one print head 221 having nozzles is arranged on the at least one nozzle bar 231. The at least one row of nozzles preferably has nozzle openings at regular intervals over the entire working width of printing machine 01 as seen in transverse direction A. In one embodiment, a single continuous print head 221 is provided, extending over the entire working width of printing machine 01 in transverse direction A. In another preferred embodiment, a plurality of print heads 221 are arranged side by side in transverse direction A on the at least one nozzle bar 231.

The at least one nozzle bar 231 preferably has at least one print head 221 and preferably several print heads 221. If the at least one nozzle bar 231 has only one print head 221, this print head 221 preferably extends over the entire working width of printing machine 01. If the at least one nozzle bar 231 has a plurality of print heads 221, these print heads 221 are preferably embodied as at least one print head row 221 or more preferably as at least one double row 223 of print heads 221, and the at least one print head row 222 or double row 223 of print heads 221 preferably extends over the total working width of printing machine 01. In the case of a double row 223 of print heads 221, the at least one row of nozzles of the respective nozzle bar 231 is preferably divided into at least two interrupted print head rows 222.

If one print head 221 has a plurality of nozzles, then all the target regions of the nozzles of this print head 221 together form a working region of this print head 221. Working regions of print heads 221 of a nozzle bar 231 and in particular of a double row of print heads 221 adjoin one another as seen in the transverse direction A and/or overlap in the transverse direction A. In this way even with a non-continuous print head 221 in transverse direction A, it is ensured that target regions of nozzles of the at least one nozzle bar 231 and/or in particular of each double row 223 of print heads 221 are preferably situated in regular and preferably periodic intervals as seen in transverse direction A. In any case, the total working region of the at least one nozzle bar 231 preferably extends over at least 90% and more preferably at least 100% of the working width of printing machine 01 in transverse direction A and/or the total width of a printing substrate guide 249. A narrow region of printing substrate web 02 and/or of the width of printing substrate guide 249 that does not belong to the working region of nozzle bar 231 may be provided on one or both sides with respect to transverse direction A.

The total working region of the at least one nozzle bar 231 is preferably made up of all the working regions of print heads 221 of this at least one nozzle bar 231 and is preferably made up of all the target regions of nozzles of these print heads 221 of this at least one nozzle bar 231. A total working region of a double row 223 of print heads 221 as seen in transverse direction A preferably corresponds to the working region of the at least one nozzle bar 231. A printing fluid of a certain color preferably is and/or can be associated with each double row 223 of print heads 221, for example, one of the colors black, cyan, yellow and magenta, or a varnish, for example, a clear varnish. Preferably, all the working regions of print heads 221 of the at least one first printing assembly 200 together form a working region of this at least one first printing assembly 200.

The at least one nozzle bar 231 preferably has a plurality of rows of nozzles in a conveyance direction of a printing substrate guide 249. This conveyance direction of the printing substrate guide 249 is preferably identical to the transport direction of the transport path provided for transport of printing substrate 02. Each print head 221 preferably has a plurality of nozzles, which are more preferably arranged in a matrix of several rows in transverse direction A and/or several columns, preferably in the conveyance direction of printing substrate guide 249, with such columns being arranged so that they run obliquely to the conveyance direction of printing substrate guide 249, for example, to increase the resolution of the print image.

The at least one print head 221 preferably works according to the drop-on-demand method in creating printing ink droplets, in which printing ink droplets are created in a targeted manner as needed. At least one heating element is preferably used per nozzle, creating evaporation of printing fluid within a reservoir. Alternatively, at least one piezo element is used per nozzle and can reduce the volume filled with printing ink by a certain percentage at a high speed when a voltage is applied.

In the drop-on-demand method, droplet deflection after ejection from the corresponding nozzle is not necessary because it is possible to define a target position of the respective printing ink droplet on the moving web of printing substrate 02 with respect to the direction of conveyance of printing substrate guide 249 based solely on the emission point in time of the respective printing ink droplet and the conveyance speed of the printing substrate guide 249. By individual triggering of each nozzle, printing ink droplets are transferred from the at least one print head 221 to the printing substrate web 02 only at selected points in time and at selected locations. This occurs as a function of the conveyance speed and/or conveying means position of printing substrate guide 249, the distance between the respective nozzle and the printing substrate web 02 and the position of the target region of the respective nozzle with respect to the position of printing substrate guide 249 as seen in the transport direction. The result is therefore the desired print image, which is formed as a function of the actuation of all nozzles. Ink droplets are preferably ejected from the at least one nozzle of the at least one print head 221 as a function of the rotational position of the drive motor, which is determined by the machine controller. The setpoint data for the rotational position of the first drive motor, predetermined by the machine controller on the first drive motor, are preferably included in a real-time calculation of data for actuating the nozzles of the at least one print head 221. A comparison with actual data on the rotational position of the first drive motor is preferably not necessary and preferably does not take place. An accurate and constant position of printing substrate web 02 in relation to the first printing substrate guide 249 is therefore of great importance for maintaining color registration and register accuracy in print images.

The great accuracy of the setpoint data on the rotational position of the first drive motor of the printing substrate guide 249, the setpoint data being predetermined by the machine controller and processed by the first drive motor, permits a very accurate position determination and/or knowledge of the position of printing substrate web 02 relative to the nozzles and their target regions. A droplet flight time between the nozzles and printing substrate web 02 is known, for example, from a learning process and/or from the known distance between the nozzles and the printing substrate web 02 and a known droplet speed. An ideal point in time for ejection of a respective droplet is determined from the position of printing substrate guide 249 and/or of the first drive of printing substrate guide 249, the conveyance speed of printing substrate guide 249 and the droplet flight time, so that a replication of an image on printing substrate web 02 is achieved such that it maintains color registration and register accuracy.

A conveyor line, in particular a conveyor line for printing substrate 02, preferably comprises the devices 241; 251; 252; 253; 254; 256; 257; 303; 306; 343; 344 that define a transport path for printing substrate 02, for example, rollers, cylinders, guide elements and the like. A conveyor line of the at least one first printing assembly 200, which extends from a first printing couple 201 of the at least one first printing assembly 200, along the transport path provided for the printing substrate 02, up to the last printing couple 201 of the at least one first printing assembly 200, along the transport path provided for printing substrate 02, is referred to as the printing line 224 of the at least one first printing assembly 200. The provided transport path is the spatial region that would be occupied by printing substrate 02 in the case of its presence. The conveyor line of the at least one first printing assembly 200 preferably comprises those devices 241; 251; 252; 254; 256 that define the transport path through the at least one first printing assembly 200, in particular both the provided transport path independently of the presence of the printing substrate 02 and the actual transport path in the presence of printing substrate 02. The part of the provided transport path of the printing substrate 02 defined by printing line 224 is referred to as the printing section 226 of the provided transport path.

The at least one printing assembly 200 preferably has a plurality of supporting points 261 along the printing section 226 of the transport path provided for printing substrate 02.

Figure 2:
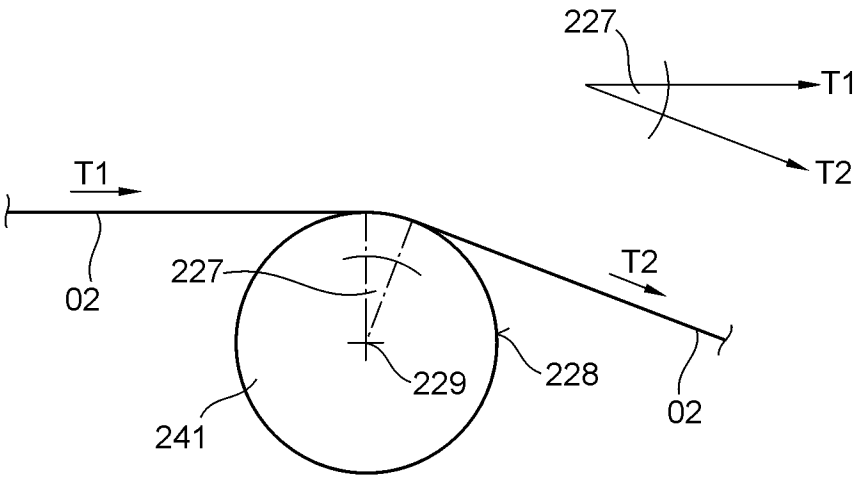
FIG. 2 a schematic diagram of a deflection of a printing substrate on a guide element.
Figure 3:
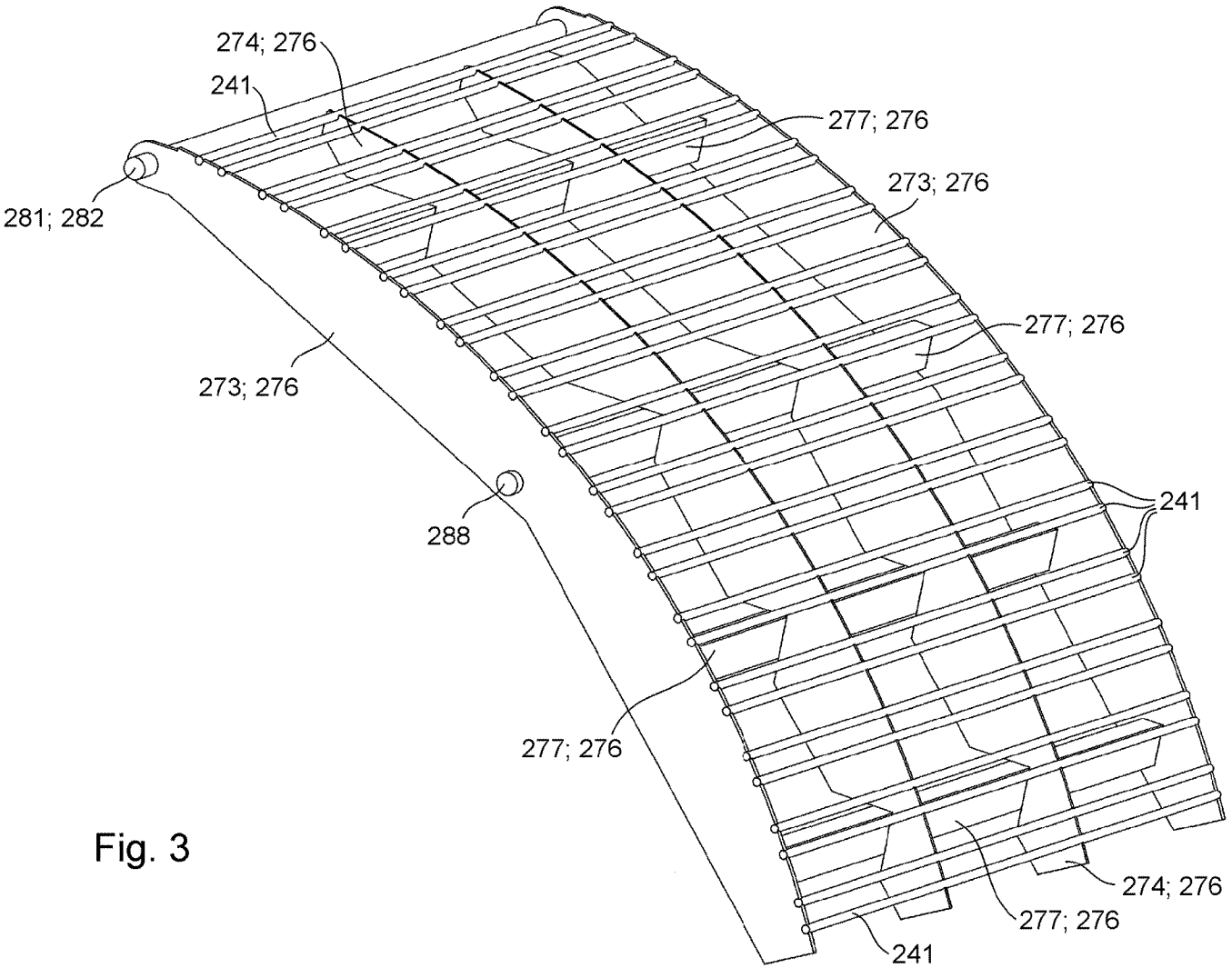
FIG. 3 a schematic diagram of a quantity of guide elements held by a common supporting frame.
Figure 4:
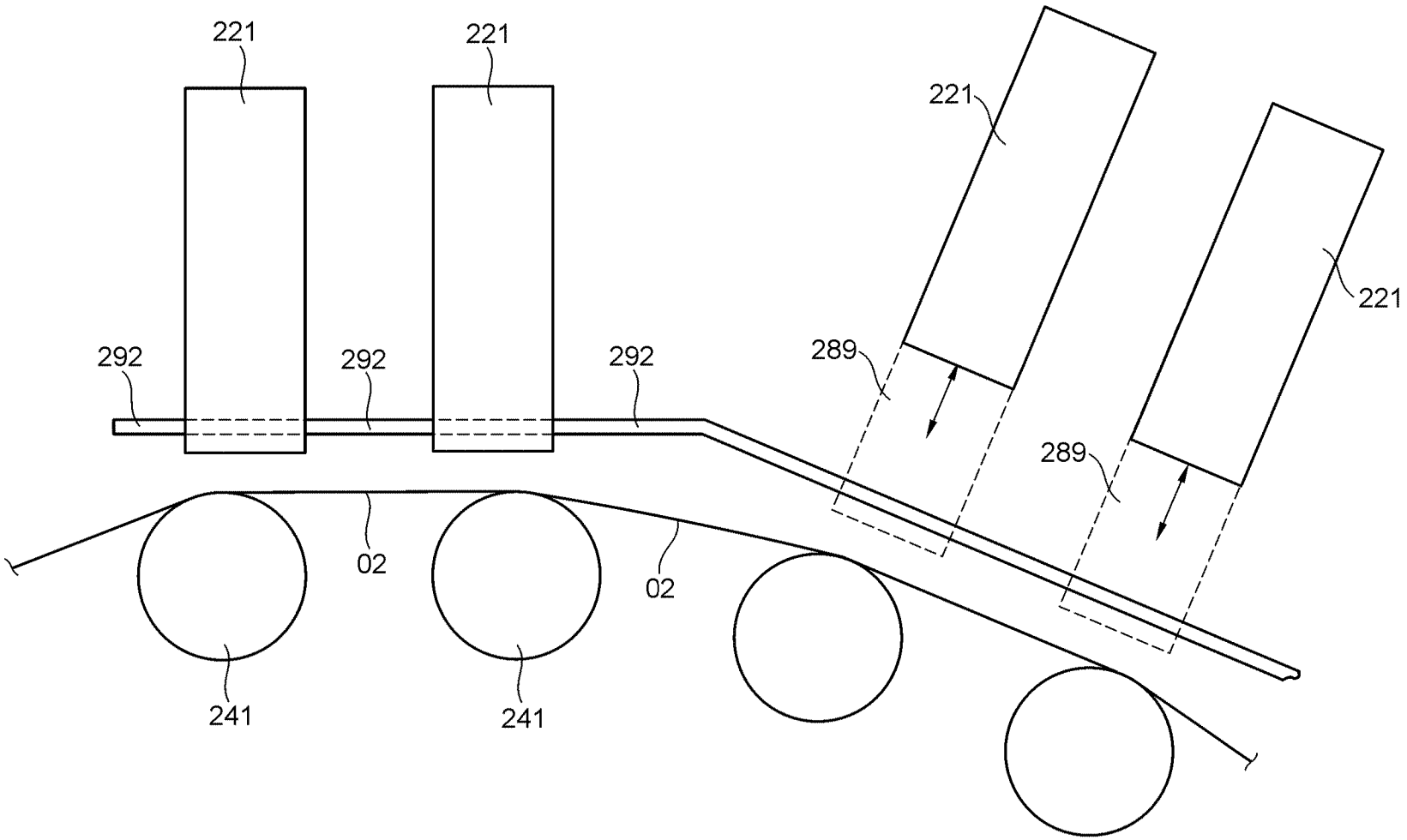
FIG. 4 a schematic diagram of a portion of a printing section.
Figure 5A:
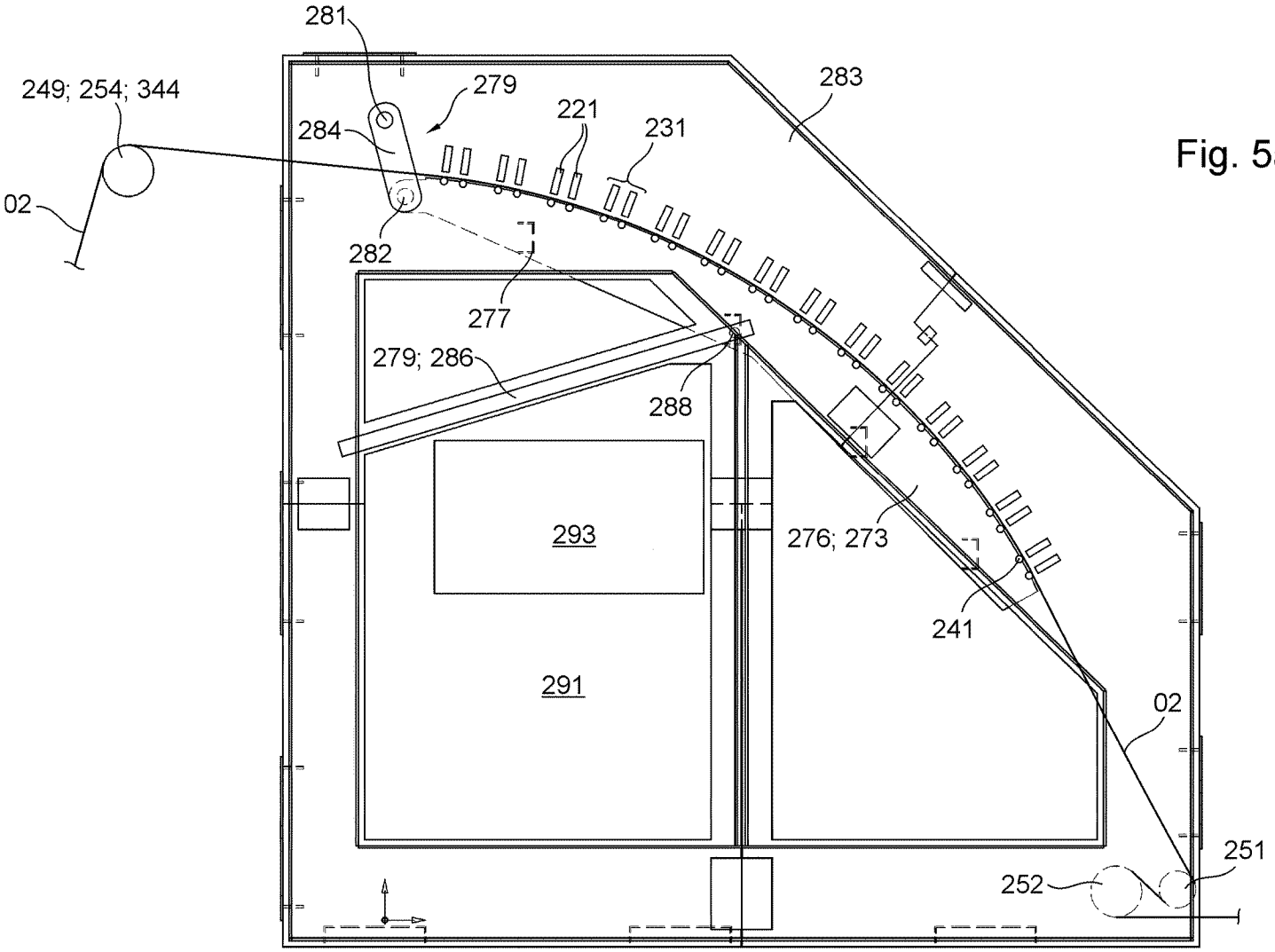
FIG. 5*a* a schematic diagram of a printing assembly with guide elements in a working position and print heads in a printing position.
Figure 5B:
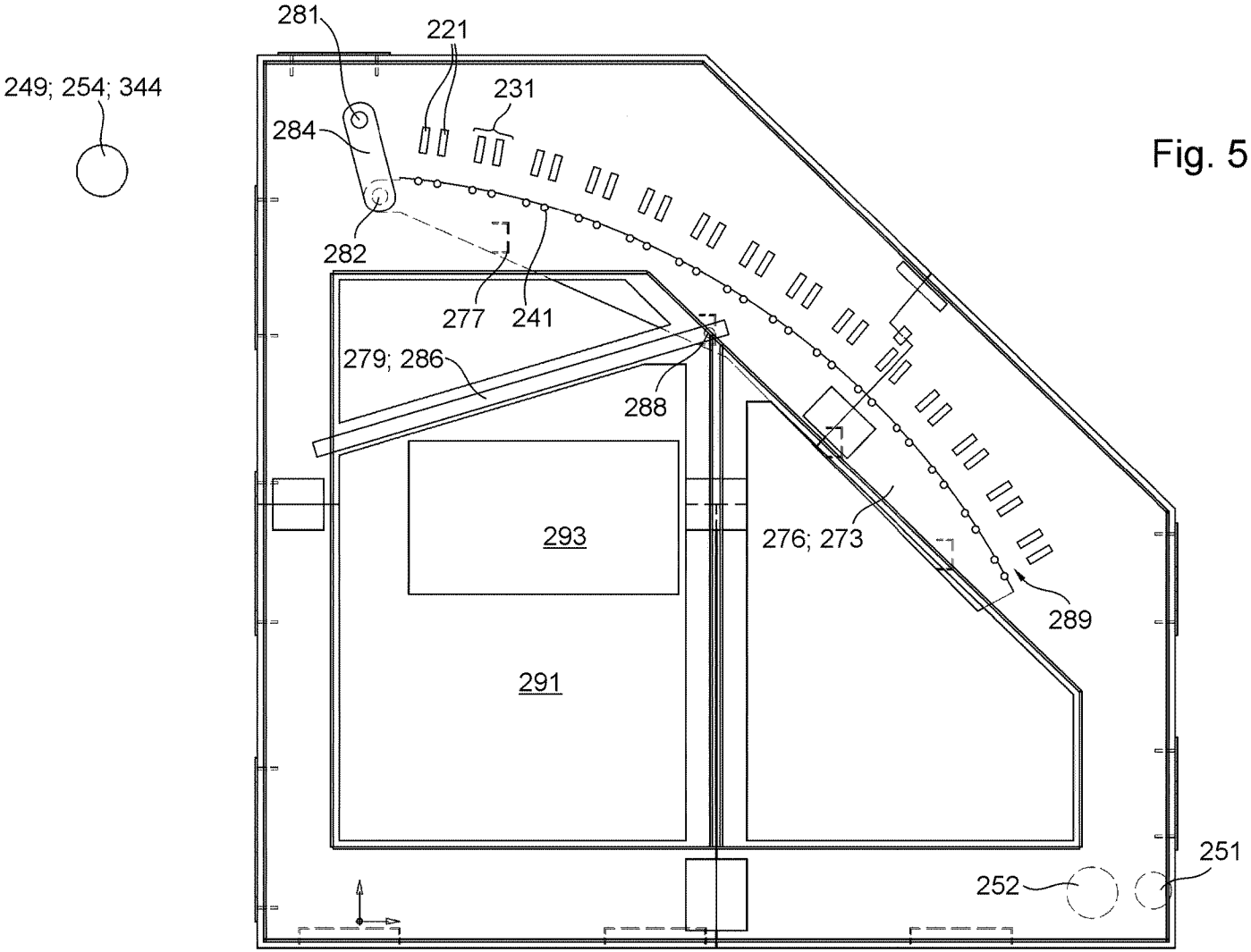
FIG. 5*b* a schematic diagram of a printing assembly according to FIG. 1 with guide elements in a working position and print heads in a throw-off position.
Figure 5C:
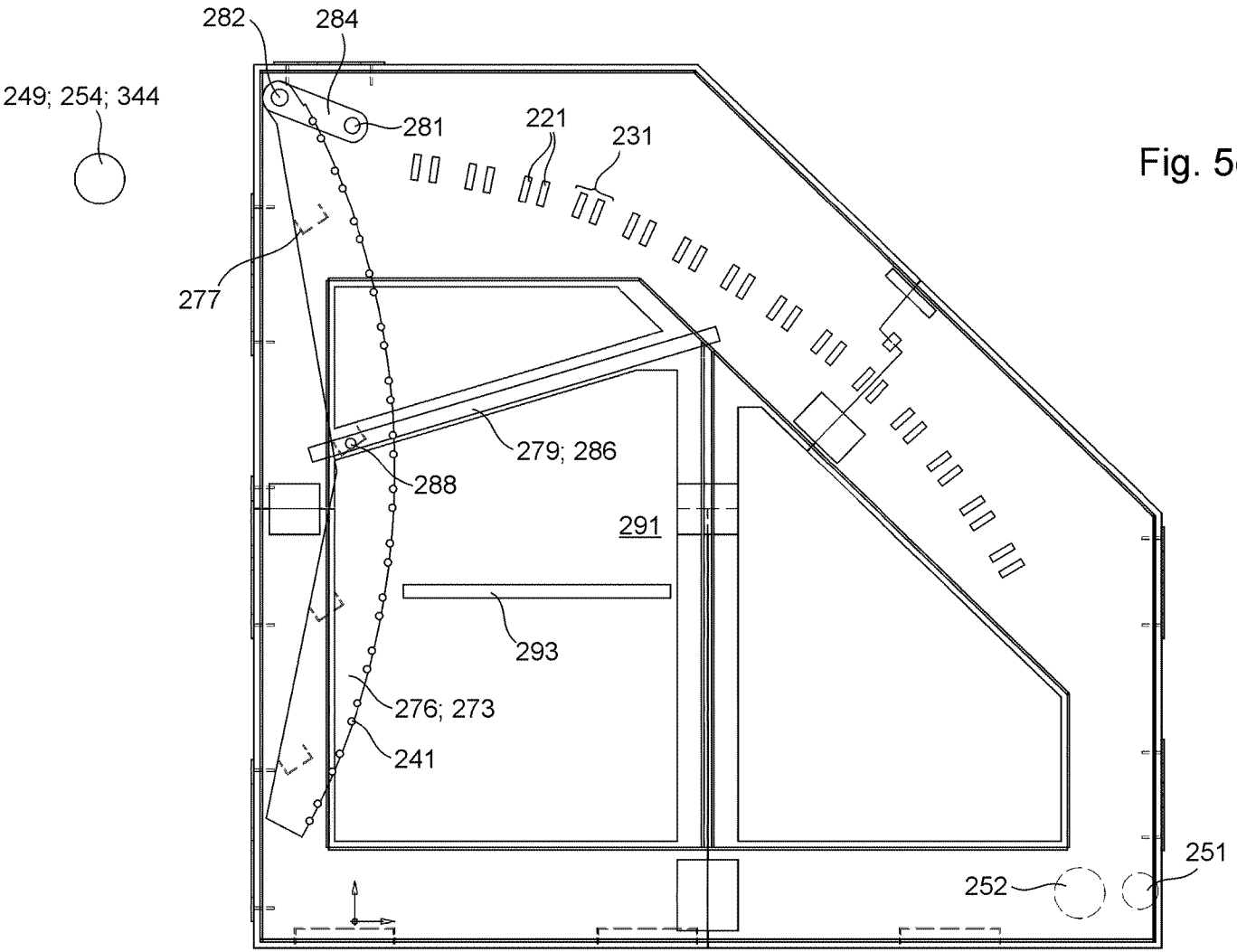
FIG. 5*c* a schematic diagram of a printing assembly according to FIG. 1 with guide elements in a maintenance position and print heads in a printing position.
Figure 6A:
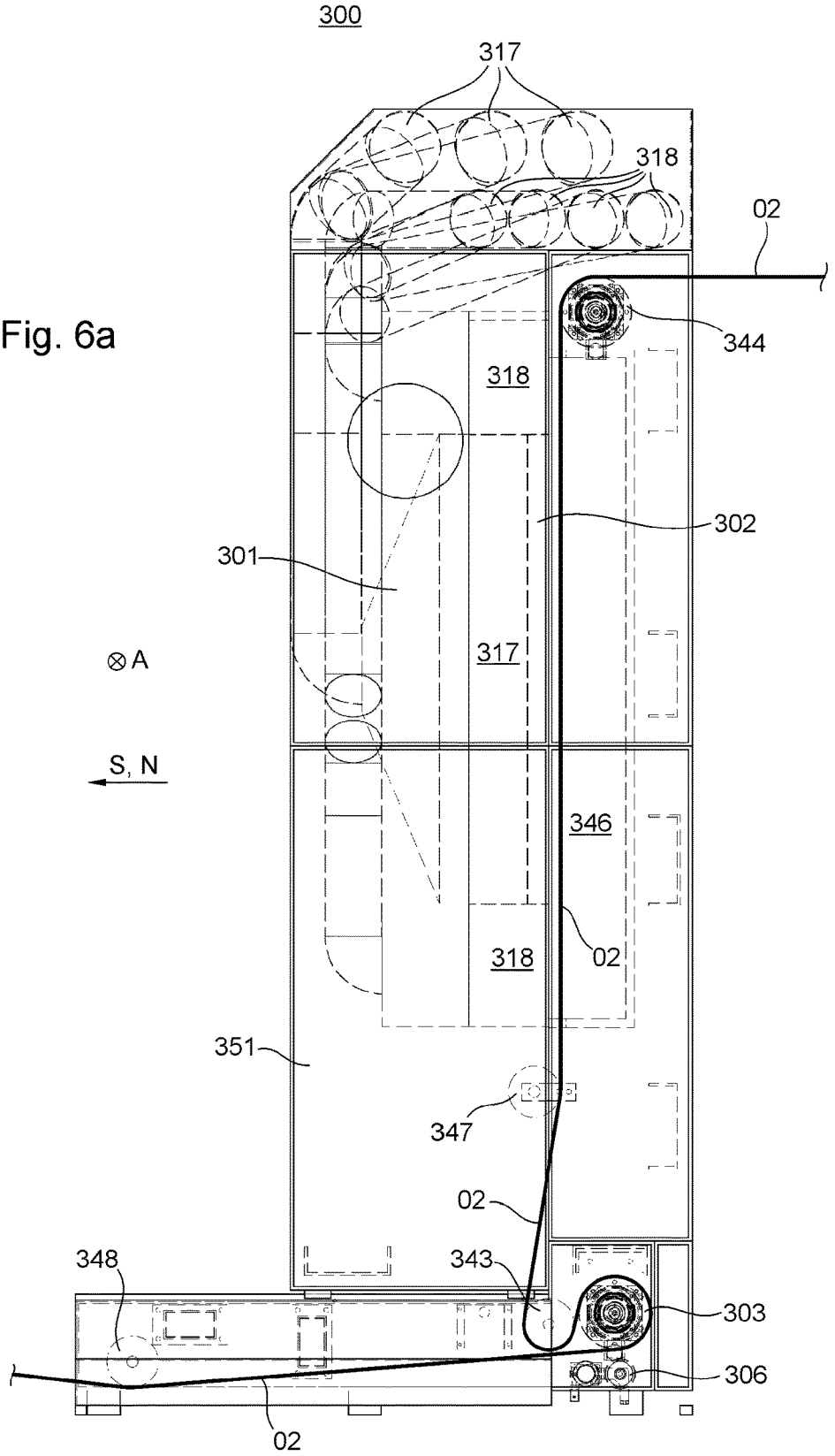
FIG. 6*a* a schematic diagram of a dryer unit of a printing machine, in which an energy output device is arranged in a working position.
Figure 6B:
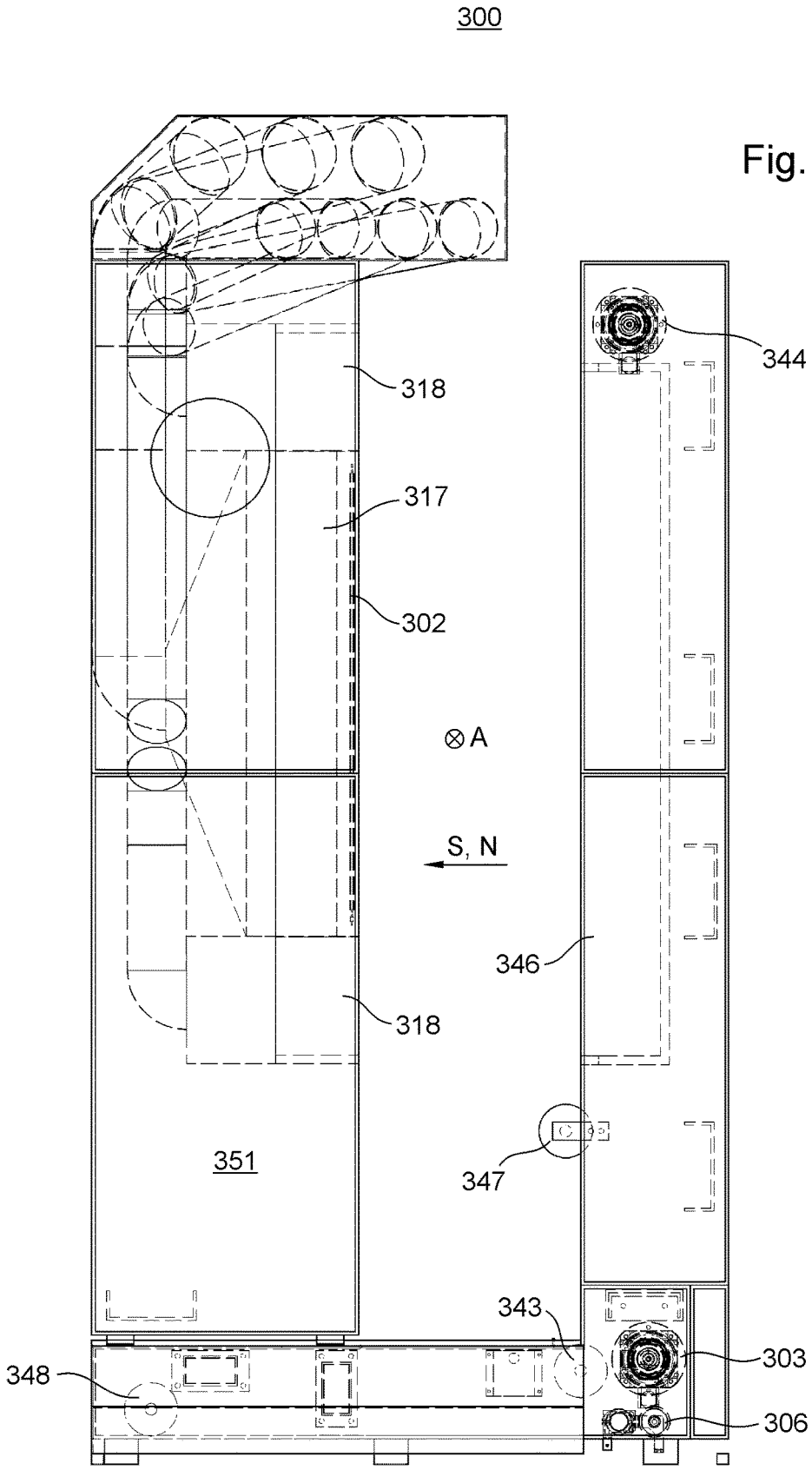
FIG. 6*b* a schematic diagram of a dryer unit of a printing machine, in which an energy output device is arranged in a throw-off position embodied as an access position, and in which a printing substrate or at least its provided transport path is indicated.
Figure 6C:
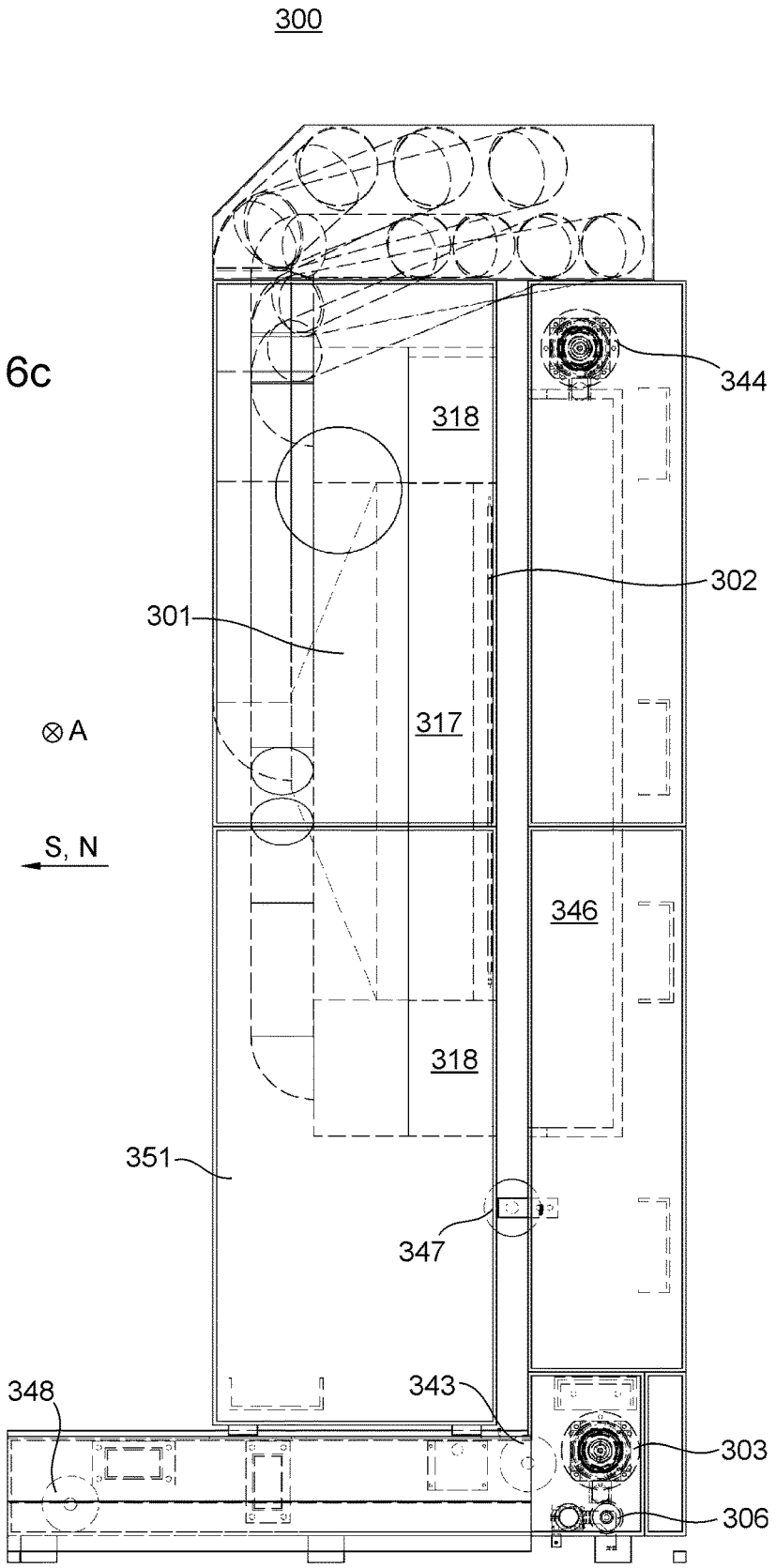
FIG. 6*c* a schematic diagram of a dryer unit of a printing machine, in which an energy output device is arranged in a throw-off position embodied as an infeed position.
Figure 7A:
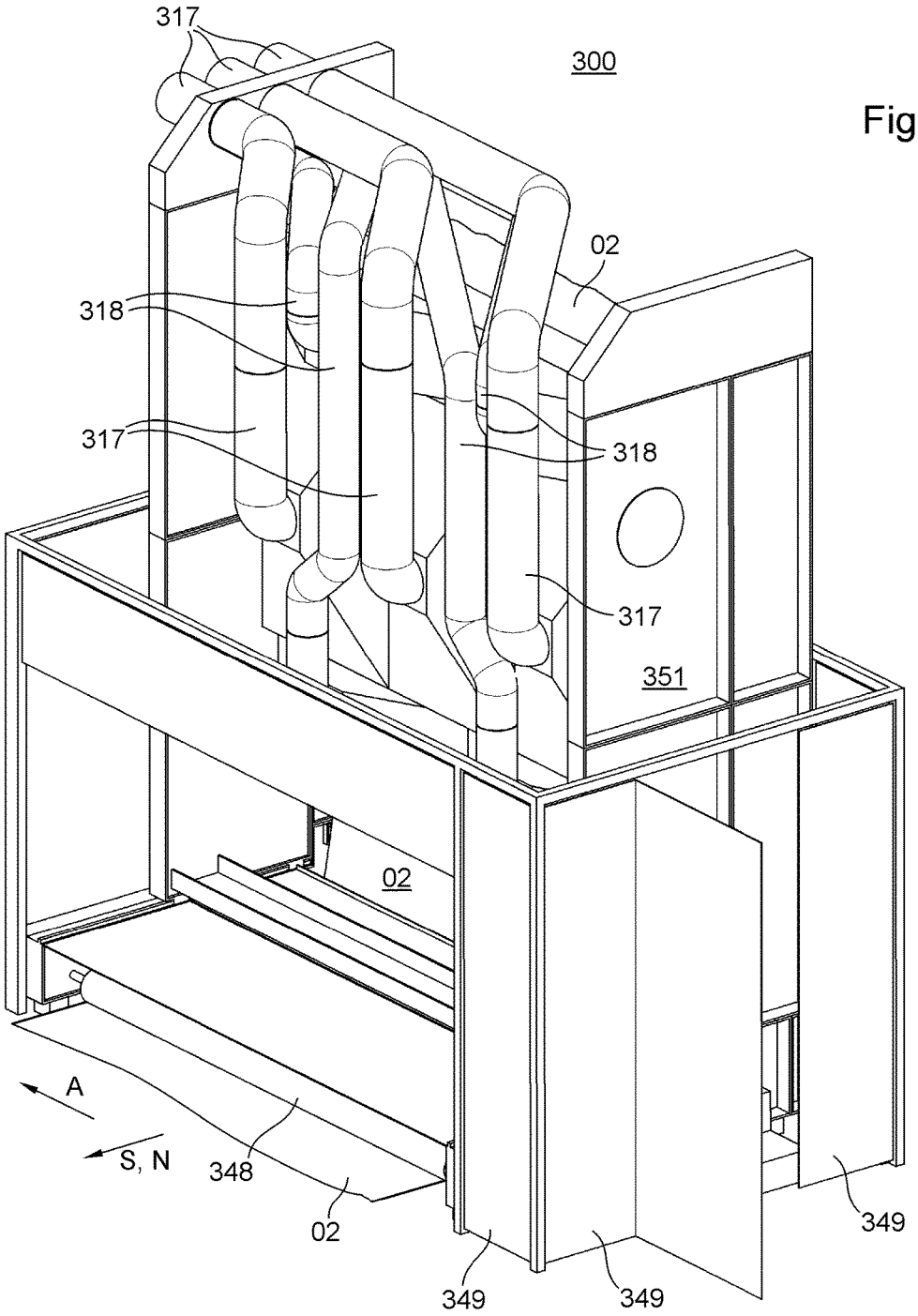
FIG. 7*a* a schematic perspective diagram of a dryer unit of a printing machine, in which an energy output device is arranged in a working position.
Figure 7B:
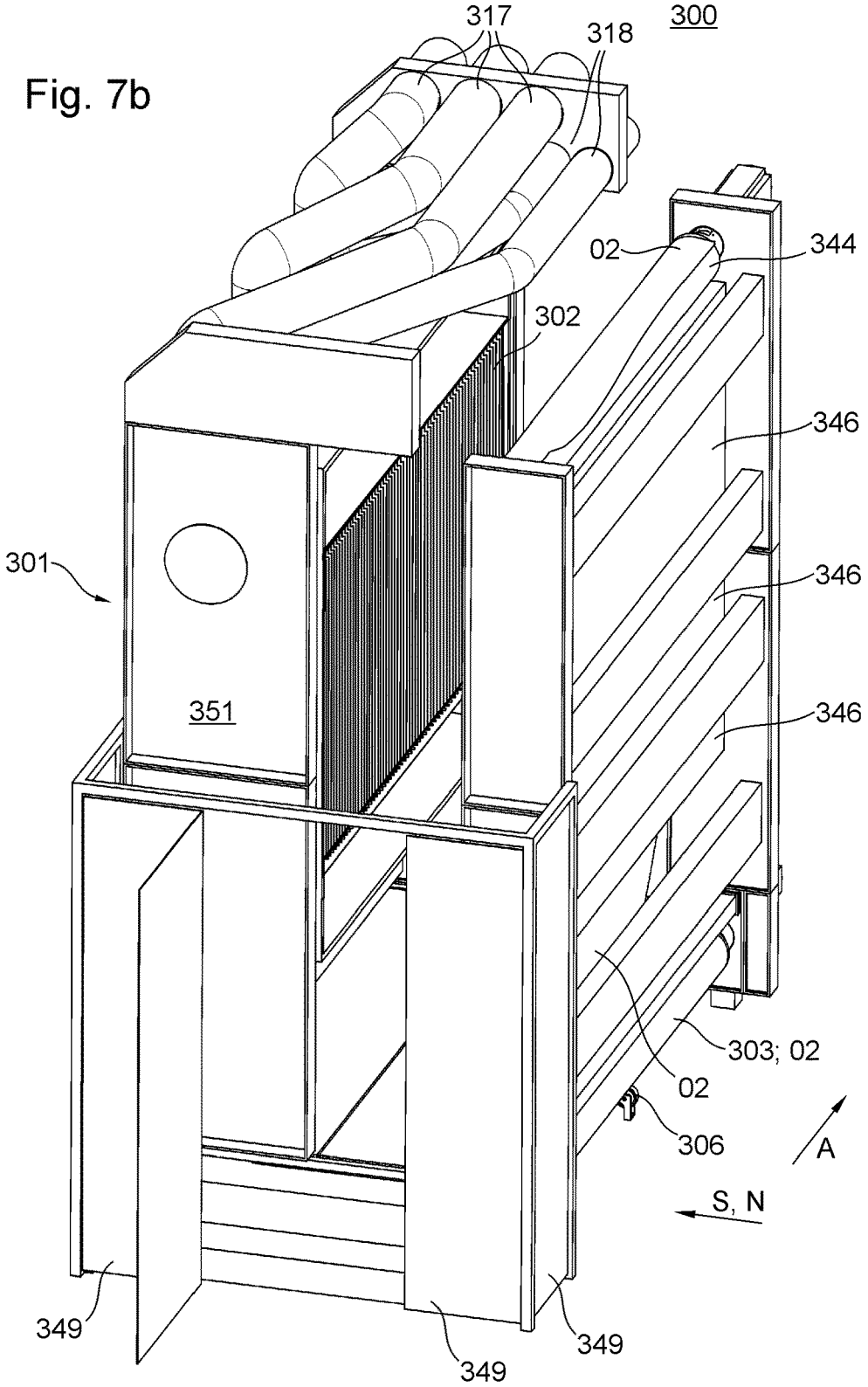
FIG. 7*b* a schematic perspective diagram of a dryer unit of a printing machine, in which an energy output device is arranged in a throw-off position embodied as an infeed position.

Supporting points 261 are preferably characterized in that the provided transport path is influenced with respect to its transport direction, for example being altered, at supporting points 261. These supporting points 261 are preferably defined by the respective guide elements 241. Guide elements 241 are preferably part of the printing substrate guide 249. Guide elements 241 are preferably devices that limit and deflect the transport path provided for printing substrate 02 and, in particular when printing substrate 02 is present, are preferably at least partially in contact with printing substrate 02. Guide elements 241 may include co-rotating and/or forcibly driven rollers and/or rolls and/or belt conveyor devices, but guide elements 241 are preferably embodied as integral or multi-part stationary guide elements 241. A deflecting angle 227 of a guide element 241 is preferably an angle between a first local transport direction T1 and a second local transport direction T2, wherein the first local transport direction T1 is a direction T1 of the transport path provided for printing substrate 02 in a region where the provided transport path runs up onto and/or is intended to run up onto guide element 241, and wherein the second local transport direction T2 is a direction T2 of the transport path provided for printing substrate 02 in a region where the provided transport path leaves and/or is intended to leave guide element 241. (This is also illustrated schematically as an example in FIG. 2.) Guide elements 241 are, in particular, components of the conveyor line. At least the guide elements 241 arranged in the region of printing section 226 of the transport path provided for printing substrate 02 are components of printing line 224, in particular.

The at least one guide element 241 preferably extends over the total working width of printing machine 01 in transverse direction A. A cross section of the at least one guide element 241 is preferably a cross section of the at least one guide element with a plane, the surface normal of which is oriented parallel to transverse direction A. The total cross section of the at least one guide element 241 is preferably the same as seen over the working width of printing machine 01, in particular independently of the position of the cross section within the working range of the at least one first printing assembly 200 and/or independently of the position of the cross section with respect to transverse direction A.

Relatively flat guide elements 241 are conceivable, for example, in the form of slightly curved metal plates. Preferably, however, the guide elements have a substantially cylindrical surface 228. The cross section of the at least one guide element 241 preferably has at least one curved outer border, in particular with a finite radius of curvature that is not equal to zero. This radius of curvature and therefore the radius of the guide elements 241 are preferably greater than 5 mm, more preferably greater than 10 mm and even more preferably greater than 13 mm. This radius of curvature and therefore the radius of guide elements 241 are preferably smaller than 50 mm, more preferably smaller than 30 mm and even more preferably smaller than 18 mm. This curved outer border is preferably at least in the range of the cross section that faces the transport region provided for printing substrate 02. The curvature is convex, in particular. More preferably, the total outer border of this cross section is curved. Even more preferably the border of this cross section is substantially circular.

The at least one guide element 241 preferably has an outer surface 228 in the form of a cylinder jacket, at least in the region of the working width of printing machine 01 and/or the at least one first printing assembly 200, more preferably over the total extent of the working width of printing machine 01 and even more preferably over the total extent of the at least one guide element in transverse direction A. The at least one guide element 241 is preferably embodied as at least one rod 241 with a substantially circular cross section, in particular as a cylindrical rod 241. The axis of curvature of surface 228 of rod 241 coincides, for example, with a central axis 229 of rod 241. Minimal flattening caused by wear, for example, should not be understood as deviating from the substantially circular cross section. An outer surface 228 of the at least one guide element 241 is preferably formed by at least one friction-reducing surface, for example, by a coating. This outer surface 228 of the at least one guide element 241 is formed by a chromium coating, for example. This outer surface 228 of the at least one guide element 241 is preferably the total circumferential surface 228 of guide element 241, which is preferably embodied as a rod 241, the circumferential surface being arranged in the region of the working width of printing machine 01. A plurality of the guide elements 241 are preferably embodied identically, more preferably all of guide elements 241 within printing line 224 of the at least one first printing assembly 200 are embodied identically.

Preferably, a plurality of such guide elements 241, in particular at least three, more preferably at least five and even more preferably at least fourteen, for example, twenty-eight, are arranged one after the other with respect to the transport path provided for printing substrate 02. Printing line 224 preferably includes a plurality of such guide elements 241 arranged one after the other. The arrangement of guide elements 241 of printing line 224 relative to one another defines the respective deflecting angle 227 for each guide element 241. The deflecting angles of guide elements 241 of printing line 224 are preferably substantially identical and deviate from those of the other guide elements 241 of printing line 224 at most in the region of a first and/or last guide element 241 of printing line 224.

When guide elements 241 are mentioned in the preceding discussion and/or the following discussion, preferably at least, and more preferably only those guide elements 241 of printing line 224 are intended. Deflecting angle 227 of the at least one guide element 241, more preferably of a plurality of the guide elements and even more preferably of all of guide elements 241 preferably amounts to at least 0.5° (zero point five degrees), more preferably at least 1° (one degree), and even more preferably at least 1.5° (one point five degrees). Deflecting angle 227 of the at least one guide element 241, more preferably of a plurality of the guide elements and even more preferably of all of guide elements 241 preferably amounts to at most 10° (ten degrees), more preferably at most 5° (five degrees) and even more preferably at most 2.5° (two point five degrees). Guide elements 241 of printing line 224 are preferably arranged along printing line 224 in the form of a curve, in particular an arc of a circle.

Guide elements 241 are preferably arranged immovably or fixed in at least one holding device, in particular immovably and/or fixed with respect to rotational movements about an axis of rotation that intersects the respective guide element 241. The respective at least one holding device is preferably deactivatable in terms of its holding function, for example, by releasing at least one closure device. By means of a preferred symmetry, in particular a radial symmetry or even rotational symmetry of the guide elements 241, it is possible to release the corresponding guide elements 241 from their fixed position in order to arrange them again in the holding device, rotated by a slight angle, and fix them there again, and thereby provide another preferably as yet unused region of surface 228, in particular of circumferential surface 228 of the corresponding guide element 241 for contact with printing substrate 02. This angle is preferably an integral fraction of a full angle, i.e., 360°/n, where n is a natural number. For example, the guide elements are rotationally symmetrical, for example, cylindrical.

At least one supporting element 273, 274 is preferably provided. The at least one supporting element 273, 274 preferably serves as a supporting device for the at least one guide element 241, more preferably for multiple guide elements 241 of printing line 224 and even more preferably for all guide elements 241 of printing line 224. The at least one supporting element 273 is embodied, for example, as at least one lateral supporting element 273. The at least one supporting element 273, 274 is preferably embodied as at least one supporting frame 276 or as part of at least one supporting frame 276, which has, for example, at least two lateral supporting elements 273, to which a plurality of guide elements 241 are attached more preferably directly and/or by means of holding devices. For example, the at least one supporting frame 276 has at least two frame crossbars 277, which are different from guide elements 241 and which extend at least in transverse direction A and ensure a constant relative position of the lateral supporting elements 273. In principle, this function can be assumed by the guide elements 241 themselves, in which case it should be noted that when all guide elements 241 are released from supporting elements 273, 274, the lateral supporting elements 273 are no longer secured relative to one another. For stability reasons, the arrangement of at least one frame crossbar 277 is preferred. The at least one lateral supporting element 273 preferably has at least one contact region per guide element 241, the respective guide element 241 resting on the lateral supporting element 273 or at least being in contact with the lateral supporting element 273 in this contact region. At least one inner supporting element 274 is preferably provided. The at least one inner supporting element 274 preferably serves at least to protect one or more or preferably all of guide elements 241 from unintentional sagging or at least unintentionally great sagging.

A print head row 222 is preferably associated with each guide element 241. Alternatively, multiple print head rows 222 may also be associated with each guide element 241, for example, if guide elements 241 are embodied not as rods but instead as flat guide elements. Preferably, one guide element 241 is associated with each print head row 222. Each nozzle of print heads 221 preferably has a respective ejection direction. Preferably, all nozzles of the same print head 221 have the same ejection direction. Preferably at least one, and more preferably each print head 221 of the at least one first printing assembly 200 has at least one nozzle, the imaginary extension of which in the ejection direction intersects a guide element 241, in particular the guide element 241 associated with this respective print head 221, with print head 221 arranged in the printing position and with guide element 241 arranged in the working position. More preferably, at least one and even more preferably each print head 221 of the at least one first printing assembly 200 has a plurality of nozzles, the imaginary extension of which in the ejection direction intersects a guide element 241, in particular the guide element 241 associated with this respective print head 221, with print head 221 arranged in the printing position and with guide element 241 arranged in the working position. More preferably, at least one and even more preferably each print head 221 of the at least one first printing assembly 200 has exclusively nozzles the imaginary extension of which in the ejection direction intersects a guide element 241, in particular the guide element 241 associated with this respective print head 221, with print head 221 arranged in the printing position and with guide element 241 arranged in the working position.

The shortest distance between a respective nozzle of a respective print head 221 arranged in its printing position, on the one hand, and the transport path provided for printing substrate 02 or the nearest guide element 241 arranged in its working position, on the other hand, preferably amounts to at least 0.1 mm, more preferably at least 0.5 mm and even more preferably at least 1.0 mm and preferably at most 5 mm, more preferably at most 3.0 mm and even more preferably at most 2.0 mm. The shortest distance between a respective nozzle of a respective print head 221 arranged in its printing position, on the one hand, and the printing substrate, on the other hand, preferably amounts to at least 0.1 mm, more preferably at least 0.5 mm and even more preferably at least 1.0 mm and preferably at most 5 mm, more preferably at most 3.0 mm and even more preferably at most 2.0 mm. These distances are correlated with one another over the thickness of the printing substrate 02.

Preferably at least one shielding device 292 is provided. The at least one shielding device 292 preferably serves to shield parts of the print heads, for example, their power supply device for electronics and/or for printing fluid and/or their holders and/or parts of nozzle bars 231 and/or supporting bodies 616, on the one hand, with respect to the transport path provided for printing substrate 02 and in particular the printing section 226 thereof, and/or with respect to a region that includes the nozzles of print heads 221. This prevents printing fluid from being deposited as soiling, for example, in the form of a fine ink mist, on parts of print heads 221 that might be impaired as a result. The at least one shielding device 292 preferably has at least one opening per print head 221, through which the respective print head 221 or at least its nozzles can protrude at least partially and do protrude even with the print head 221 arranged in its printing position. The openings are preferably substantially sealed by print heads 221 arranged in their printing positions. The at least one shielding device 292 is embodied, for example, as at least one shielding surface 292, in particular as at least one shielding plate 292. The at least one shielding device 292 is preferably arranged in a stationary position relative to the frame 283 of the at least one first printing assembly 200, in particular independently of the arrangement of the at least one print head 221 in its printing position or in its throw-off position and/or independently of the arrangement of the at least one guide element 241 and/or the supporting frame 276 in its working position or in its maintenance position.

At least one rotatable first web guide means 251 is preferably arranged upstream of the first guide element 241 of printing line 224 with respect to the transport path provided for printing substrate 02. This at least one first rotatable web guide means 251 is preferably embodied as a first motor-driven web guide means 251 and/or as a first web guide roller 251, in particular a first motor-driven web guide roller 251. For example, the at least one first web guide roller 251 has its own drive motor and/or the at least one first web guide roller 251 is part of at least one system for regulating the web tension of a web-type printing substrate 02. At least one rotatable second web guide means 254 is preferably arranged downstream of the last guide element 241 of printing line 224 with respect to the transport path provided for printing substrate 02. This at least one second rotatable web guide means 254 is preferably embodied as a second motor-driven web guide means 254 and/or a second web guide roller 254, in particular a second motor-driven web guide roller 254. For example, the at least one second web guide roller 254 has its own drive motor and/or the at least one second web guide roller 254 is part of the at least one system for regulating the web tension of web-type printing substrate 02. Web guide means 251; 253; 254; 257 and/or web guide rollers 251; 252; 253; 254; 256; 257 are preferably part of printing substrate guide 249.

Printing section 226 of the transport path provided for printing substrate 02 preferably runs with a monotonic slope. A first guide element 241 of printing line 224 is preferably the lowest positioned of all the guide elements 241 of printing line 224. The last guide element 241 of printing line 224 is preferably the guide element 241 positioned at the highest level in printing line 224.

The at least one printing assembly 200 preferably has at least one and more preferably exactly one pivot device 279. The at least one pivot device 279 is preferably associated with at least one, more preferably a plurality of, and even more preferably all of guide elements 241 of printing line 224. Multiple guide elements 241 and more preferably all guide elements 241 of printing line 224 are preferably arranged such that they are pivotable about at least one common pivot axis 281; 282, in particular by means of the at least one pivot device 279, in particular being pivotable along a respective individual pivot path and/or a pivot path of a different length in each case. This at least one common pivot axis 281; 282 is preferably at least one pivot axis 281; 282 of pivot device 279 of the at least one printing assembly 200. For example, at least one supporting element 273; 274, in particular at least one lateral supporting element 273 and/or at least one inner supporting element 274, is arranged to be pivotable about the at least one common pivot axis 281; 282, in particular along a respective pivot path, together with the guide elements 241 and/or at least one supporting frame 276. The at least one supporting frame 276 is preferably arranged pivotably about the at least one common pivot axis 281; 282.

A working position and a maintenance position are preferably associated with each guide element 241 that is pivotable about the at least one common pivot axis 281; 282. The working position of each guide element 241 is preferably characterized in that the guide element 241 is situated in its working position during a printing operation and/or in that the guide element 241 arranged in its working position has a smallest distance of at most 5 mm, more preferably at most 3.0 mm and even more preferably at most 2.0 mm from the print head 221 arranged closest to this guide element 241 in its printing position, and/or in that the guide element 241 arranged in its working position forms a tangent to the transport path provided for printing substrate 02 during printing operation. The maintenance position of each guide element 241 is preferably characterized in that the guide element 241 is in a maintenance condition of the at least one first printing assembly 200 in its maintenance position, and/or in that the guide element 241 arranged in its maintenance position has a smallest distance of at least 5 cm, more preferably at least 10 cm and even more preferably at least 20 cm from the print head 221 arranged closest to this guide element 241 in its printing position, and/or in that the guide element 241 arranged in its maintenance position is spaced a distance apart from the transport path provided for printing substrate 02 during printing operation.

The at least one common pivot axis 281; 282 of the at least one pivot device 279 is preferably arranged higher than the working position and/or the maintenance position of the first guide element 241 of printing line 224, as seen in the transport direction of printing substrate 02. The at least one common pivot axis 281; 282 is preferably arranged higher than the working position and/or maintenance position of each guide element 241 of printing line 224 associated with a central one-third of the printing line 224, as seen in the transport direction of the printing substrate 02. A vertical component of the distance between the at least one first guide element 241 of printing line 224, on the one hand, and the at least one common pivot axis 281; 282, on the other hand, is preferably at least twice as large as the vertical component of the distance between the at least one last guide element 241 of printing line 224, on the one hand, and the at least one common pivot axis 281; 282, on the other hand, more preferably at least three times as large and even more preferably at least four times as large, in particular regardless of whether the at least one supporting frame 276 is in its working position or in its maintenance position.

In a preferred first embodiment of pivot device 279, pivot device 279 has exactly one common pivot axis 281. In this first embodiment of pivot device 279, the at least one supporting element 273; 274 and in particular the at least one supporting frame 276 can be pivoted about a single common pivot axis 281, in particular relative to a frame 283 of the at least one first printing assembly 200. In a second embodiment of pivot device 279, pivot device 279 has at least two and preferably exactly two common pivot axes 281; 282 and at least one intermediate member 284. The at least one intermediate member 284 is preferably pivotable about a first pivot axis 281 relative to frame 283 of the at least one first printing assembly 200.

The at least one pivot device 279 preferably has at least one in particular common pivot drive 286. The at least one pivot drive 286 has, for example, at least one linear drive 286. The at least one pivot drive 286, in particular linear drive 286, preferably acts on frame 283 with at least one first connecting element, for example, acting directly or with the intermediate connection of at least one additional component. The at least one pivot drive 286, in particular linear drive 286, preferably acts with at least one second connecting element on at least one supporting element 273; 274 and/or at least one frame crossbar 277 and/or the supporting frame 276. For example, by means of the at least one linear drive 286, the beginning of a flexible tension means, in particular a chain, is linearly movable and the tension means is deflected about at least one and preferably at least two deflecting devices, and one end of the tension means is connected to the at least one supporting frame 276. If the beginning of the tension means is then moved linearly, the tension means will pull the supporting frame 276 upward so that the latter is pivoted about the at least one pivot axis 281; 282. By using the flexible tension means, a pivoting movement of supporting frame 276 can be implemented, in particular about a single pivot axis 281, with a linear drive 286 because the flexible tension means does not require any fixed path of movement.

A main direction of conveyance B is preferably defined by a straight-line connection between a first guide element 241 of printing line 224 based on the transport path provided for printing substrate 02 and a last guide element 241 of printing line 224, based on the transport path provided for printing substrate 02. The main direction of conveyance B is preferably defined by a straight-line connection between a first guide element 241 based on the printing section 226 of the transport path provided for printing substrate 02 and a last guide element 241 based on the printing section 226 of the transport path provided for printing substrate 02. The main direction of conveyance B points from the first guide element 241 of printing line 224 based on the transport path provided for printing substrate 02 to the last guide element 241 of printing line 224 based on the transport path provided for printing substrate 02. The main direction of conveyance B is preferably oriented orthogonally to transverse direction A.

The alignment of the main direction of conveyance B with guide elements 241 arranged in their working position and/or with supporting frame 276 arranged in its working position preferably has an angle of at least 10°, more preferably at least 20° and even more preferably at least 30° to the alignment of the main direction of conveyance B with guide elements 241 arranged in their maintenance position and/or with supporting frame 276 arranged in its maintenance position.

The main direction of conveyance B preferably has at least one component facing vertically upward and at least one horizontal component with guide elements 241 arranged in their working position and/or with supporting frame 276 arranged in its working position. The main direction of conveyance B is preferably aligned at an angle of at least 10°, more preferably at least 20° and even more preferably at least 30° to a horizontal plane, with guide elements 241 arranged in their working position and/or with supporting frame 276 arranged in its working position. The main direction of conveyance B is preferably aligned at an angle of at most 70°, more preferably at most 55° and even more preferably at most 40° to a horizontal plane with guide elements 241 arranged in their working position and/or with supporting frame 276 in its working position. In an alternative embodiment, the main direction of conveyance B would run substantially horizontally, i.e., at an angle of at most 5° to a horizontal plane.

The main direction of conveyance B preferably has at least one component pointing vertically upward and more preferably exclusively one component pointing vertically upward with guide elements 241 arranged in their maintenance position and/or with supporting frame 276 arranged in its maintenance position. The main direction of conveyance B is preferably arranged at an angle of at most 30°, more preferably at most 20° and even more preferably at most 10° to a vertical direction with guide elements 241 arranged in their maintenance position and/or with supporting frame 276 arranged in its maintenance position.

The joint pivotability of guide elements 241 of printing line 224 and/or the pivotability of the at least one supporting frame 276 preferably yields a possibility for increasing the distance between the nozzles of the print heads and/or the at least one shielding device 292, on the one hand, and the guide elements 241 of printing line 224, on the other hand. The joint pivotability of the guide elements 241 of printing line 224 and/or the pivotability of the at least one supporting frame 276 therefore results in the creation of a maintenance space 291 between the nozzles of the print heads 221 and/or the at least one shielding device 292, on the one hand, and the guide elements 241, on the other hand. This maintenance space 291 is accessible, for example, for operators. This maintenance space 291, for example, permits maintenance and/or cleaning of the guide elements 241 of printing line 224 and/or of the at least one shielding device 292, in particular independently of the working width of printing machine 01. For example, at least one preferably movable standing aid 293 in particular platform 293, is arranged in the maintenance space 291. Platform 293 is embodied in two parts, for example, and preferably includes an integrated and extendable ladder.

During normal printing operation, all print heads 221 are in a stationary arrangement. A permanently accurate color registration and/or register-true alignment of all nozzles is thereby ensured. Various situations, in which a movement of print heads 221 is necessary, are conceivable. A first such situation is a flying reel change or printing substrate change, or more generally a reel change with a splicing process or a printing substrate change with a splicing process. At least the print heads 221, and preferably the at least one nozzle bar 231 and/or supporting body 616 as a whole, is/are therefore movable in at least one direction, for example, in the throw-off direction C relative to the guidance plane of the first printing substrate guide 249, in particular can be thrown-off of said plane, more preferably orthogonally to a surface of the transport path provided for the printing substrate 02 that is closest to the print head 221. In particular, print heads 221 and more preferably the at least one nozzle bar 231 are movable in at least one direction, in particular in the throw-off direction C, relative to the closest guide element 241 in each case, in particular being thrown-off of said element. In this way the distance can be increased sufficiently but must be reduced again accordingly thereafter. A second such situation occurs, for example, during maintenance and/or cleaning and/or encapsulation of at least one of print heads 221. Print heads 221 are preferably attached individually to the at least one nozzle bar 231 and are releasable individually from the at least one nozzle bar 231. This allows print heads 221 to be serviced and/or cleaned and/or replaced individually.

At least one cleaning device 263, in particular at least one nozzle cleaning device 263, is preferably provided, having at least one washing nozzle and/or at least one brush and/or at least one squeegee and/or at least one cleaning cloth. Print heads 221 in their respective throw-off position are preferably arranged far enough from the guide elements 241 of printing line 224, which are arranged in particular in their working position, that the at least one cleaning device 263, in particular nozzle cleaning device 263, fits into a resulting cleaning intermediate space 289. This at least one cleaning device 263 is preferably arranged movably in transfer direction A, and preferably also has a dimension in transverse direction A that is smaller than the working width of the printing machine. When the print heads 221 associated with the cleaning device are arranged in their printing position, the at least one cleaning device 263 is preferably arranged outside of the working width of the printing machine with respect to transverse direction A. A separate cleaning device 263, more preferably two separate cleaning devices 263, are preferably associated with each print head row 222 or to each double row 223 of print heads 221.

At least one first dryer 301, which includes a region of the transport path provided for the printing substrate 02 embodied as a drying section, is preferably arranged along the transport path provided for the printing substrate 02, downstream of the at least one first printing assembly 200, said transport path being defined by an active area of the at least one dryer 301. After passing through the at least one first printing assembly 200, the transport path of printing substrate 02 and in particular the printing substrate web 02 preferably passes through the at least one first dryer 301 to dry the applied printing fluid. The at least one first dryer 301 is preferably a part of the at least one dryer unit 300.

The at least one dryer unit 300 has at least one first dryer 301, which is preferably embodied as at least one radiation dryer 301 and/or as at least one air flow dryer 301. It is also possible for a plurality of dryers 301 to be arranged one after the other, for example, along the transport path provided. Such a plurality of dryers 301 is arranged, for example, one above the other in the case of a substantially vertical transport path in the at least one dryer unit 300. The at least one first dryer 301 has at least one first energy output device 302; 317, which is preferably controllable and/or regulable. The at least one first energy output device 302; 317 is embodied, for example, as at least one radiation source 302 and/or at least one air supply line 317. The at least one radiation source 302 is embodied, for example, as an infrared radiation source 302 and/or as a radiation source 302 for ultraviolet light. The at least one radiation source 302 is preferably at least one controllable and/or regulable radiation source 302. The at least one first energy output device 302; 317 is preferably embodied for the targeted transfer of energy in particular from the at least one first energy output device 302; 317 to a printing substrate 02 that is and/or can be arranged in an active region of the first energy output device 302; 317 and is preferably provided with printing fluid. The at least one first energy output device 302; 317 is arranged movably, in particular relative to the transport path provided for the transport of web-type printing substrate 02. The active region of the at least one first energy output device 302; 317 preferably intersects the transport path provided for the transport of web-type printing substrate 02.

The at least one first energy output device 302; 317 is arranged along a linear adjustment path, which is at least 75%, preferably at least 90% and more preferably completely linear, in and/or opposite an adjustment direction S between at least one active position and at least one throw-off position. The adjustment direction S deviates from at least one horizontal direction by at most 40°, preferably at most 30°, more preferably at most 15° and even more preferably at most 5°. The adjustment direction further deviates by at most 40°, preferably at most 30°, most preferably at most 15° and even more preferably at most 5° from a normal direction N. This normal direction N is preferably a normal direction N of an average surface normal of an entire section of the transport path provided for web-type printing substrate 02 situated in an entire active region, in particular, of the at least one first energy output device 302; 317. The normal direction N of the average surface normal is determined, in particular, as the average over all directions of surface normals from tangent planes to all surface elements of the transport path provided for printing substrate 02, said surface elements being situated in the active region of the at least one first energy output device 302; 317. When printing substrate 02 runs substantially vertically through the active region of the at least one energy output device 302; 317, as is preferred, the normal direction N and/or the adjustment direction S are thus preferably oriented substantially horizontally.

Printing machine 01 is preferably characterized in that, at least within the at least one dryer unit 300 and, more preferably, also within the at least one printing assembly 200 and, even more preferably, in a wider region of the printing machine 01, at least one and preferably exactly one infeed means, preferably continuous and preferably movable along at least one infeed path for infeed of a printing substrate 02, is and/or can be at least temporarily and preferably permanently arranged. An arrangement within the dryer unit 300 is understood in particular to mean that a projection of the at least one infeed means in or opposite axial direction A or transverse direction A intersects the active region of the at least one energy output device 302; 317. The at least one infeed path and/or the at least one infeed means is preferably arranged outside of the working width of printing machine 01 with respect to transverse direction A. At least one printing substrate web 02 preferably is and/or can be connected to the at least one infeed means via at least one connecting element more preferably embodied as at least one infeed tip, in particular regardless of whether the at least one infeed means is embodied as an infeed belt and/or as an infeed chain and/or as a continuous infeed means and/or as a finite infeed means.

At least two throw-off positions of the at least one energy output device 302; 317, which are different in particular with respect to the adjustment direction S, are preferably provided, in which the at least one first energy output device 302; 317 can be arranged in a targeted manner, depending on the mode of operation. The at least two throw-off positions are preferably provided, in addition to the at least one active position. For example, one of the throw-off positions is an infeed position and/or one of the throw-off positions is an access position. The infeed position is preferably to be assumed when infeed of a printing substrate 02 through the at least one dryer unit 300 is to be performed. The access position is preferably to be assumed when an operator needs to gain access to a side of the at least one energy output device 302; 317 facing the transport path provided.

For example, the shortest distance between the at least one first energy output device 302; 317 and the transport path provided for the printing substrate 02 when the first energy output device 302; 317 is arranged in the access position is greater than that when the first energy output device 302; 317 is arranged in the infeed position. In particular, the shortest distance between the at least one first energy output device 302; 317 and the transport path provided for the printing substrate 02 when the first energy output device 302; 317 is arranged in the infeed position is greater than that with the first energy output device 302; 317 arranged in the active position, preferably by at least 5 mm, more preferably by at least 50 mm and even more preferably by at least 90 mm and independently thereof by at most 400 mm, for example. The shortest distance between the at least one first energy output device 302; 317 and the transport path provided for printing substrate 02 when the first energy output device 302; 317 is arranged in the access position is preferably greater than that with the first energy output device 302; 317 arranged in the active position, preferably by at least 450 mm, more preferably by at least 600 mm and even more preferably by at least 700 mm.

Preferably at least one measuring roller 343 and/or at least one first deflecting roller 347 is arranged along the transport path provided for printing substrate 02, downstream of the active region of the at least one first energy output device 302; 317, these rollers preferably being wrapped by the transport path provided for the printing substrate 02 and/or by the printing substrate 02 itself. Preferably at least one first draw roller 344, to which at least one separate drive motor is assigned and which is preferably wrapped by the transport path provided for printing substrate 02 and/or by printing substrate 02, is arranged along the transport path provided for printing substrate 02, upstream of the active region of the at least one first energy output device 302; 317, and/or at least one second draw roller 303, which is preferably wrapped by the transport path provided for printing substrate 02 and/or by printing substrate 02, is arranged along the transport path provided for printing substrate 02, downstream of the active region of the at least one first energy output device 302; 317 and/or downstream of the at least one measuring roller 343 and/or downstream of the at least one first deflecting roller 347. The at least one draw roller 303 and/or the at least one measuring roller 343 and/or the at least one first deflecting roller 347 is/are preferably embodied as at least one cooling roller 303.

A plurality of pressure rollers 306, for example at least three, more preferably at least five and even more preferably at least nine pressure rollers, are preferably arranged so that they are individually pressed against the at least one second draw roller 303. For example, each of these pressure rollers 306 is arranged on a separate lever arm, which is arranged so as to pivot by means of a separate power element. All such lever arms are preferably arranged pivotably about a common axis. These pressure rollers 306 are preferably arranged one after the other in transverse direction A. At least one second deflecting roller 348, which is preferably wrapped by the transport path provided for the printing substrate 02 and/or by the printing substrate 02, is preferably arranged along the transport path provided for printing substrate 02, downstream of the at least one draw roller 303. The at least one second deflecting roller 348 is identical to the at least one web guide roller 257, for example.

At least one adjusting drive, by means of which a movement of the at least one energy output device 302; 317 can be executed along the adjustment path, is preferably provided. The at least one adjusting drive is embodied, for example, as at least one hydraulic drive and/or as at least one pneumatic drive. The at least one adjusting drive is preferably embodied as at least one electric drive and/or more preferably as at least one threaded spindle and at least one threaded nut cooperating therewith.

The printing machine 01 that comprises a first printing assembly 200 is preferably characterized in that the at least one dryer unit 300 having the at least one first dryer 301 is preferably arranged along the transport path provided for the printing substrate 02, downstream of the at least one first printing assembly 200, said dryer comprising a region of the transport path intended for the printing substrate 02, the region being embodied in particular as a drying section, the transport path being defined by the active region of the at least one first dryer 301. A transport direction provided for the printing substrate 02 preferably has at least one vertical component, preferably pointing downward, which is greater than any horizontal component that may be present in this transport direction, over at least half and more preferably at least 75% of the entire drying section of the transport path provided for the printing substrate 02.

The axial direction A or the transverse direction A is preferably defined by an axis of rotation of the at least one first draw roller 344 and/or an axis of rotation of the at least one second draw roller 303, in particular as a direction parallel to this axis of rotation. The adjustment direction S of the at least one energy output device 302; 317 is preferably linear. The adjustment direction S of the at least one energy output device 302; 317 differs from the axial direction A or the transverse direction A by at least 50°, preferably at least 60°, more preferably at least 75° and even more preferably at least 85°. The adjustment direction S of the at least one energy output device 302; 317 preferably deviates, in particular at the same time, from at least one horizontal direction by at most 40°, preferably at most 30°, more preferably at most 15° and even more preferably at most 5°.

Due to the radiation emitted by the at least one energy output device 302; 317, solvent and/or moisture is preferably removed from the printing substrate web 02 and/or from the printing fluid arranged thereon, and is absorbed into the ambient air in an interior space of the at least one first dryer 301. The transport path of printing substrate web 02 runs through this interior space of the at least one first dryer 301. Preferably, at least one ventilation device is arranged in the region of the at least one energy output device 302; 317.

The at least one ventilation device preferably has at least one air supply line 317 and at least one air removal line 318. The at least one first dryer 301 is thus likewise embodied as an air flow dryer 301 in addition to its embodiment as a radiation dryer 301. The at least one air supply line 317 is preferably arranged along the transport path provided for printing substrate 02 between at least two air removal lines 318. For example, the at least one air supply line 317 has tubular sections and/or the at least one air supply line 317 ends in a funnel-shaped end region, which has a much larger cross-sectional area than other sections of the at least one air supply line 317. For example, the at least one air removal line 318 has tubular sections and/or the at least one air removal line 318 begins in a funnel-shaped starting region, which has a much larger cross-sectional area than other sections of the at least one air removal line 318.

The at least one air supply line 317 is preferably at least one energy output device 317, and at least one radiation source 302 is likewise at least one energy output device 302. In this case, the at least one dryer 301 then has at least two energy output devices 302; 317. The at least one air supply line 317 and/or the at least one air removal line 318 preferably each have at least one flexible region, with which they are connected to a stationary air transport device. At least one radiation shield 346 and/or at least one reflector 346 is preferably arranged on a side of the transport path provided for printing substrate 02 that faces away from the at least one energy output device 302; 317. At least one heat exchanger, by means of which air flowing through the at least one air removal device 318 can output energy to the air flowing through the at least one air supply line 317, is preferably provided.

At least one barrier device 349, by means of which a safety region is and/or can be separated from the surrounding area is preferably provided. The safety region is preferably a region comprising at least the volume that can optionally be taken up by the at least one energy output device 302 and optionally also by a dryer frame 351 that supports at least one energy output device 302 during movements along the adjustment path. The safety region preferably also comprises a larger spatial region. The safety region can preferably be entered from the surrounding area through at least one closable opening in the barrier device 349. This at least one opening is preferably closable by means of a closure device 352, for example, at least one door 352. A movement of the at least one energy output device 302 is preferably possible in particular from its active position and/or its access position and/or its infeed position only when the at least one closure device 352 is closed and/or when a signal generator arranged outside of the safety region is operated. The at least one closure device 352 is preferably to be opened only when the at least one energy output device is arranged in its access position.

A preferred method for operating a printing machine 01 can be carried out in particular by means of the printing machine 01. This involves a method for operating the printing machine 01, wherein the printing machine 01 comprises the at least one first printing assembly 200 and the at least one dryer unit 300, and wherein the at least one dryer unit 300 comprises the at least one first dryer 301 with at least the first energy output device 302; 317. In a first throw-off operation, the at least one energy output device 302; 317 is preferably moved, in particular by means of the at least one adjustment drive, out of the active position in adjustment direction S along a linear adjustment path by at least 5 mm, preferably by at least 50 mm and more preferably by at least 90 mm, and independently thereof is moved by at most 400 mm, for example, into the infeed position, where it is held. In an infeed operation that takes place subsequently, at least one web-type printing substrate 02 is preferably infed by means of at least one infeed means, which is different in particular from any printing substrate 02, along the transport path provided for the printing substrate 02 through the active region of the at least one energy output device 302; 317. More preferably, in a first resetting operation that takes place subsequently, the at least one first energy output device 302; 317 is moved, in particular by means of the at least one adjustment drive, opposite the adjustment direction S along the same linear adjustment path back out of the infeed position and into the active position, where it is held.

Energy from the at least one first energy output device 302; 317 is preferably output to the previously infed web-type printing substrate 02 between the first throw-off operation and a second throw-off operation in at least one drying process in the active region of the first energy output device 302; 317. More preferably, the previously infed web-type printing substrate 02 is preferably first provided at least partially with at least one printing fluid in the at least one printing assembly 200.

In a second throw-off operation that takes place later, in particular, the at least one first energy output device 302; 317 is preferably moved, in particular by means of the at least one adjustment drive, out of the active position in the same adjustment direction S, in particular along the same linear adjustment path, by at least 450 mm, more preferably by at least 600 mm and even more preferably by at least 700 mm, into an access position different from the infeed position, and is held there. In a first maintenance process that takes place subsequently, at least one maintenance action is preferably carried out on the at least one energy output device 302; 317, for example, a replacement of at least one current carrying component and/or cleaning of a component. More preferably, in a second resetting operation that takes place subsequently, the at least one first energy output device 302; 317 is moved, in particular by means of the at least one adjustment drive, out of the access position opposite the adjustment direction S along the same linear adjustment path back into the active position, and is held there.

The method is preferably characterized in that the at least one infeed means is connected in a connecting operation by means of at least one connecting element to the at least one printing substrate web 02. The at least one connecting element preferably passes by a printing position of the at least one print head 221 while the print head is thrown off from the transport path provided and/or is arranged in at least one resting position, and/or the at least one connecting element passes by at least one target region of at least one nozzle of the at least one print head 221 during the infeed process, and/or no component of the at least one infeed means passes by a target region of a nozzle of the at least one print head 221 during the infeed process. The at least one connecting element preferably passes by an active region of the at least one energy output device 302; 317 of the at least one first dryer 301, while the energy output device is in a throw-off position embodied as an infeed position. Preferably, no component of the at least one infeed means passes by the active region of the at least one energy output device 302; 317 during the infeed process. Preferably only at least one infeed means is used, which is arranged on only one side, with respect to transverse direction A, of the transport path provided for printing substrate 02, and/or the infeed path of which runs on only one side of the transport path provided for printing substrate 02.

Once the printing substrate 02 has passed by the at least one first printing assembly 200, printing substrate web 02 is transported further along its transport path and is preferably fed to the at least one first dryer 301 of the at least one dryer unit 300. A transport path comprising one or more guide means and/or conveying means for printing substrate 02 is preferably embodied downstream of the last printing couple 201 such that the first side of printing substrate web 02, which is printed in the at least one first printing assembly 200, does not come in physical contact with any component of rotary printing machine 01, in particular with any guide means and/or conveying means, after passing by the last printing couple 201 and until it reaches the active region of the at least one energy output device 302; 317 of the at least one first dryer 301. The second side of the printing substrate web 02, which in particular has not been printed by the first printing assembly 200, is preferably in contact with at least one web guidance means 257, for example, at least one web guide roller 254; 256; 257, and/or with the first draw roller 344 after passing by the last printing couple 201 and until it reaches the active region of the at least one energy output device 302; 317 of the at least one first dryer 301.

A transport direction provided for printing substrate 02 preferably has at least one vertical component, preferably facing downward, which is larger than any horizontal component of this transport direction that may be present, over at least one-half, and more preferably, over at least 75% of the entire drying section. For that reason, a motor-driven web guide roller 254 or draw roller 344 is preferably provided, which is wrapped by printing substrate 02 and/or by the provided transport path with a wrap angle preferably amounting to at least 45°, more preferably at least 60° and even more preferably at least 75°. This at least one motor-driven web guide roller 254 or draw roller 344 is preferably arranged downstream of the last guide elements of printing line 224 and upstream of the active region of the at least one dryer 301 along the printing substrate 02 and/or along the transport path provided for the printing substrate 02.

The at least one first dryer 301 preferably has at least one radiation source 302, which is preferably embodied as a radiation source 302 for microwaves and/or for radiation in the visible range and/or in the ultraviolet range of the electromagnetic spectrum, and/or more preferably as an infrared radiation source 302. The at least one first dryer 301 is preferably embodied as an infrared radiation dryer 301. A radiation source 302, preferably an infrared radiation source 302, is a device by means of which energy, in particular electrical energy, is and/or can be converted into radiation, preferably infrared radiation, in a targeted manner, and is and/or can be directed at the printing substrate web 02. The at least one radiation source 302 forms the at least one energy output device 302. The at least one radiation source 302 preferably has a defined active region. The active region of a radiation source 302 is the region, in particular, that contains all points that can be connected to the radiation source 302, in particular directly without interruption in a straight line or by means of reflectors provided for that purpose. The active region of the at least one first dryer 301 is preferably made up of the active regions of all radiation sources 302 of the at least one first dryer 301 and/or the active regions of all air supply lines 317 of the at least one first dryer 301. The active region of the at least one first dryer 301 preferably points from the at least one radiation source 302 toward a part of the transport path of printing substrate web 02 that is closest to the at least one radiation source 302.

Air is preferably introduced into the interior space of the at least one first dryer 301 through at least one aeration opening in the at least one air supply line 317. In the interior of the first dryer 301, water and/or solvent from the printing inks to be removed the printing substrate web 02 is then removed from the printing inks by the infrared radiation, for example, and taken up by the air introduced. This air is then discharged from the at least one first dryer 301 through at one venting opening and/or at least one air removal line 318.

Downstream of the active region of the at least one radiation source 302 of the at least one first dryer 301 in the transport direction of printing substrate web 02, at least one first cooling device is preferably provided. The at least one first cooling device preferably has the at least one first cooling roller 303 and preferably has a first cooling impression roller that is and/or can be thrown onto the at least one first cooling roller 303 and/or the at least one and more particularly multiple pressure rollers 306 that are and/or can be thrown onto the at least one first cooling roller 303.

The infeed means is preferably different from any printing substrate 02. For example, the at least one infeed means is embodied as at least one continuous infeed means, for example, as at least one continuous infeed belt. The at least one infeed means is alternatively embodied as at least one finite infeed means, for example, as a finite infeed belt and/or as a finite infeed chain. Preferably at least one infeed drive is provided, by means of which the at least one infeed means is arranged so that it is movable along the at least one infeed path. In the case of a continuous infeed means, it is sufficient, for example, for exactly one such infeed drive to be provided. Alternatively, the at least one infeed means is embodied as finite. In that case, preferably at least one infeed storage device is provided, in which the at least one infeed means can be located at least temporarily, in particular as long as it is not being used for feeding in a printing substrate web 02. In an alternative embodiment, the at least one infeed means is embodied as at least one finite infeed chain. In the preferred case of the at least one continuous infeed means, the at least one infeed means for infeed of a printing substrate web 02 along the transport path provided for the printed substrate web 02 is arranged in particular permanently along its at least one infeed path within printing machine 01.

At least one infeed guide element is preferably provided, by means of which at least one infeed path of the at least one infeed means is and/or can be defined. The at least one infeed guide element is embodied, for example, as at least one deflecting roller. Alternatively, the at least one infeed guide element is embodied as at least one chain track. Preferably, the at least one infeed guide element is embodied as at least one rotatable infeed guide element, for example, as at least one deflecting roller. In particular, a chain track may also have switches for implementing different infeed paths.

The at least one infeed means for infeed of a printing substrate web 02 along the transport path provided for printing substrate web 02 is preferably arranged in particular permanently along its at least one infeed path within printing machine 01.

The at least one infeed means preferably has at least two and more preferably at least five intended connecting points at which at least one printing substrate web 02 can be connected directly and/or via at least one connecting element to the at least one infeed means. Printing machine 01 is preferably characterized in that the at least two connecting points are spaced by a distance of at most 10 cm, more preferably at most 5 cm, even more preferably at most 2 cm and more preferably still no distance at all with respect to axial action A or transverse direction A, and/or in that the at least two connecting points are spaced a distance apart from one another along the at least one infeed path.

Before infeed of the printing substrate web 02 through the at least one printing assembly 200, at least one print head 221 embodied as an inkjet print head 221 of the at least one printing assembly 200 is preferably thrown off from the transport path provided for the at least one printing substrate web 02. In a partial operation of an infeed operation, at least one infeed means is then preferably moved along an infeed path through the at least one printing assembly 200, thereby drawing the at least one printing substrate web 02 along the transport path provided for the at least one printing substrate web 02. The infeed path and the transport path are preferably spaced a distance apart from one another as seen in the axial direction A or transverse direction A.

At least one post-processing apparatus, which is preferably embodied as a one-step or multistep folding device and/or as a sheet cutter and/or as a flat delivery unit and/or as a winding device, is arranged downstream of a drawing nip and/or downstream from a remoistening device along the transport path of the printing substrate web 02. The printing substrate web 02 is preferably folded and/or cut and/or stapled and/or sorted and/or put in envelopes and/or shipped and/or wound in this and/or by means of this post-processing apparatus.

The working width of printing machine 01 and/or of the at least one first printing assembly 200 and/or the width of a printing substrate 02 to be processed preferably amounts to at least 1500 mm, preferably at least 2000 mm and more preferably at least 2500 mm, for example. However, even larger working widths and/or web widths are possible due to the provided guide elements 241, in particular in combination with the provided inner supporting elements 274 and/or due to the adjustment direction S of the at least one energy output device 302 and/or due to the supporting body 616 and/or crossbars 272 and/or suction elements 247 described below.

Additional exemplary and/or preferred details of the at least one printing assembly 200 are described below.

The at least one printing assembly 200 has at least two print heads 221, for example, preferably embodied as inkjet print heads 221, arranged one after the other with respect to the transport direction defined by the transport path provided for transport of web-type printing substrate 02 in particular. The at least one printing assembly preferably has at least four, more preferably at least eight, even more preferably at least ten, even more preferably at least twelve and more preferably still at least fourteen such print heads 221 arranged one after the other with respect to the transport direction defined by the transport path provided for transport of printing substrate 02.

Figure 8:
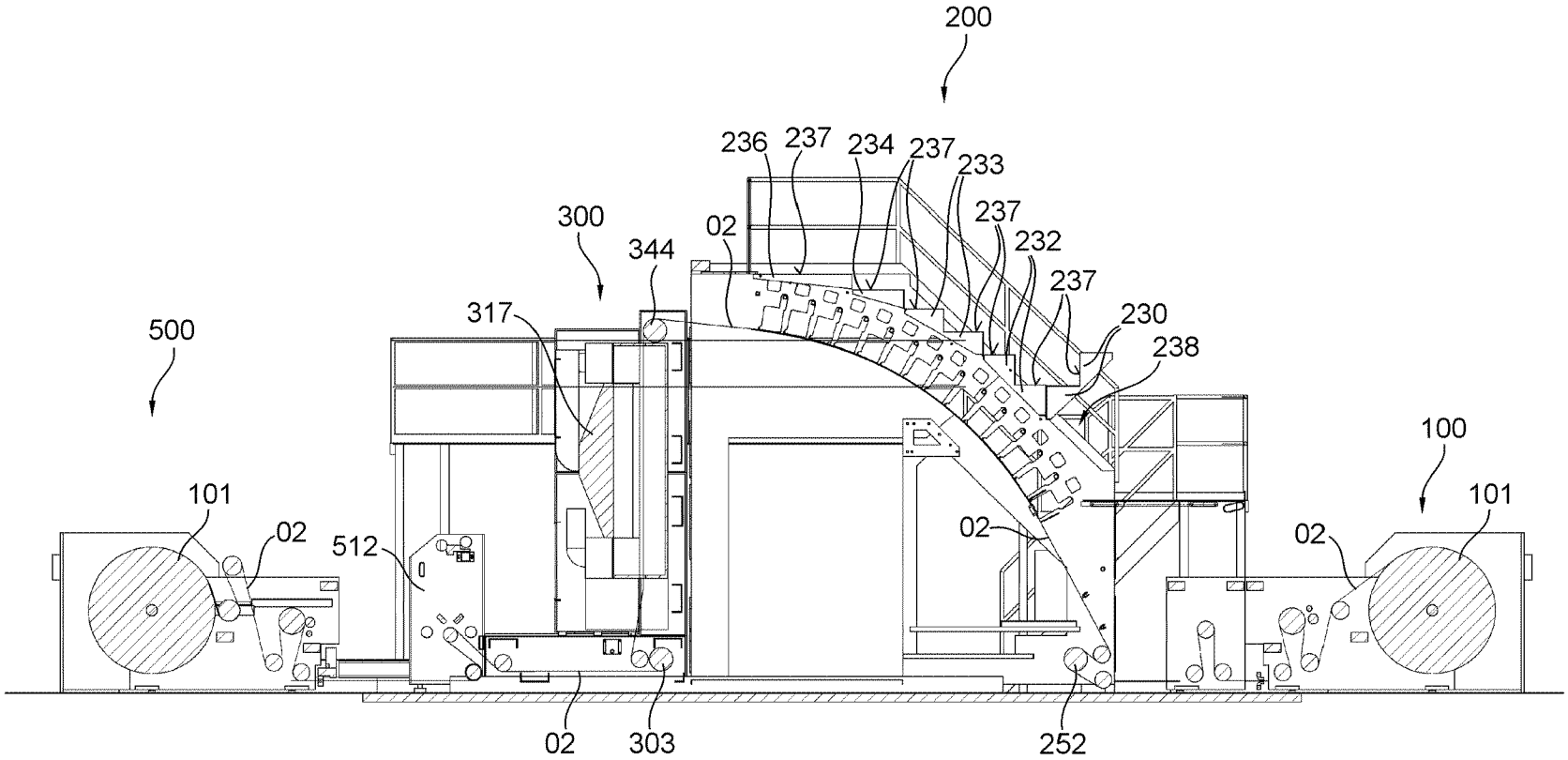
FIG. 8 a schematic diagram of a printing machine having at least one printing assembly.
Figure 9:
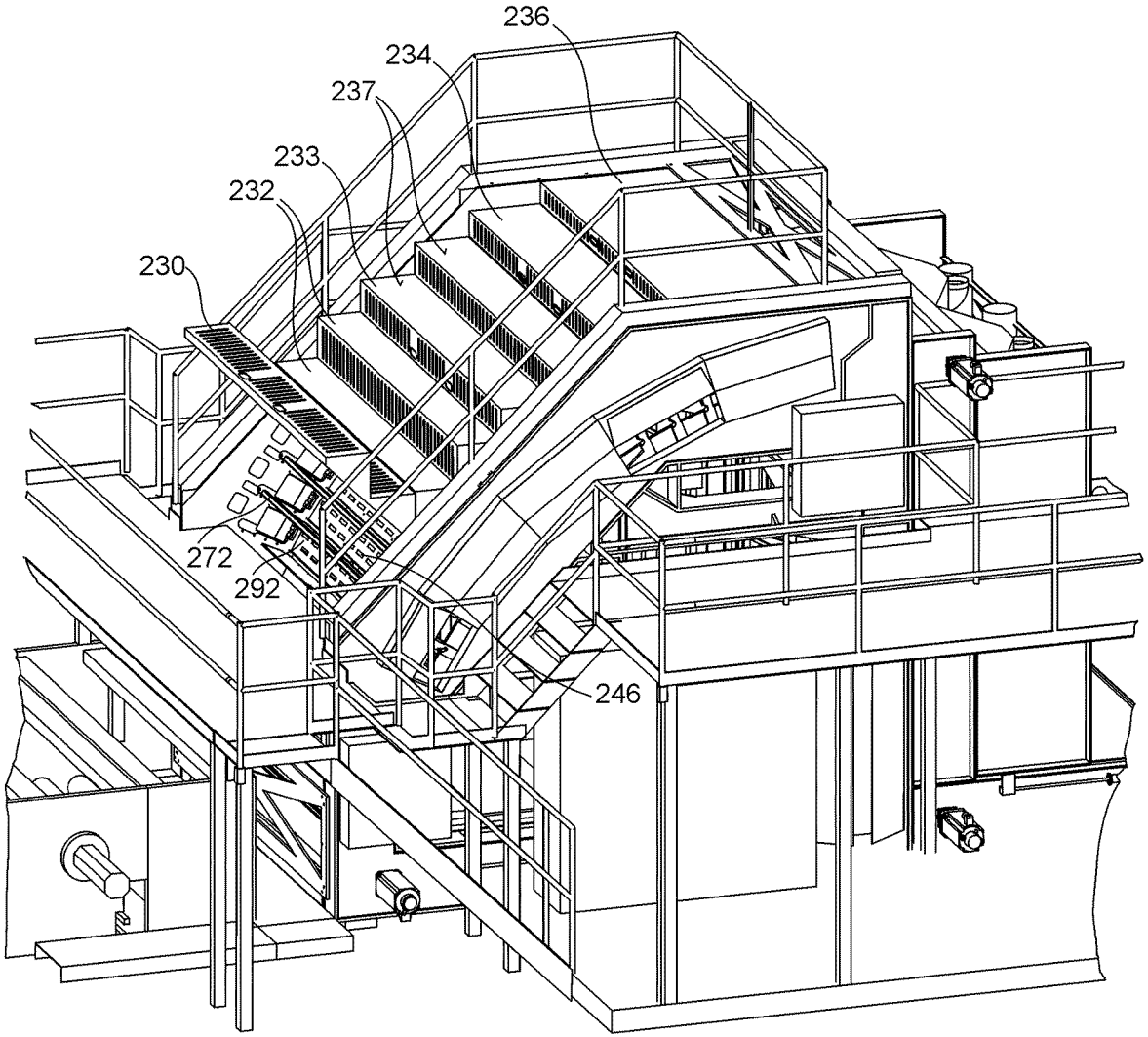
FIG. 9 a schematic diagram of a printing assembly with the protective cover open.
Figure 10:
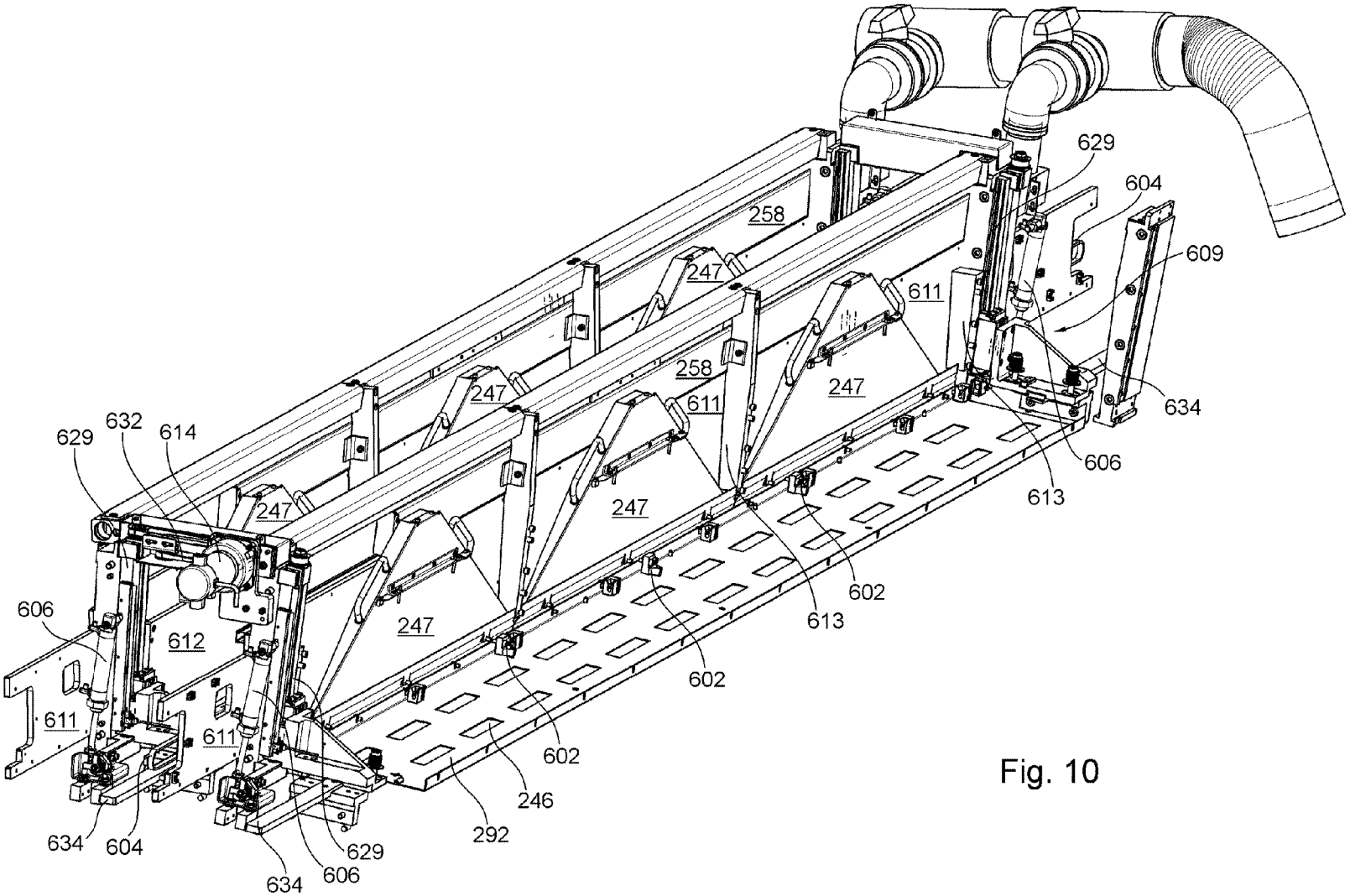
FIG. 10 a schematic partial diagram of two crossbars with accessory devices arranged thereon.
Figure 11:
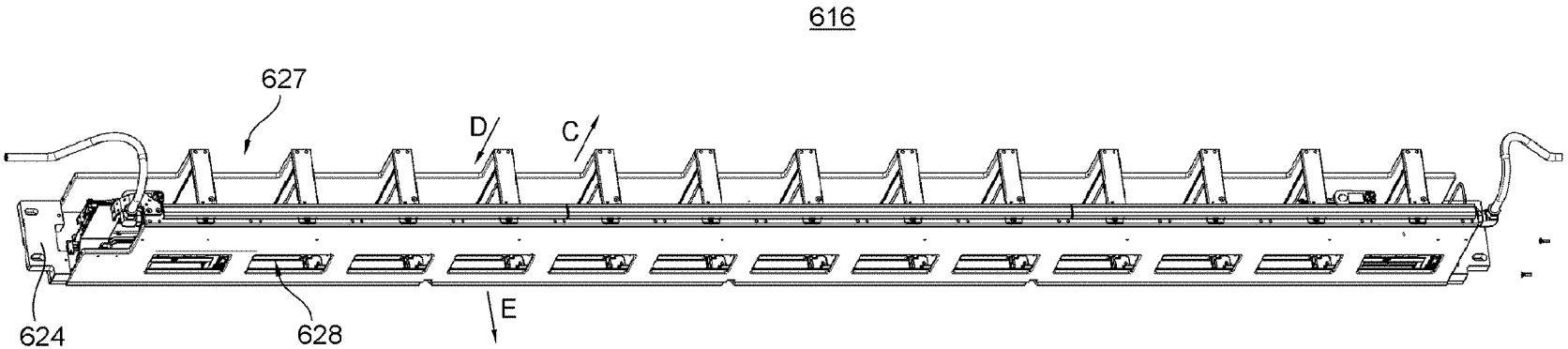
FIG. 11 a schematic diagram of a supporting body obliquely from above.
Figure 12:
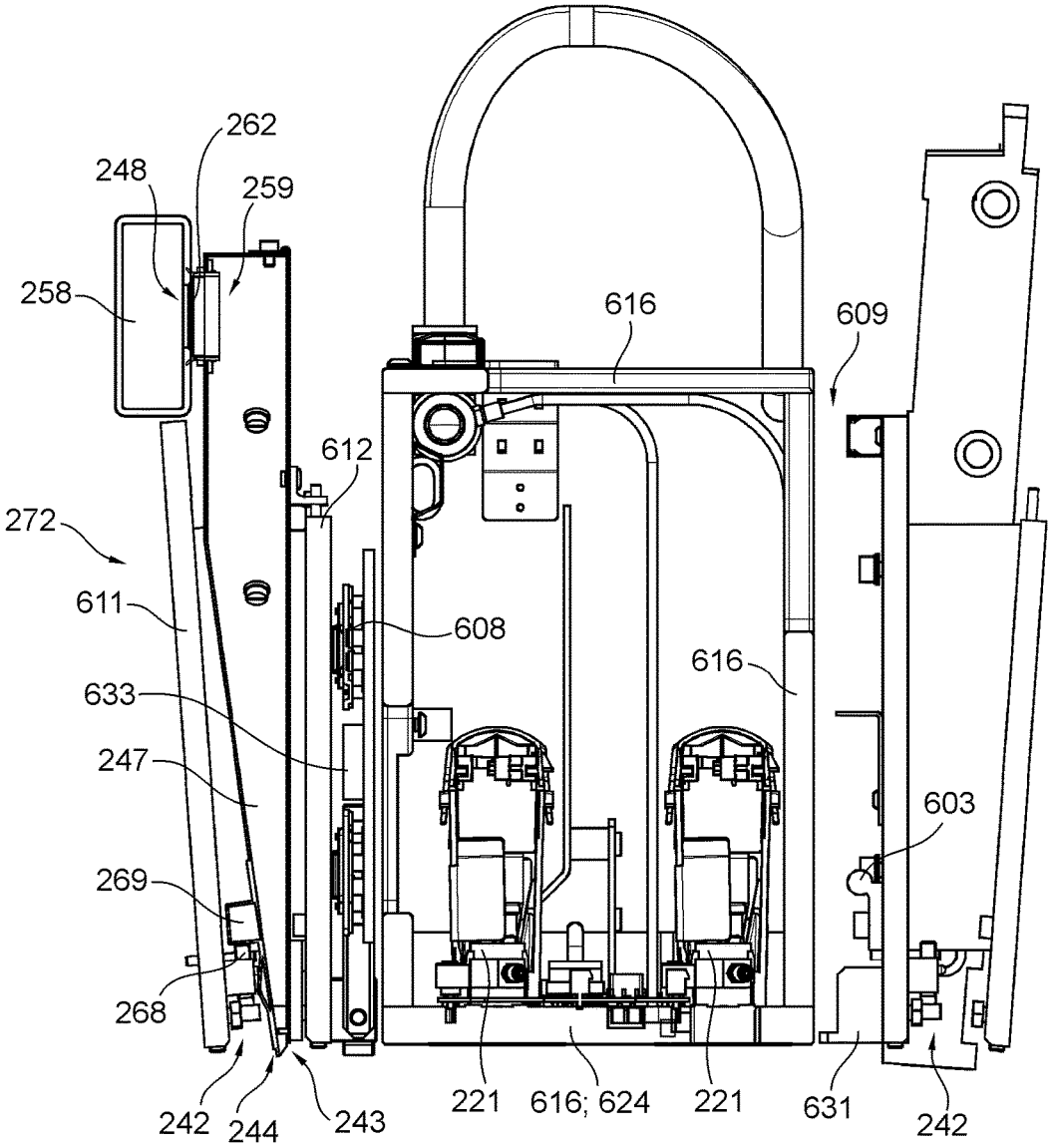
FIG. 12 a schematic sectional diagram through the supporting body according to FIG. 11 with adjoining crossbars.
Figure 13:
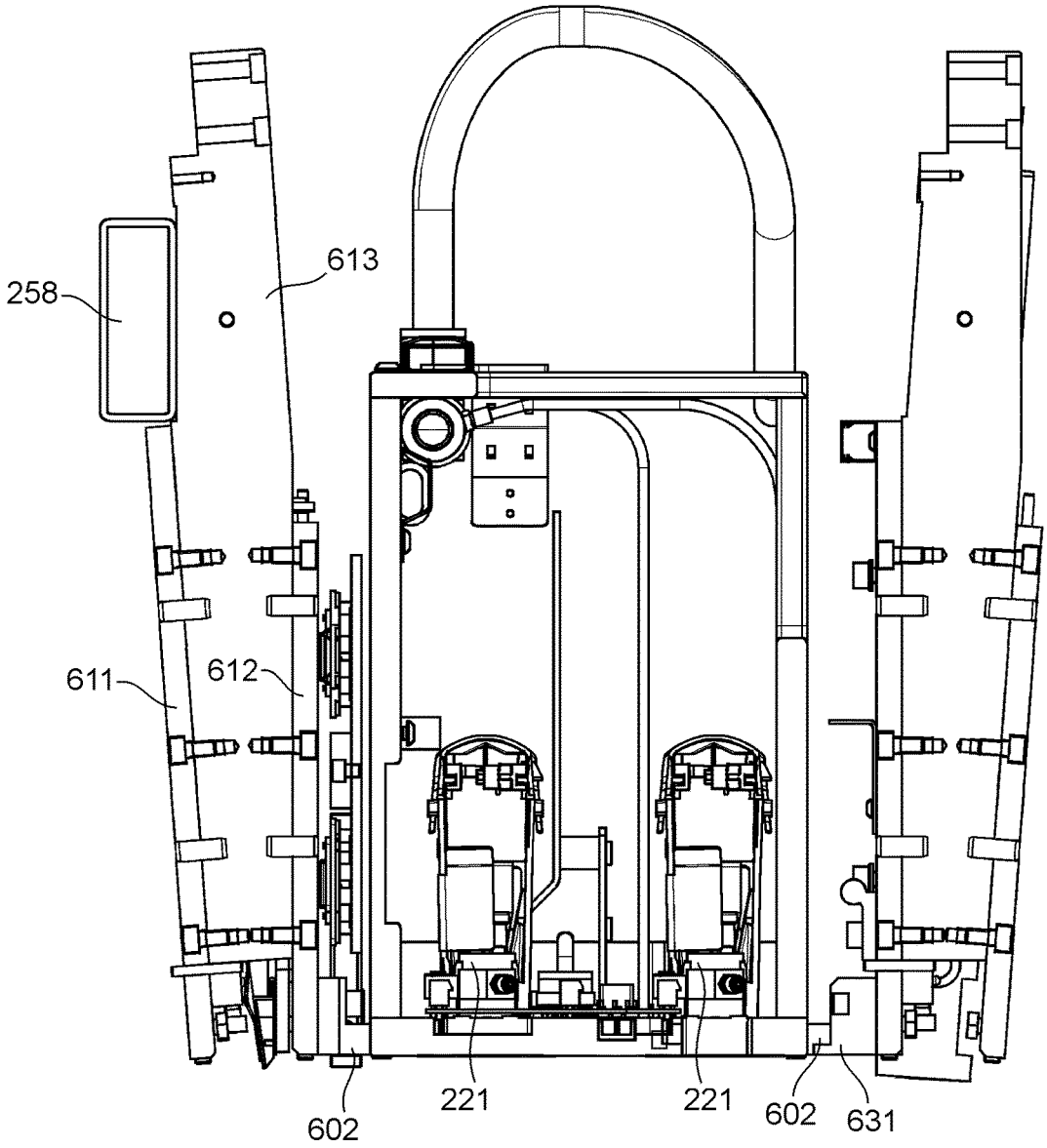
FIG. 13 a schematic sectional diagram through the supporting body according to FIG. 11 with adjoining crossbars.
Figure 14:
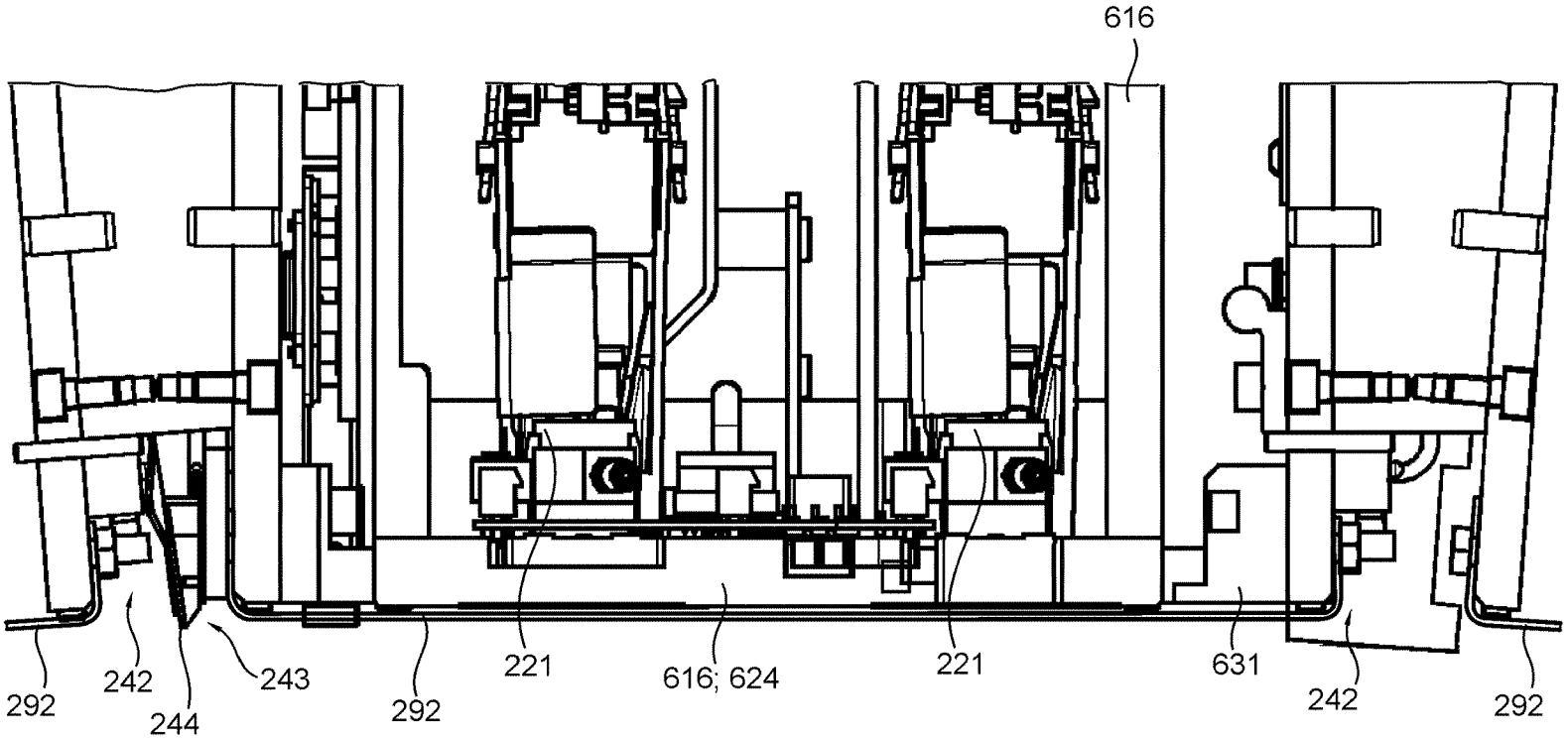
FIG. 14 a schematic sectional diagram through the supporting body according to FIG. 11 with adjoining crossbars in the area of a closure holder.
Figure 15:
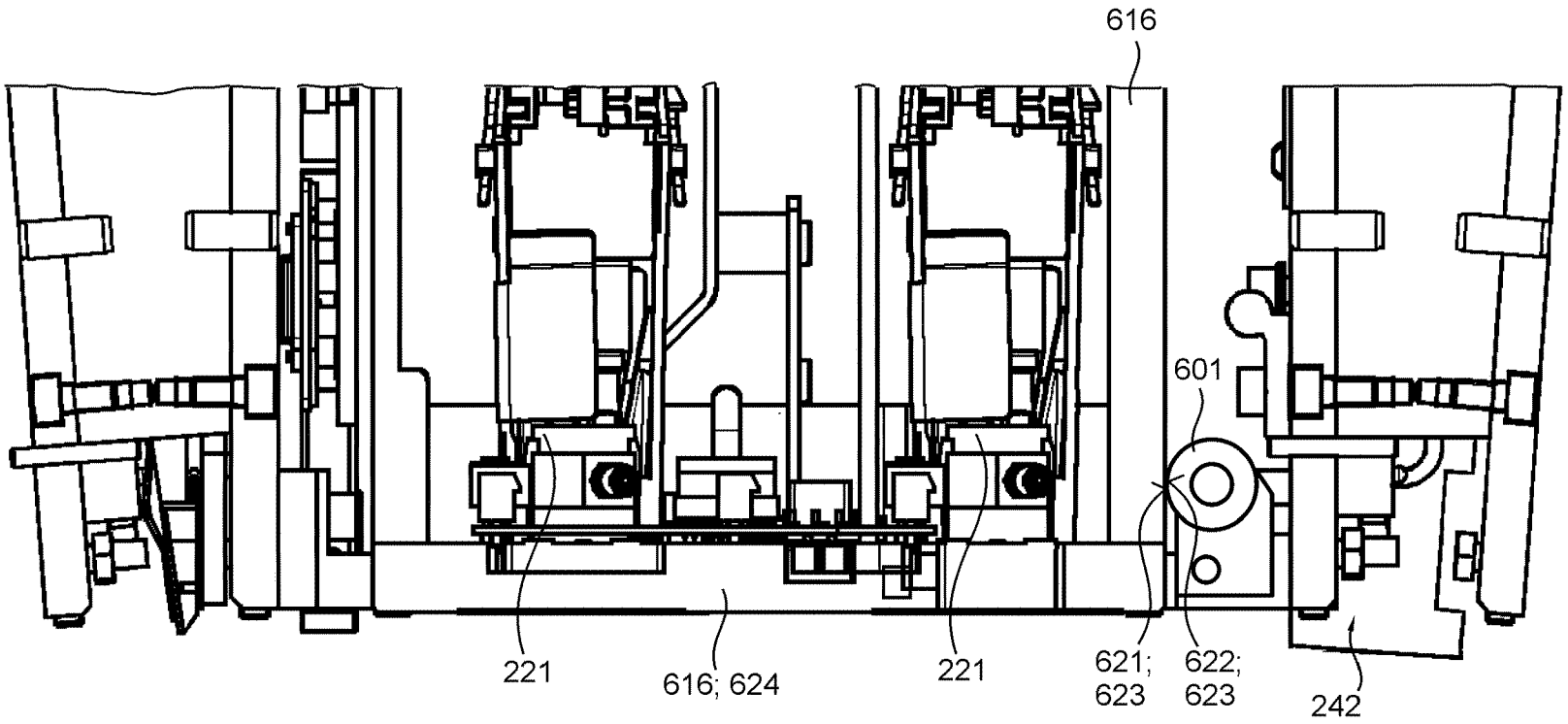
FIG. 15 a schematic sectional diagram through the supporting body according to FIG. 11 with adjoining crossbars in the area of a supporting roller.
Figure 16:
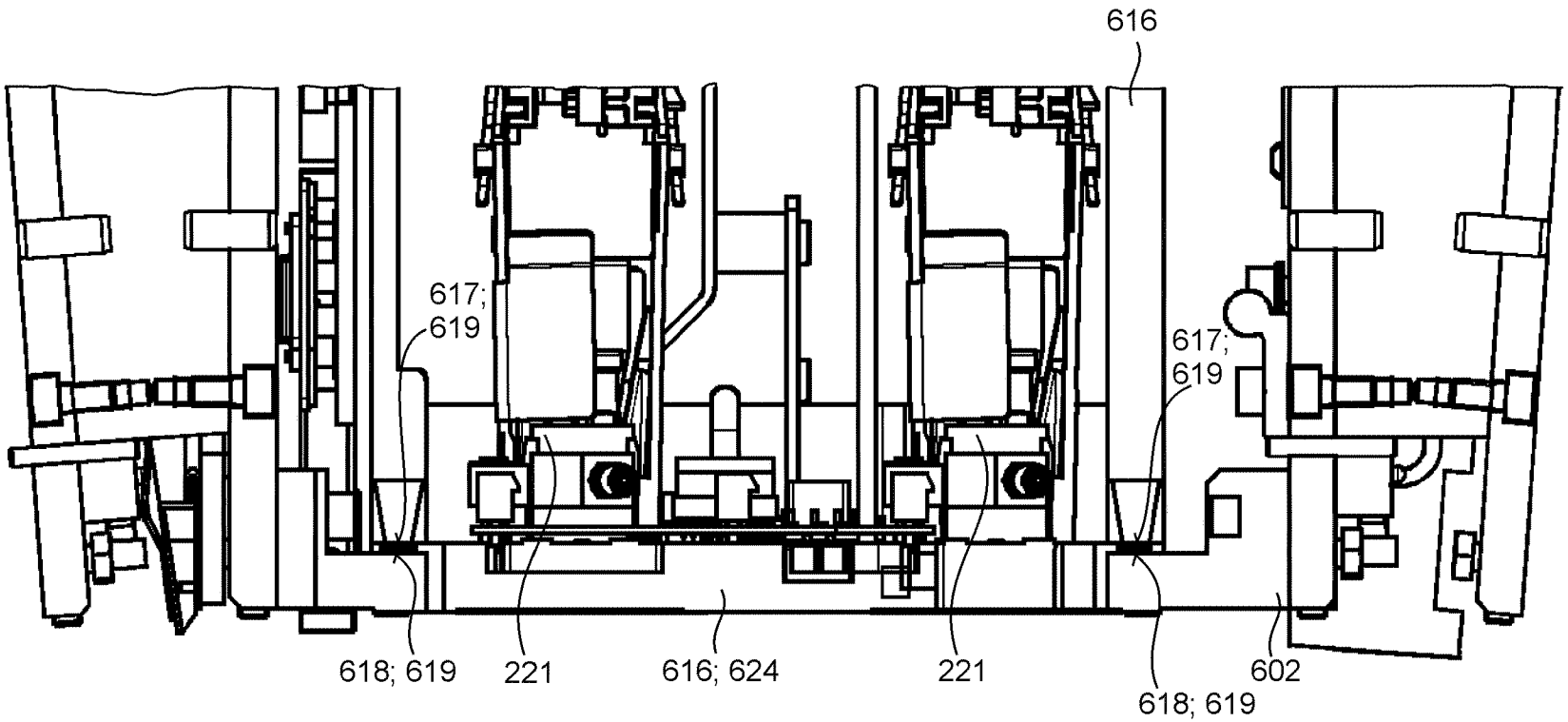
FIG. 16 a schematic sectional diagram through the supporting body according to FIG. 11 with adjoining crossbars in the area of a supporting stop.
Figure 17:
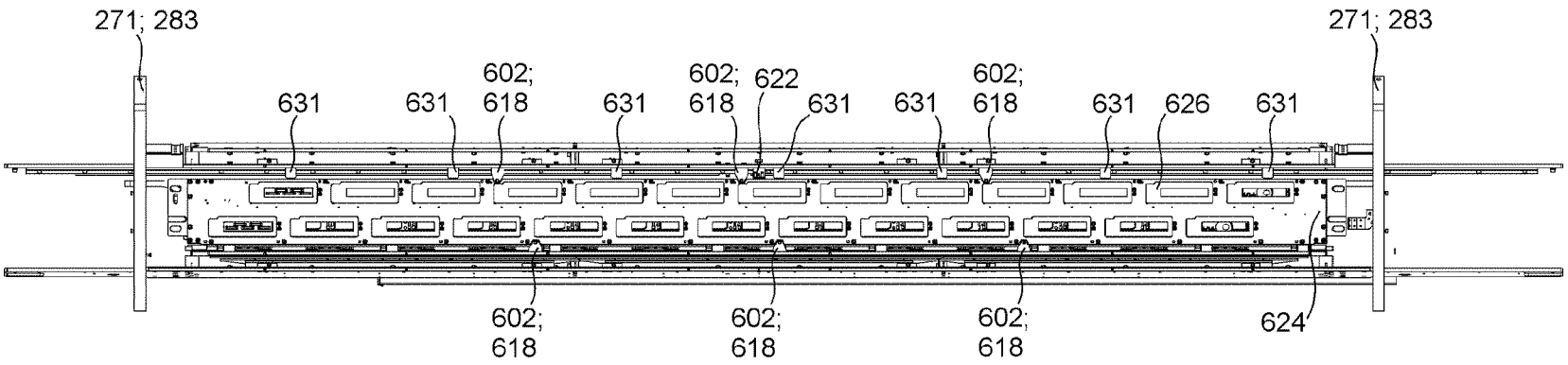
FIG. 17 a schematic diagram of the supporting body according to FIG. 11 from beneath between two side walls and two crossbars with the shielding device masked out.
Figure 18:
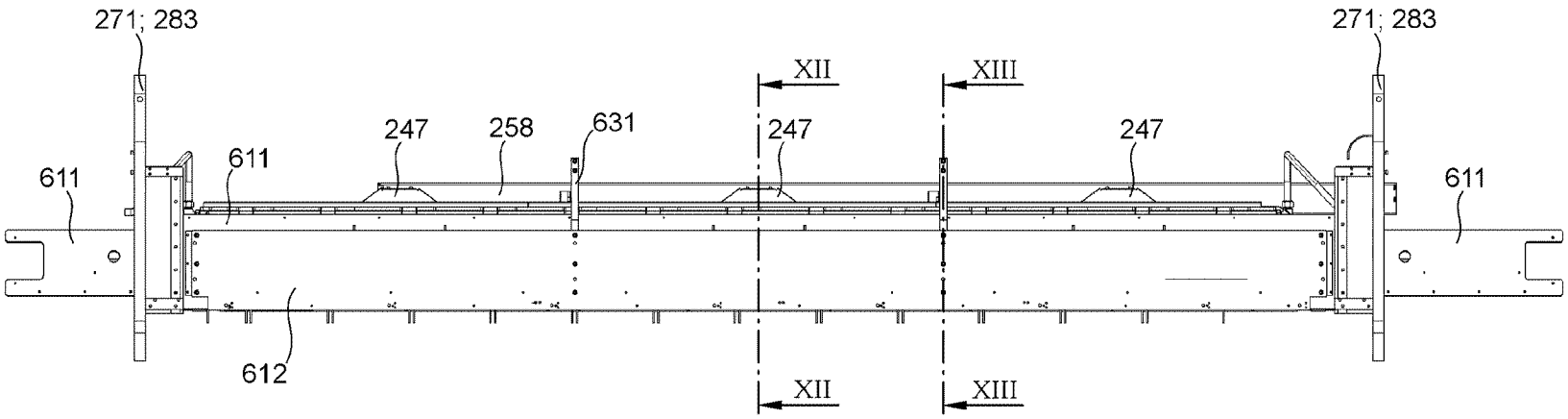
FIG. 18 a schematic diagram according to FIG. 18 as seen in a transport direction.
Figure 19:
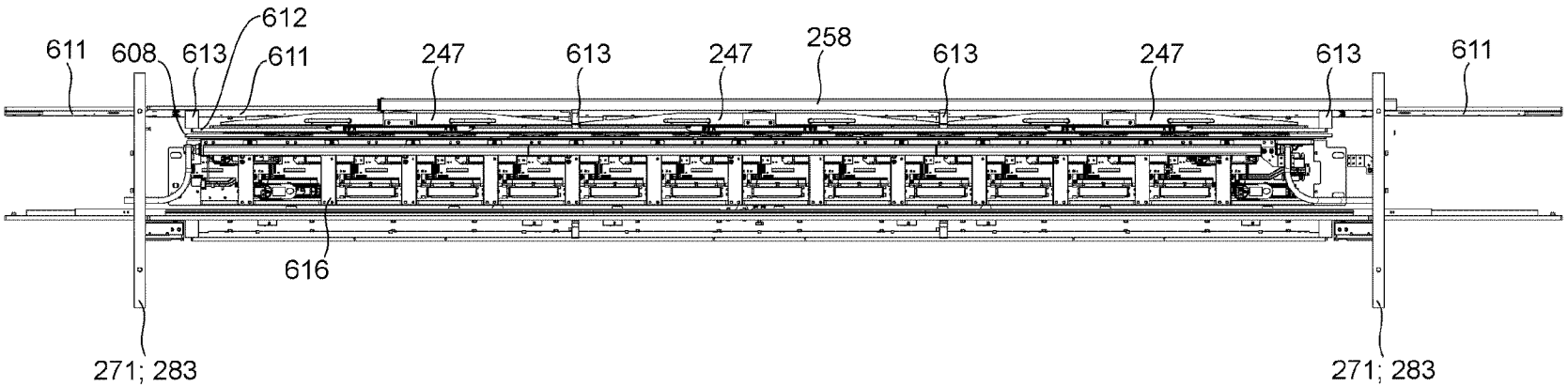
FIG. 19 a schematic diagram according to FIG. 18 from above.
Figure 20:
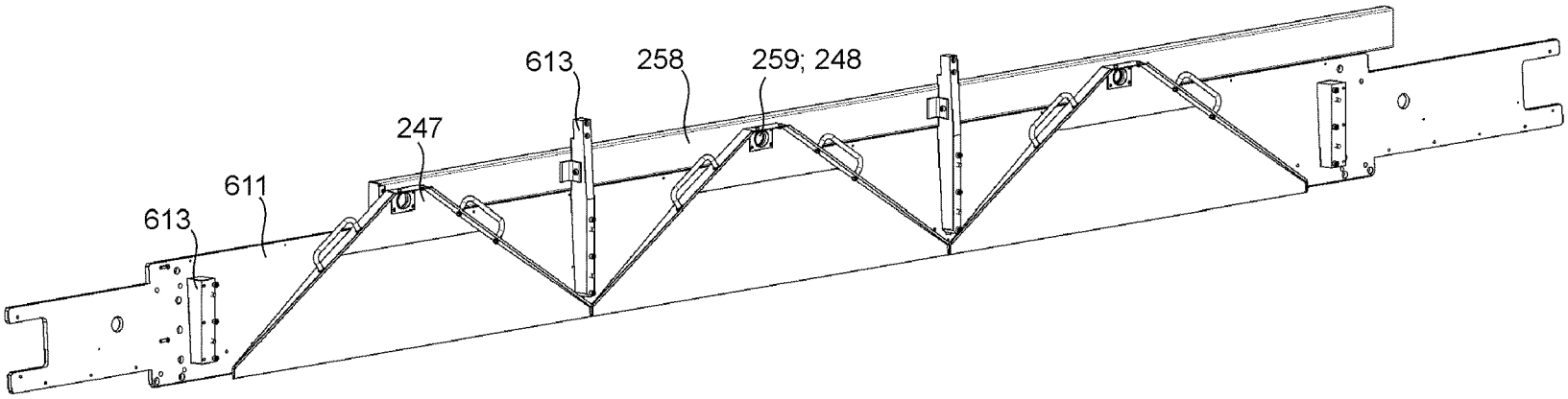
FIG. 20 a schematic diagram of three suction boxes and one suction line on a first crossbeam.
Figure 21:
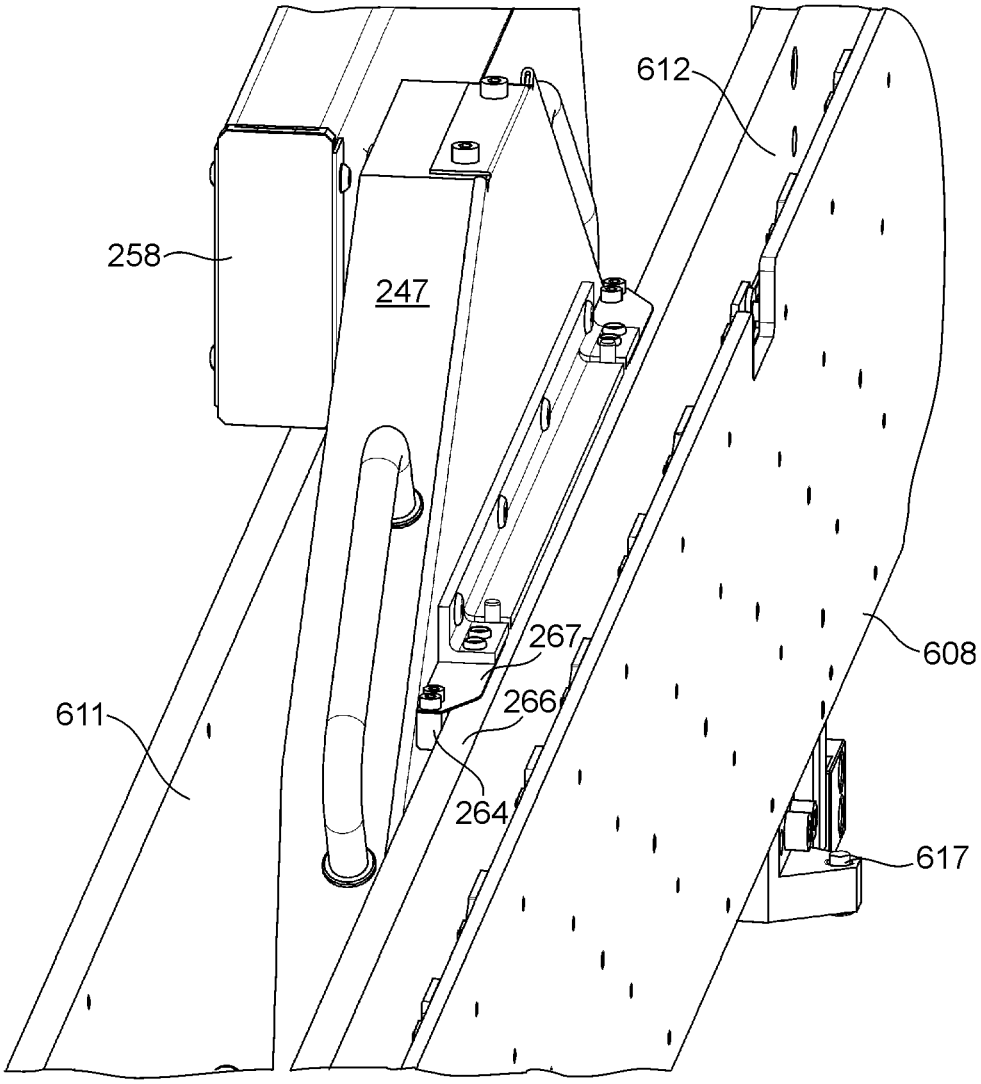
FIG. 21 a schematic diagram of a suction box between two crossbeams of a crossbar.
Figure 22:
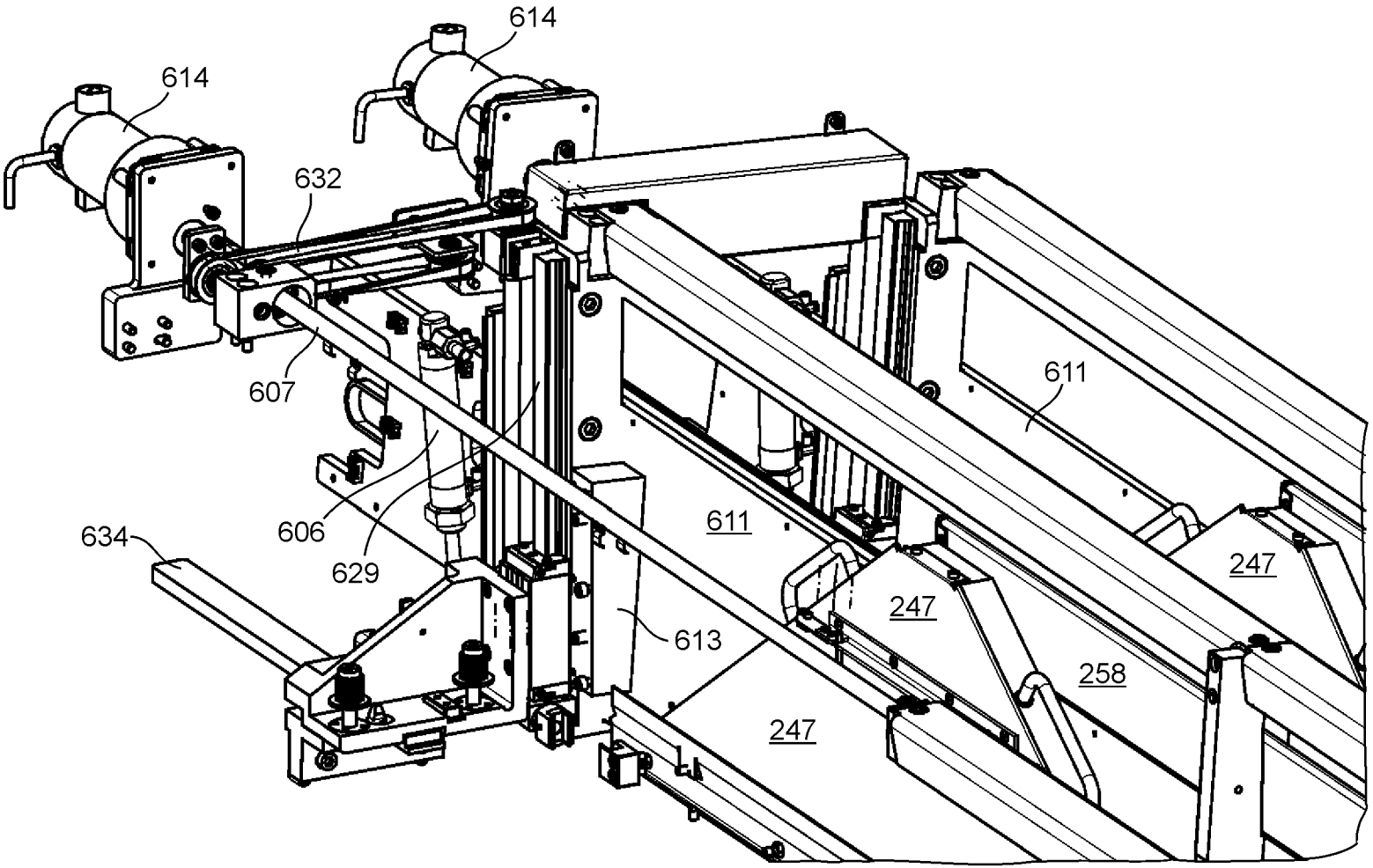
FIG. 22 a schematic partial diagram of an end region of two crossbars.

The at least one printing assembly 200 preferably has at least one protective cover 230; 232; 233; 234; 236, which is embodied as movable between at least one respective covering position and at least one respective access position. Preferably, a plurality of such protective covers 230; 232; 233; 234; 236 that are movable independently of one another are provided. (For example, FIG. 8 and FIG. 9 show four protective covers 232; 233; 234; 236 in their respective covering positions and one protective cover 230 in its access position.) The at least one protective cover 230; 232; 233; 234; 236 preferably has at least one tread surface 237, which is embodied, in particular, to be stood on by at least one operator and/or is movable jointly with the at least one protective cover 230; 232; 233; 234; 236. At least when the at least one protective cover 230; 232; 233; 234; 236 is situated in its respective covering position, the at least one tread surface 237 of the at least one protective cover 230; 232; 233; 234; 236 is preferably arranged at least partially in the vertical direction above at least one of the print heads 221 of printing assembly 200, and in particular on the side of the at least one protective cover 230; 232; 233; 234; 236 that faces away from the at least one print head 221. In this way, access to the corresponding print heads 221 is made possible, for example, even when printing substrate is still located in the at least one printing assembly 200. With relatively wide printing assemblies 200 in particular, accessibility to print heads 221 is thus optimized independently of the working width of printing assembly 200.

The at least one printing assembly 200 is preferably characterized, in particular, in that when protective cover 230; 232; 233; 234; 236 and/or tread surface 237 is situated in its respective at least one access position, at least one maintenance opening 238 is left open and at least one of print heads 221 is accessible to an operator, for example, from a direction having at least one component that faces vertically downward. The side of the respective print head 221 that faces away from its respective nozzle surface is then accessible in particular. A nozzle surface is, in particular, a surface of a print head 221 that is permeated by nozzle openings.

The totality of the at least one protective cover 230; 232; 233; 234; 236 in the case of only one protective cover 230; 232; 233; 234; 236 refers to this one protective cover 230; 232; 233; 234; 236 and in the case of multiple protective covers 230; 232; 233; 234; 236 refers to the totality of these multiple protective covers 230; 232; 233; 234; 236. The at least one printing assembly 200 is preferably characterized in that, at least when at least one protective cover 230; 232; 233; 234; 236 is arranged in its respective covering position, at least two tread surfaces 237 of the totality of the at least one protective cover 230; 232; 233; 234; 236, which surfaces are movable at least partially independently of one another, are arranged at least partially in the vertical direction above at least one of the print heads 221 of the printing assembly 200 and in particular on a side of the at least one protective cover 230; 232; 233; 234; 236 that faces away from the respective at least one print head 221. Independently movable tread surfaces 237 enable, for example, one tread surface 237 to be used to support an operator while at the same time, another tread surface 237 is folded over with its protective cover 230; 232; 233; 234; 236, to permit work on one of the print heads 221. At another time, the functions of these two tread surfaces 237 may be reversed. In particular with a large number of print heads 221, the result is therefore safer access to any print head 221.

The at least one printing assembly 200 preferably has at least two protective covers 230; 232; 233; 234; 236, in particular, which are each embodied to be movable between at least one respective covering position and at least one respective access position, and each of which has at least one tread surface 237, wherein, at least with the at least two protective covers 230; 232; 233; 234; 236 arranged in their respective covering positions, the respective at least one tread surface 237 is more preferably arranged at least partially in the vertical direction above at least one of the print heads 221 of the printing assembly 200, and is even more preferably arranged on a side of the respective at least one protective cover 230; 232; 233; 234; 236 that faces away from the at least one print head 221.

This at least one tread surface 237 preferably has a surface normal, in particular an average surface normal, the direction of which deviates from a vertical direction by at most 20°, more preferably at most 10° and even more preferably at most 5° when the protective cover 230; 232; 233; 234; 236 and/or tread surface 237 is arranged in its respective covering position. This increases the stability for operators, in particular. The at least one tread surface 237, and in the case of multiple tread surfaces 237, preferably each one of the multiple tread surfaces 237, preferably has a width corresponding to at least 60%, preferably at least 75% and more preferably at least 90% of the working width of the printing assembly 200 and/or amounting to at least 40 cm, preferably at least 100 cm, more preferably at least 200 cm and even more preferably at least 250 cm. The width is preferably measured in the transverse direction A. In the case of multiple tread surfaces 237, for example, at least two or at least three tread surfaces 237, these specifications for the orientation and/or width of the tread surfaces 237 preferably apply to each one of the multiple, in particular at least two or at least three tread surfaces 237.

In particular at least 25%, preferably at least 50%, more preferably at least 75% and even more preferably at least 90% of the print heads 221 of printing assembly 200 are arranged in such a way that they are arranged in the vertical direction beneath at least one of the at least one movable protective covers 230; 232; 233; 234; 236 in its respective covering position and/or are arranged in such a way that the respective projection of these print heads 221 in the vertical direction lies completely within a projection, oriented in the same vertical direction, of the entirety of the at least one movable protective cover 230; 232; 233; 234; 236 of the printing assembly 200, arranged in its respective covering position, in the same projection plane. This means, in particular, that the projection of the respective print head 221 is a subset of the projection of the protective covers 230; 232; 233; 234; 236 and/or that a projection of the respective print head 221 has an envelope that lies within an envelope of the projection of the protective covers 230; 232; 233; 234; 236 in the same projection plane.

At least one of the at least one protective cover 230; 232; 233; 234; 236 preferably has at least two tread surfaces 237, which are arranged at different heights in pairs when protective cover 230; 232; 233; 234; 236 is arranged in its covering position. This allows the protective cover to also act as a step, to enable access to higher parts of the at least one printing assembly 200. Alternatively or additionally, the at least one printing assembly 200 has a plurality of protective covers 230; 232; 233; 234; 236, wherein the plurality of protective covers 230; 232; 233; 234; 236, at least when they are arranged in their respective covering positions, each have tread surfaces 237, which are arranged at different heights in pairs in relation to the entire set of multiple protective covers 230; 232; 233; 234; 236. For example, the at least one printing assembly 200 is characterized in that the tread surfaces 237 of a plurality of such protective covers 230; 232; 233; 234; 236, at least when this plurality of protective covers 230; 232; 233; 234; 236 are arranged in their respective covering positions, together form a flight of steps, comprising at least four, preferably at least five, more preferably at least six, even more preferably at least seven and more preferably still at least eight steps.

In particular, the respective steps are preferably formed by the respective tread surfaces 237. For example, individual steps are formed by surfaces that are associated with stationary components of the printing assembly 200. Each tread surface 237 and/or each step is preferably arranged at a respective individual height, which is different from that of other tread surfaces 237 and/or steps. In particular, all tread surfaces 237 and/or steps are preferably arranged in such a way that respective tread surfaces 237 and/or steps that are arranged further toward the rear in terms of the transport direction defined by a transport path provided for printing substrate 02 are situated higher than respective tread surfaces 237 and/or steps that are arranged further toward the front in terms of the transport direction. The flight of steps thus preferably rises in the transport direction defined by the transport path provided for printing substrate 02.

The at least one protective cover 230; 232; 233; 234; 236 is preferably embodied as pivotable between its respective covering position and its respective at least one access position. For example, the at least one protective cover 230; 232; 233; 234; 236 has at least one spring mounting element. The at least one spring mounting element preferably serves to support and/or dampen the movement, in particular the pivoting movement, of the respective at least one protective cover 230; 232; 233; 234; 236 between its respective covering position and its respective at least one access position. The at least one spring mounting element is embodied, for example, as at least one compression spring.

The at least one printing assembly 200 is characterized, for example, in that the printing assembly 200 comprises at least three, preferably at least four, more preferably at least eight, even more preferably at least ten, even more preferably at least twelve and more preferably still at least fourteen print heads 221 arranged one after the other with respect to the transport direction, for which it is true of each in pairs that a respective second print head 221 arranged downstream of a respective first one of these print heads 221 in the transport direction is arranged higher than the respective first print head 221. For example, the at least one printing assembly 200 is characterized in that at least three, more preferably at least four tread surfaces 237 of the at least one protective cover 230; 232; 233; 234; 236 arranged in its covering position are arranged along the transport direction, together forming a flight of steps comprising at least three, preferably at least four, more preferably at least five, even more preferably at least six, even more preferably at least seven and more preferably still at least eight steps. Each one of the at least three, more preferably four or correspondingly more tread surfaces 237 is preferably arranged in the vertical direction above at least one of the at least four or correspondingly more print heads 221. Alternatively or additionally, the at least one printing assembly 200 is characterized in that the at least three, preferably at least four tread surfaces 237 are arranged one after the other along the transport direction in their respective treading position and together form a flight of steps comprising at least three, preferably at least four, more preferably at least five, even more preferably at least six, even more preferably at least seven and more preferably still at least eight steps.

The at least one printing assembly 200 preferably comprises at least three tread surfaces 237 embodied in particular for being stepped on by at least one operator and/or movable jointly with the at least one protective cover 230; 232; 233; 234; 236, each being embodied as movable at least between a respective tread position and a respective access position. A tread surface 237 in the tread position means, in particular, a closed tread surface 237 and/or closed protective cover 230; 232; 233; 234; 236. A tread surface 237 in the access position means, in particular, an open tread surface 237 and/or an open protective cover 230; 232; 233; 234; 236. Each one of the at least three tread surfaces 237 in its respective tread position is preferably arranged at least partially in the vertical direction above at least one of the print heads 221 of printing assembly 200, and in particular on a side of the at least one protective cover 230; 232; 233; 234; 236 that faces away from the at least one print head 221. The at least one printing assembly 200 preferably has the at least one protective cover 230; 232; 233; 234; 236 which is embodied as movable between the at least one respective covering position and the at least one respective access position, wherein the at least one protective cover 230; 232; 233; 234; 236 preferably includes at least one of the at least three tread surfaces 237 that are movable jointly in particular with the at least one protective cover 230; 232; 233; 234; 236.

The at least one printing assembly 200 is preferably characterized in that at least 25%, more preferably at least 50%, even more preferably at least 75% and more preferably still at least 90%, or all of print heads 221 of the at least one printing assembly 200 are preferably arranged in such a way that they are arranged in the vertical direction below at least one of the at least three movable tread surfaces 237 in their respective tread position. The at least one printing assembly 200 is preferably characterized in that the at least three tread surfaces 237 are arranged to be movable at least partially independently of one another, and/or in that the at least three tread surfaces 237 are embodied as pivotable between their respective tread position and their respective at least one access position, and/or in that the at least three tread surfaces 237 are arranged at different heights in pairs in their respective tread positions.

The at least one printing assembly 200 preferably comprises the at least one transport path provided for transport of web-type printing substrate 02, in particular, the transport path preferably defining the at least one transport direction. In the case of a curved transport path, the transport direction is preferably the direction running tangentially to a partial segment of the provided transport path closest to a respective reference point. This respective reference point is preferably located at the point and/or on the component that is referenced to the transport direction. A sequence of functional units 242; 243; 244; 292 extending in the transport direction is preferably arranged opposite the provided transport path, in particular in the region of printing line 224 of the at least one first printing assembly 200, in a direction having at least one component pointing vertically upward. These functional units 242; 243; 244; 292 are preferably components of the at least one printing assembly 200.

Within this sequence of functional units 242; 243; 244; 292, at least one first gas supply opening 242 and thereafter, preferably directly downstream, at least one first section of shielding device 292 permeated by print head recesses 246 is preferably arranged within this sequence of functional units 242; 243; 244; 292, one after the other in the transport direction. This first section of shielding device 292 is preferably permeated substantially exclusively and more preferably exclusively by print head recesses 246, with the exception of mounting recesses. Within this sequence of functional units 242; 243; 244; 292, downstream thereof in the transport direction, more preferably directly downstream, at least one first gas suction opening 243 is provided, followed, preferably directly downstream, by at least one flow shield 244, which is followed, preferably directly downstream, by at least one second gas supply opening 242, which is followed, preferably directly downstream, by at least one second section of shielding device 292 permeated by print head recesses 246, which is followed, preferably directly downstream, by at least one second gas suction opening 243. This second section of shielding device 292 is preferably permeated substantially exclusively and more preferably exclusively by print head recesses 246, with the exception of mounting recesses.

In other words, this means that, within this sequence of functional units 242; 243; 244; 292, at least one functional unit 242 embodied as a first gas supply opening 242, followed, preferably directly downstream, by at least one functional unit 243 embodied as at least one first section of a shielding device 292 permeated by print head recesses 246, followed, preferably directly downstream, by at least one functional unit 243 embodied as at least one first gas suction opening 243, followed, preferably directly downstream, by at least one functional unit 244 embodied as at least one flow shield 244, followed, preferably directly downstream, by at least one functional unit 242 embodied as at least one second gas supply opening 242, followed, preferably directly downstream, by at least one functional unit 292 embodied as at least one second section of shielding device 292 permeated by print head recesses 246, followed, preferably directly downstream, by at least one functional unit 243 embodied as at least one second gas suction opening 243 are arranged one after the other in the transport direction. A main surface of the at least one flow shield 244 preferably has an average surface normal which has at least one first component that is oriented orthogonally to an average surface normal of a surface of the at least one shielding device 292, which at least also faces downward. More preferably, this first component of the average surface normal of the main surface of flow shield 244 is greater than any component of these average surface normals that is orthogonal thereto.

The at least one printing assembly 200 is preferably characterized in that the sequence of functional units 242; 243; 244; 292 comprises at least one subsequence of functional units 242; 243; 244; 292, each comprising at least one gas supply opening 242, followed, more preferably directly downstream, by at least one section of shielding device 292 permeated by print head recesses 246, followed, more preferably directly downstream, by at least one gas suction opening 243, followed, more preferably directly downstream, by at least one flow shield 244, one after the other in the direction of transport. The sequence of functional units preferably comprises at least three, more preferably at least four, even more preferably at least seven and more preferably still at least eleven such subsequences, one after another in the direction of transport, preferably directly adjoining one another. The sequence of functional units 242; 243; 244; 292 preferably ends after a last such subsequence in the direction of transport, for example, in particular directly after a last such subsequence, with a final sequence of functional units 242; 243; 244; 292 comprising at least one gas supply opening 242, followed, preferably directly downstream, by at least one section of shielding device 292 permeated by print head recesses 246, followed, preferably directly downstream, by at least one gas suction opening 243, one after another in the direction of transport.

The at least one printing assembly 200 is preferably characterized in that all the functional units 242; 243; 244; 292 of the sequence are intersected by a common reference plane, the surface normals of which run both orthogonally to the direction of transport and also horizontally.

Alternatively or additionally, printing assembly 200 is preferably characterized in that the at least one first gas supply opening 242 has a dimension extending in the direction of transport of preferably at least 1 mm, more preferably at least 2 mm and even more preferably at least 4 mm and/or of preferably at most 50 mm, more preferably at most 30 mm and even more preferably at most 20 mm, and/or in that the at least one gas supply opening 242 extends in a transverse direction A oriented horizontally and orthogonally to the transport direction, over at least 30%, more preferably at least 50% and even more preferably at least 80% of the working width of printing assembly 200. The dimension of the at least one gas supply opening 242 in transverse direction A should be the sum of all existing individual dimensions in transverse direction A of optionally the plurality of gas supply openings 242 arranged side by side in transverse direction A.

Alternatively or additionally, the at least one printing assembly 200 is preferably characterized in that the at least one shielding device 292 extends in the transverse direction A, which is oriented horizontally and orthogonally to the transport direction, over at least 60% preferably at least 75%, more preferably at least 90% and even more preferably at least 100% of the working width of the at least one printing assembly 200, and/or in that at least one print head 221, more preferably at least two print heads 221, more preferably at least ten print heads 221 and even more preferably at least twenty print heads 221 protrude(s) partially through a respective recess in the respective shielding device 292 in a direction having a component directed vertically downward. The smallest distance from shielding device 292 to the transport path intended for the transport of printing substrate preferably amounts to at least 0.3 mm, more preferably at least 0.6 mm and even more preferably at least 1.0 mm, and preferably to at most 5 mm, more preferably at most 3 mm and even more preferably at most 2 mm. The smallest distance from print heads 221 to the transport path intended for the transport of printing substrate preferably amounts to at least 0.1 mm, more preferably at least 0.4 mm and even more preferably at least 0.8 mm, and preferably to at most 5 mm, more preferably at most 2 mm and even more preferably at most 1.2 mm.

Alternatively or additionally, the at least one printing assembly 200 is preferably characterized in that the at least one printing assembly 200 has at least one suction element 247, more preferably embodied as at least one suction box 247. The at least one suction box 247 preferably has at least one inlet opening 243, which more preferably faces at least partially toward the transport path intended for printing substrate 02 and which forms the at least one first gas suction opening 243 and/or the at least one second gas suction opening 243. The at least one inlet opening 243 is preferably bordered, in particular on its rear edge as seen in the transport direction, by the at least one flow shield 244. In the case of at least two suction boxes 247, this preferably means that at least one inlet opening 243 of at least one of the at least two suction boxes 247 forms the at least one first gas suction opening 243 and/or the at least one second gas suction opening 243.

The at least one suction box 247 preferably has at least one and more preferably exactly one outlet opening 259, which is more preferably connected to a respective connecting opening 248 of a suction line 258, in particular a common suction line. The at least one outlet opening 259 is preferably connected to the respective connecting opening 248 of suction line 258 via an outlet connection that is sealed by means of a sealing element 262 embodied in particular as a sealing ring 262. Suction line 258 is in turn preferably connected to a suction device (not shown). The at least one suction box 247 is preferably removable from suction line 258 and/or from printing assembly 200, in particular in a nondestructive manner, in particular while retaining the installed position of suction line 258 and/or in a removal direction.

The at least one inlet opening 243 of the at least one suction box 247 preferably has a transverse dimension, a transverse dimension being a dimension in transverse direction A. Transverse direction A is in turn preferably oriented orthogonally to the transport direction and/or orthogonally to each surface normal of the transport path provided for the transport of printing substrate 02 and/or horizontally. The at least one inlet opening 243 of the at least one suction box 247 preferably has a longitudinal dimension orthogonal to the transverse dimension, the longitudinal dimension being a dimension in the longitudinal direction, and the longitudinal direction preferably being identical to the transport direction of the transport path provided for the transport of printing substrate 02. The transverse dimension of the at least one inlet opening 243 of the respective at least one suction box 247 is preferably at least five times, more preferably at least 10 times and even more preferably at least 50 times as large as the longitudinal dimension of the respective at least one suction box 247. For example, the transverse dimension of the at least one inlet opening amounts to at least 10 cm, more preferably at least 25 cm and even more preferably at least 50 cm and/or the transverse dimension of the at least one inlet opening preferably amounts to at most 300 cm, more preferably at most 200 cm and even more preferably at most 100 cm. For example, the longitudinal dimension of the at least one inlet opening amounts to at least 0.5 mm, more preferably at least 1 mm and even more preferably at least 2 mm, and/or the longitudinal dimension of the at least one inlet opening amounts to at most 75 mm, more preferably at most 30 mm and even more preferably at most 10 mm.

The at least one suction box 247 is preferably embodied as at least one hollow body 247 comprising at least one inlet opening 243 and at least one outlet opening 259. A suction direction preferably points, for example, from the at least one inlet opening 243 to the at least one outlet opening 259. A central suction direction of the at least one suction box 247 preferably includes at least one component oriented in a direction pointing vertically upward. The at least one suction box 247 is preferably characterized in that an inside dimension of the at least one suction box 247 measured in transverse direction A becomes smaller from the at least one inlet opening 243 to the at least one outlet opening 259, and/or in that an inside dimension of the at least one suction box 247 measured in the longitudinal direction becomes larger from the at least one inlet opening 243 to the at least one outlet opening 259. More preferably, along at least 50% of the shortest straight line distance from the at least one inlet opening 243 to the at least one outlet opening 259, an inside cross-sectional area of the at least one suction box 247, measured orthogonally to this distance, is the same size up to a tolerance of at most 25%, more preferably at most 15%, even more preferably at most 10% and more preferably still at most 5%, in particular wherein, along this at least 50% of the shortest straight line distance from the at least one inlet opening 243 to the at least one outlet opening 259, the inside dimension of the at least one suction box 247, measured in the transverse direction A, is reduced from the at least one inlet opening 243 to the at least one outlet opening 259.

For example, the at least one suction box 247 has at least one rear boundary surface, which delimits the at least one suction box 247 and in particular the interior space thereof as seen in the transport direction. For example, the at least one suction box 247 has at least one front boundary surface, which delimits the at least one suction box 247 and in particular the interior space thereof opposite the direction of transport. For example, the at least one suction box 247 has at least two side surfaces, which delimit the at least one suction box 247 and in particular the interior space thereof in and/or opposite transverse direction A. Preferably, the at least two side surfaces are at least partially arranged such that the surface normals thereof run obliquely to any horizontal direction and any vertical direction and/or at an angle between 10° and 170° relative to one another. The at least one outlet opening 259 is preferably embodied as an opening of the at least one rear boundary surface. Alternatively or additionally, the at least one outlet opening 259 is embodied as an opening in the at least one front boundary surface. A lower edge of the at least one rear boundary surface is preferably closer to the transport path provided for the transport of printing substrate 02 than a lower edge of the at least one front boundary surface. The distance from the lower edge of the at least one rear boundary surface to the transport path provided for the transport of printing substrate preferably amounts to at least 0.1 mm, more preferably at least 0.4 mm and even more preferably at least 0.8 mm, and preferably at most 5 mm, more preferably at most 2 mm and even more preferably at most 1.2 mm. This distance is preferably adjustable, for example, by means of at least one screw 268 embodied in particular as a stop body 268.

For example, a part of the component that forms the at least one rear boundary surface is embodied at least partially as the at least one flow shield 244. In this way, the at least one flow shield 244 prevents printing fluid ejected by a print head 221 arranged upstream of this at least one flow shield 244 from entering an active region of a print head 221 arranged behind this at least one flow shield 244, on the one hand due to the flow shield acting as a barrier and, on the other hand, because a suctioning effect is facilitated by the interaction between flow shield 244 and inlet opening 243. In addition, the risk that gas or a gas mixture originating from a gas supply opening 242 will be drawn from an inlet opening 243 located opposite the direction of transport without passing by a print head 221 is reduced or prevented as a result. A short circuit of the flow is thus prevented or reduced.

The at least one printing assembly 200 preferably has at least two, more preferably at least three suction boxes 247, which are connected at respective flow connections to the same common suction line 258, the flow path of which determines the direction of flow, and which leads to a suction device. Each of these flow connections preferably has a respective smallest cross-sectional area associated with the respective suction box 247. Every flow connection arranged along the flow path, in particular closer to the suction device along the flow path in the direction of flow, preferably has a smaller smallest cross-sectional area than every flow connection located a further distance from the suction device along the flow path, in particular in the direction of flow along the flow path. The at least one printing assembly 200 is preferably characterized in that the at least two and in particular at least three suction boxes 247 are arranged side by side in the transverse direction A. Alternatively or additionally, the at least one printing assembly 200 is preferably characterized in that the direction of flow of the flow path of suction line 258 has at least one component in transverse direction A that is greater than any component that may be present in a direction orthogonal thereto.

Alternatively or additionally, the at least one printing assembly 200 is preferably characterized in that the at least two, and in particular at least three suction boxes 247 have respective inlet openings 243, and in that the inlet openings 243 of the at least two and in particular at least three suction boxes 247, each being connected to the same common suction line 258 at flow connections, together extend over a length in transverse direction A that corresponds to at least 80%, more preferably at least 90%, even more preferably at least 95% and more preferably still at least 100% of the working width of printing assembly 200 and preferably extends in a transverse direction A.

Unless explicitly described otherwise, the specifications provided above and below are preferably each valid for print heads 221 and/or suction elements 247 arranged in their working position. Unless explicitly described otherwise, the specifications provided above and below regarding openings preferably do not apply to openings that are filled by screws or other connecting elements and/or openings that are provided merely as points of engagement for screws or other connecting elements.

Alternatively or additionally, the at least one printing assembly 200 having the at least one suction box 247 is preferably characterized in that the at least one suction box 247 has at least one inlet opening 243, which points at least partially toward the transport path provided for printing substrate 02, and/or in that the at least one suction box 247 has at least one outlet opening 259, which is connected to a respective connecting opening 248 of a suction line 258, in particular via an outlet connection that is sealed by means of a sealing element 262 embodied in particular as a sealing ring 262, said suction line in turn preferably being connected to a suction device, and/or in that the at least one suction box 247 can be removed from the suction line 258 and/or from printing assembly 200, in particular in a nondestructive manner, in particular while retaining the installed position of suction line 258 and/or in a removal direction. More preferably the at least one suction box 247 can be removed from suction line 258 and/or from printing assembly 200 without loosening the screw connections and/or without loosening additional components of printing assembly 200 that are connected to suction box 247 and/or to suction line 258.

The at least one suction box 247 can preferably be removed from suction line 258 and/or from printing assembly 200 by means of at most three successive linear movements in each case, more preferably at most two successive linear movements in each case, and even more preferably by at most one linear movement in each case of the at least one suction box 247. For example, one suction box and preferably the middle one of three suction boxes 247 based on the transverse direction A can be removed from suction line 258 and/or from printing assembly 200 by exactly one linear movement of the at least one suction box 247. For example, two suction boxes, preferably two outer of three suction boxes 247 based on the transverse direction A can be removed from suction line 258 and/or from printing assembly 200 by two or three successive linear movements in each case of the respective one of these two suction boxes 247. The installed position of suction boxes 247 can be selected by the additional movement of the outer suction boxes 247, in such a way that their respective inlet openings 243 are arranged as close to one another as possible, but at least one spacer 613 is positioned such that it is located between the middle suction box 247 and a respective one of the outer suction boxes 247 in transverse direction A. The middle suction box 247 can then be easily removed linearly from printing assembly 200 while the outer suction boxes must at least partially bypass a spacer 613, for example, which requires more than one linear movement in each case. Alternatively, the two outer section boxes may each be removed from the printing assembly in a respective linear direction, wherein the suction boxes are not situated in parallel to one another and are not parallel to the direction in which the middle suction box 247 can be removed from printing assembly 200. The shape and orientation of the side walls of the suction boxes 247 support the ability to arrange inlet openings 243 close to one another while at the same time arranging spacers 613 between the suction boxes 247.

Printing assembly 200 is preferably characterized in that the respective connecting opening 248 of suction line 258 and/or the respective outlet opening 259 of the respective suction box 247 each point in a connecting direction having at least one first component in or opposite the transport direction. More preferably, this first component is larger than any component of the connecting direction in any direction orthogonal to the transport direction.

The direction in which a respective opening faces is preferably the surface normal to a virtual opening plane. The virtual opening plane is an imaginary, i.e., virtual plane, which differs as little as possible from the edge that encloses the opening. This difference is preferably totaled, i.e., integrated over the entire edge that surrounds the opening. Thus, if the edge surrounding the opening lies exclusively in one plane, then the totaled, i.e., integrated deviation is zero and this plane is the virtual opening plane. However, if the edge surrounding the opening does not lie exclusively in one plane and is instead contained exclusively in at least one curved surface, then the virtual opening plane is the plane into which the edge surrounding the opening can be projected, so that this projection of the edge surrounding the opening deviates as little as possible from the actual edge that surrounds the opening over all points of the edge that surrounds the opening when totaled, i.e., integrated.

The at least one suction box 247 is preferably removable from printing assembly 200 in a removal direction, and every projection of the at least one suction box 247 direction passes by every component of suction line 258 in the removal direction. This is preferably true, in particular, when suction box 247 is arranged in its working position. Therefore, suction line 258 can remain in its position unchanged during removal of the respective suction box 247. This reduces the effort of removing the respective suction box 247. With respect to suction boxes 247 that require more than one linear movement for their removal, the direction of removal is, for example, the direction of the last linear movement in removal. More preferably, every projection of components that are removed during the removal of the at least one suction box 247 passes by every component of suction line 258 during removal.

Due to the simple removal, simple cleaning of suction boxes 247 is possible, in particular. For this purpose, the suction boxes 247 are preferably embodied as hollow bodies 247 that are closed exclusively by clamping or by a small number of screw connections and are easy to open. They can thus be removed easily from printing assembly 200, opened easily and cleaned easily. Cleaning is appropriate, for example, after a certain number of hours of operation as the air entering through the at least one gas supply opening 242 and flowing along the at least one shielding device 292 entrains a fine ink mist, which thus enters the inlet opening 243 of the respective suction box 247, said inlet opening being embodied as a gas suction opening 243, and is precipitated there.

Alternatively or additionally, the at least one printing assembly 200 is preferably characterized in that at least one sealing element 262, which is reversibly deformable and/or elastic in particular, is clamped between the at least one suction box 247 and the at least one suction line 258, and in that at least one clamping element 264 is clamped between the at least one suction box 247, on the one hand, and at least one supporting body 266, on the other hand, on a side of the at least one suction box 247 that faces away from the at least one sealing element 262, and in that the at least one clamping element 264 is arranged on at least one deflecting element 267, which is reversibly deformable and/or elastic in particular, and/or is embodied as a spring element 267. The at least one deflecting element 267 is preferably arranged in at least one location rigidly on the at least one suction box 247 or on the at least one supporting body 266 and is connected thereto. This permits a particularly simple system configuration for tightly clamping the at least one suction box 247. The at least one sealing element 262 is preferably a sealing ring 262, which has a peripheral sealing lip, the sealing lip corresponding to a rotationally symmetrical section of a conical circumferential surface based on an axis of symmetry of sealing ring 262. More preferably, the conical circumferential surface preferably has an opening angle between 10° and 170°, more preferably between 30° and 160°, even more preferably between 60° and 150° and more preferably still between 80° and 140°.

A method for arranging at least one suction box 247 in a printing assembly 200 is also preferred, wherein the at least one suction box 247 is moved in an insertion direction into the printing assembly 200 until at least one contact body 269 contacts at least one respective stop body 268, for example, at least one respective screw 268, and wherein at least one deflecting element 267 carrying a clamping element 264 is deflected out of an equilibrium position, and wherein after that, at least one outlet opening 259 of the at least one suction box 247 is moved toward at least one connecting opening 248 of a suction line 258 in a sealing direction with at least one component orthogonal to the insertion direction, and wherein a flow connection is established, on the one hand, and, on the other hand, the at least one clamping element 264 reaches a clamping position between the at least one suction box 247 and the at least one supporting body 266 by a relaxing movement of the at least one deflecting element 267. The at least one clamping element 264 is clamped there preferably by a restoring force of a sealing element 262 that connects outlet opening 259 to connecting opening 248. For example, at least one guide pin, which cooperates with at least one elongated guide recess, is used as a guide for the pressing movement. For example, the guide pin is arranged on the at least one supporting body 266, and the at least one guide recess is arranged on the at least one suction box 247.

The at least one printing assembly 200 preferably has at least two, in particular at least three suction boxes 247. These at least two and more preferably at least three suction boxes 247 are preferably each constructed and/or arranged and/or removable as described above and below with respect to the at least one suction box 247 as long as this does not result in any contradictions.

Alternatively or additionally, the at least one printing assembly 200 is preferably characterized in that these at least two and in particular at least three suction boxes 247, individually and independently of others of these at least two and in particular at least three suction boxes 247, which are arranged next to the respective one of the at least two and in particular at least three suction boxes 247 in transverse direction A, can each be removed from the common suction line 258 and/or from printing assembly 200. The at least one printing assembly 200 preferably has at least two, in particular at least three, suction boxes 247, wherein the at least two and in particular at least three suction boxes 247 have respective inlet openings 243, which point at least partially toward the transport path provided for printing substrate 02. The at least one printing assembly 200 is preferably characterized in that the inlet openings 243 of the at least two and in particular at least three suction boxes 247 together extend over an inlet length that corresponds to at least 80%, more preferably at least 90%, even more preferably at least 95%, and more preferably still at least 100% of the working width of printing assembly 200. The at least three suction boxes 247 are preferably connected to the same common suction line 258 with their respective outlet openings 259 at flow connections. The inlet length preferably extends in transverse direction A. The at least one suction box 247, and more preferably, the at least two, in particular at least three, suction boxes 247, can preferably be removed from suction line 258 and/or from printing assembly 200, in particular in a nondestructive manner, in particular while retaining the installed position of suction line 258 and/or in a removal direction.

Alternatively or additionally, the at least one printing assembly 200 is preferably characterized in that the printing assembly 200 has at least one crossbar 272, which extends from a first side wall 271 of a frame 283 of printing assembly 200 to a second side wall 271 of frame 283 of printing assembly 200. More preferably, the at least two and in particular at least three suction boxes 247 are attached to the at least one crossbar 272, for example, attached exclusively to the at least one crossbar 272.

The at least one crossbar 272 preferably has at least one first crossbeam 611 and at least one second crossbeam 612. The at least first crossbeam 611, on the one hand, and the at least one second crossbeam 612, on the other hand, are preferably arranged so that they are spaced a distance apart from one another in the transport direction. For example, at least one spacer 613 is arranged between the at least one first crossbeam 611 and the at least one second crossbeam 612. More preferably, the at least one spacer 613 is connected, in particular rigidly, to the at least one first crossbeam 611 and the at least one second crossbeam 612. Between the at least one first crossbeam 611 and the at least one second crossbeam 612, at least one interior space of the respective crossbar 272 is preferably formed, for example, due to the at least one spacer 613. The at least one suction element 247 embodied as a suction box 247, for example, is preferably arranged at least partially inside the interior space of the at least one crossbar 272 and/or at least partially between the at least one first crossbeam 611 and the at least one second crossbeam 612, as seen in the transport direction. A plurality of spacers 613 may be arranged at least partially inside the crossbar 272 in the transverse direction, while still allowing nearly the entire working width of printing assembly 200 to be covered with gas suction openings 243 and/or inlet openings 243 in particular due to the arrangement of a plurality of suction boxes 247, for example three suction boxes 247, side by side in transverse direction A. Preferably at least three, more preferably at least four spacers 613 per crossbar 272 are arranged side by side in transverse direction A.

Printing assembly 200 is preferably characterized in that each one of the at least two and in particular at least three suction boxes 247 has a respective inlet opening 243, which extends separately in a transverse direction A over an inlet length that corresponds to at most 60%, more preferably at most 50% and even more preferably at most 40% of the working width of printing assembly 200.

For example, at least one shielding device 292 is arranged in such a way that it is attached, in particular rigidly, to at least one first crossbeam 611 of a first crossbar 272, and in that it is attached, in particular rigidly, to a second crossbeam 612 of a second crossbar 272. This first crossbar 272 is therefore rigidly connected to the second crossbar 272. The second crossbar 272 is in turn preferably connected in the same way to a third crossbar 272 by means of another or the same shielding device 292. All three crossbars 272 are then interconnected in this way. The more crossbars 272 are interconnected in this way, the more stable the entire structure becomes. A very stable structure that supports the stability of the entire frame 283 can be formed in this way. Preferably, at least three crossbars 272, more preferably at least five, even more preferably at least seven, even more preferably at least nine and more preferably still at least thirteen crossbars are interconnected in this way by means of common and/or respective shielding devices 292.

Alternatively or additionally, the at least one printing assembly 200 is preferably characterized in that the at least one printing assembly 200 has at least one frame 283, which has at least two side walls 271. The transport path provided for the transport of web-type printing substrate 02 preferably runs in particular at least partially between these at least two side walls 271. The at least one printing assembly 200 preferably has at least two, more preferably at least three, even more preferably at least four, even more preferably at least seven and more preferably still at least eleven crossbars 272, each extending at least in transverse direction A between the side walls 271, and arranged one after the other with respect to the transport direction, and each preferably being connected, in particular rigidly, to both of the at least two side walls 271 of frame 283.

The at least one printing assembly 200 preferably has at least three, more preferably at least four, even more preferably at least six, and more preferably still at least eight print heads 221, which are arranged one after the other in the transport direction and/or are spaced a distance apart from one another in the transport direction. At least one first accessory device 247; 263; 601; 602; 603; 604; 607; 608, which is different in particular from each print head 221 and is associated with at least one front print head 221 arranged upstream of this respective one of the in particular at least three crossbars 272 in the transport direction, is preferably arranged on each crossbar 272, in particular on each one of the at least three crossbars 272. At least one second accessory device 247; 263; 601; 602; 603; 604; 607; 608, which is different in particular from each print head 221 and is associated with at least one rear print head 221 arranged downstream of this respective one of the in particular three crossbars 272 in the transport direction, is preferably arranged on each one of the in particular at least three crossbars. In other words, this means that preferably each one of the crossbars, in particular at least two or at least three crossbars 272, is embodied as a holder for at least one such first accessory device 247; 263; 601; 602; 603; 604; 607; 608 and as a holder for at least one such second accessory device 247; 263; 601; 602; 603; 604; 607; 608, respectively.

The at least one first accessory device 247; 263; 601; 602; 603; 604; 607; 608 and/or the at least one second accessory device 247; 263; 601; 602; 603; 604; 607; 608 is embodied, for example, as at least one supporting element 601; 602 and/or as at least one cleaning device 263 and/or as at least one guide 603 of a cleaning device 263 and/or as at least one cleaning drive 604 of a cleaning device 263 and/or as at least one torque transfer device 607 and/or as at least one print head closure 608 and/or as at least one nozzle closure 608 and/or as at least one suction box 247. The at least one supporting element 601; 602 is preferably embodied as at least one supporting roller 601 and/or as at least one supporting stop 602, and/or the at least one torque transfer device 607 is preferably embodied as at least one synchronous shaft 607 that more preferably extends in transverse direction A over at least 50%, more preferably at least 75% and even more preferably at least 90% of the working width of printing assembly 200. Such a torque transfer device 607 is a component, for example, of at least one throw-off drive 614 and/or is arranged in operative connection with at least one throw-off drive 614.

The at least one printing assembly 200 is preferably characterized in that print head spaces 609 are preferably arranged between the crossbars 272 in the transport direction, and in that a respective crossbar 272 of the at least three crossbars 272 borders a print head space 609 located in front of the respective crossbar 272 in the transport direction and/or borders a print head space 609 located behind the respective crossbar 272 in the transport direction. The at least one front print head 221 preferably is and/or can be located in the respective front print head space 609, and the at least one rear print head 221 preferably is and/or can be located in the respective rear print head space 609. Print heads 221 are preferably arranged only outside of each crossbar 272 and/or only inside of print head spaces 609. At the beginning and/or the end of a sequence of such crossbars 272, for example, a first peripheral crossbar, which does not have any print heads 221 in front of it in the transport direction, is arranged, or a second peripheral crossbar, for example, which does not have any print heads 221 behind it in the transport direction, is arranged. Transverse direction A is preferably oriented orthogonally to any transport direction defined by the transport path provided for printing substrate 02, and horizontally.

Alternative or additionally, the at least one printing assembly 200 is preferably characterized in that each one of the crossbars 272, and preferably each one of at least two crossbars 272 has at least one first crossbeam 611 and at least one second crossbeam 612, spaced a distance apart from one another in particular in and/or opposite the transport direction, which more preferably together delimit an interior space of the respective crossbar 272, at least partially in and opposite the transport direction, more preferably jointly. Preferably, at least one component of a gas transport device and/or at least one accessory device 247; 263; 601; 602; 603; 604; 607; 608 for supplying energy and/or fuels and/or printing fluid and/or data and/or at least one gas to at least one print head 221 and/or at least one inner accessory device 247; 263; 601; 602; 603; 604; 607; 608 for cleaning and/or for maintenance and/or for at least temporary coverage of at least one print head 221 is/are arranged in the respective at least one interior space. An accessory device 608 for at least temporary coverage of at least one print head 221 is, for example, an accessory device 608 that is movable optionally between a closure position and a readiness position.

The at least one inner accessory device 247; 263; 601; 602; 603; 604; 607; 608 is embodied, for example, as at least one cleaning device 263 and/or as at least one guide 603 of a cleaning device 263 and/or as at least one cleaning drive 604 of a cleaning device 263 and/or as at least one torque transfer device 607 and/or as at least one print head closure 608 and/or as at least one nozzle closure 608. The at least one component of the gas transport device is, for example, at least one suction box 247. The at least one printing assembly 200 is characterized, for example, in that a print head space 609, in which at least one print head 221 is and/or can be arranged, is situated between two of the at least two crossbars 272 that are in proximity in the transport direction and in particular between a first crossbeam 611 associated with a respective first crossbar 272 and a second crossbeam 612 associated with a respective second crossbar 272.

Alternatively or additionally, the at least one printing assembly 200 is preferably characterized in that at least one spacer 613 is arranged between the respective at least one first crossbeam 611 and the respective at least one second crossbeam 612. For example, the respective at least one spacer 613 is in contact with the respective at least one first crossbeam 611 and the respective at least one second crossbeam 612. The respective at least one spacer 613 is preferably connected, in particular rigidly, to the respective at least one first crossbeam 611 and to the respective at least one second crossbeam 612. Alternatively or additionally, the at least one printing assembly 200 is preferably characterized in that the at least one spacer 613 is at a distance from each one of the at least one two side wall 271 that corresponds to at least 20%, more preferably at least 25% and even more preferably at least 30% of the working width of printing assembly 200. This does not necessarily apply to each one of these spacers 613, but preferably does apply to at least one and, more preferably, at least two of the spacers 613. Each crossbar 272 preferably has at least two, more preferably at least three, and even more preferably, at least four such spacers 613 arranged side by side in transverse direction A. A side wall 271 is understood in particular to also include such a component of frame 283 that has relatively large holes and/or the shape of which deviates relatively greatly from a flat surface. Side walls 271 are preferably opposite one another in transverse direction A, wherein the transport path intended for the transport of web-type printing substrate 02 in particular is preferably arranged between them.

For example, the at least one first crossbeam 611 is constructed in several parts, in particular in such a way that each individual part of the at least one first crossbeam 611 extends over less than the distance from the one of the two side walls 271 to the other of the two side walls 271, but the respective at least one first crossbeam 611 as a whole extends from the one of the two side walls 271 to the other one of the two side walls 271. For example, the at least one second crossbeam 612 is constructed in multiple parts, in particular such that each individual part of the at least one second crossbeam 612 extends over less than the distance from the one of the two side walls 271 to the other of the two side walls 271, but the respective at least one second crossbeam 612 as a whole extends from the one of the two side walls 271 to the other of the two side walls 271. One or more spacers 613 then serve, for example, as connecting pieces between individual parts of a respective first crossbeam 611 and/or as connecting pieces between individual parts of a respective second crossbeam 612.

The at least one first crossbeam 611 preferably extends over a length in the transverse direction A corresponding to at least 80%, more preferably at least 90%, even more preferably at least 95% and more preferably still at least 100% of the working width of the at least one printing assembly 200. The at least one second crossbeam 612 preferably extends over a length in the transverse direction A corresponding to at least 80%, more preferably at least 90%, even more preferably at least 95% and more preferably still at least 100% of the working width of the at least one printing assembly 200.

The at least one printing assembly 200, which preferably includes the at least one frame 283 having at least two side walls 271, preferably has the at least one crossbar 272, which extends at least in transverse direction A between side walls 271 and which more preferably is connected, in particular rigidly connected, to both of the two side walls 271 of frame 283. More preferably, the at least one printing assembly 200 has at least two, more preferably at least three, even more preferably at least four, even more preferably at least five, even more preferably at least six and more preferably still, at least seven crossbars 272, each extending between side walls 271 at least in transverse direction A and each preferably being connected, in particular rigidly connected, to both of the two side walls 271 of frame 283.

The at least one printing assembly 200 preferably has at least one supporting body 616, which is movable relative to the frame 283 and/or relative to the at least one crossbar 272 in at least one throw-off direction C, and which extends at least in the transverse direction A between the side walls 271 and more preferably extends from one side wall 271 to another side wall 271. Printing assembly 200 more preferably has at least two, even more preferably at least four, even more preferably at least eight and more preferably still at least twelve such supporting bodies 616. The at least one movable supporting body 616 preferably extends in transverse direction A over at least 75%, more preferably at least 90% and even more preferably at least 100% of the working width of the at least one printing assembly 200. The at least one supporting body 616 is preferably movable in the at least one throw-off direction C relative to frame 283 by means of at least one throw-off drive 614, in particular lifting drive 614. The at least one supporting body 616 is preferably movable linearly. Throw-off direction C preferably includes at least one component pointing vertically upward and/or throw-off direction C is a lifting direction C. Throw-off direction C is preferably oriented orthogonally to transverse direction A. Preferably, at least one print head 221 is arranged on the at least one supporting body 616 and is jointly movable with the at least one supporting body 616. At least two print heads 221 are preferably arranged on the at least one supporting body 616 in each case, and more preferably are movable jointly with the respective at least one supporting body 616. The at least one supporting body 616 and the print heads 221 arranged thereon form a respective nozzle bar 231, for example.

At least one first contact point 617 located on the at least one supporting body 616 and at least one second contact point 618 located on the at least one crossbar 272 preferably form at least one first contact point pair 619, the pair being opposite one another in throw-off direction C and being in contact with one another, or movable into contact with one another. The at least one first contact point pair 619 preferably serves to delimit a linear path, in particular, along which the at least one supporting body 616 can be moved in and/or opposite the throw-off direction C, at least with respect to a direction pointing vertically downward. During a printing operation of the at least one printing assembly 200, the at least one first contact point 617 located on the at least one supporting body 616 and the at least one second contact point 618 located on the at least one crossbar 272 are preferably in contact with one another. In this way, the distance between the print heads and the printing substrate 02 is preferably defined. In particular, this contact point pair 619 restricts or prevents sagging of the supporting body 616 in throw-off direction C, in particular during the printing operation, and/or keeps the distance between print heads 221 of supporting body 626 and printing substrate 02 the same or at least much less variable over the working width, in particular during the printing operation.

At least one third contact point 621, located on the at least one supporting body 616, and at least one fourth contact point 622, located on the at least one crossbar 272, preferably form at least one second contact point pair 623, the pair being opposite one another at least temporarily and at least also in a supporting direction orthogonal to throw-off direction C and orthogonal to transverse direction A, and being in contact with one another, or movable into contact with one another. For example, the at least one printing assembly 200 has at least two crossbars 272, and this at least one crossbar 272, on which the fourth contact point 622 is located, is a different one of the at least two crossbars 272 from the crossbar 272 on which the at least one second contact point 618, in particular for this supporting body 616, is located. In this way, in particular in cases in which the respective supporting body 616 can be moved in a throw-off direction C that is different from the vertical direction, sagging of the supporting body 616 in a direction orthogonal to throw-off direction C is restricted or prevented. The position of all print heads 221 of this supporting body 616 along the transport path is thereby kept the same or at least much less variable, in particular during the printing operation. This increases the print quality that is achievable by means of the printing assembly 200.

Alternatively or additionally, the at least one printing assembly 200 is preferably characterized in that the at least one second contact point 618 is defined by the at least one crossbar 272 itself and/or by at least one supporting element 602, which is arranged on the at least one crossbar 272 and more preferably is embodied as a supporting stop 602. Alternatively or additionally, the at least one printing assembly 200 is preferably characterized in that the at least one third contact point 621 is defined by at least one pivotable and/or rotatable supporting element 601, preferably embodied as a supporting roller 601, arranged on the at least one supporting body 616, and/or in that the at least one fourth contact point 621 is defined by at least one pivotable and/or rotatable supporting element 601, preferably embodied as a supporting roller 601, arranged on the at least one crossbar 272. The printing assembly 200 preferably has, per supporting body 616, at least three, more preferably at least four and even more preferably at least six supporting elements 602 embodied as supporting stops 602 and arranged on the at least one crossbar 272 to form at least three, more preferably at least four, even more preferably at least six such second contact points 618.

Alternatively or additionally, the at least one printing assembly 200 is preferably characterized in that the at least one first contact point pair 619 is spaced with respect to the transverse direction A from each side wall 271 by a distance that corresponds to at least 20%, more preferably at least 30% and even more preferably at least 40% of the working width of printing assembly 200. This is not necessarily true of each one of these first contact point pairs 619, but is preferably applicable to at least one and more preferably at least two of these first contact point pairs 619. Alternatively or additionally, the at least one printing assembly 200 is preferably characterized in that the at least one second contact point pair 623 is spaced with respect to the transverse direction A from each side wall 271 by a distance that corresponds to at least 20%, more preferably at least 30% and even more preferably at least 40% of the working width of printing assembly 200. This is not necessarily true of each second contact point pair 623 but is preferably true of at least one.

Alternatively or additionally, the at least one printing assembly 200 is preferably characterized in that the at least one supporting body 616 has a reinforcing region along the transverse direction A over at least 60%, more preferably at least 75% and even more preferably at least 90% of its length. Longitudinal sectional planes are preferably planes whose surface normals have a direction parallel to transverse direction A. Each such longitudinal sectional plane that intersects the reinforcing region preferably forms, together with the at least one supporting body 616, a respective totality of one or more sectional surfaces, which extend in the vertical direction over a total of at least 5 cm, more preferably at least 10 cm, even more preferably at least 15 cm and more preferably still at least 20 cm. The at least one supporting body 616 is therefore particularly stable and is secured against gravity-induced sagging, for example.

Alternatively or additionally, the at least one printing assembly 200 is preferably characterized in that the at least one supporting body 616 is embodied as at least one cage enclosing an interior space, and in that the at least one print head 221 is located with at least 80% of its volume inside this interior space. A cage here is understood in particular to be a structure that is permeated with openings. The at least one interior space preferably has a substantially cuboid structure. For example, a cage is a container that is closed on all sides but whose sides are more or less perforated. The cage embodiment ensures a particularly high stability, but with a low weight of supporting body 616, as well as good accessibility to the print heads 221 arranged in the interior space inside the cage.

Alternatively or additionally, the at least one printing assembly 200 is preferably characterized in that the at least one supporting body 616 has at least one bottom segment 624, which has at least one print head opening 626 that opens the at least one bottom segment 624 opposite the throw-off direction C and/or in a direction having at least one component that points vertically downward, and through which the at least one print head 221 is arranged at least partially penetrating. More preferably, the at least one print head 221 is arranged penetrating through the at least one print head opening 626 in such a way that an ejection direction of at least one nozzle of the at least one print head 221 has at least one component oriented vertically downward and/or opposite the throw-off direction C. Therefore, despite the stable arrangement, the print heads 221 can be arranged at a suitable distance from the transport path provided for the transport of printing substrate 02 and/or from the printing substrate 02. The at least one print head 221 is preferably arranged on the bottom segment of supporting body 616 by means of a holder associated with the respective print head 221. The at least one holder has adjustment options for alignment of the respective print head 221, for example.

Alternatively or additionally, the at least one printing assembly 200 is preferably characterized in that the at least one supporting body 616 has at least one access opening 627, which opens the at least one supporting body 616 in an access direction D having at least one component that points vertically upward and/or in the throw-off direction C and through which access opening the at least one print head 221 can more preferably be removed from the at least one supporting body 616. This allows a particularly simple replacement of print heads 221. This is also true in particular in connection with the at least one protective cover 230; 232; 233; 234; 236, which is preferably embodied to be movable between at least one respective covering position and at least one respective access position, and/or which preferably includes at least one tread surface 237, which is embodied in particular to be stepped on by at least one operator and/or which is movable jointly with the at least one protective cover 230; 232; 233; 234; 236.

Alternatively or additionally, the at least one printing assembly 200 is preferably characterized in that the at least one supporting body 616 has at least one escape opening 616, which opens the at least one supporting body 616 in an escape direction E that runs with at least one component horizontally and/or orthogonally to the throw-off direction C. This facilitates the installation and/or dismantling of components and/or accessories of individual print heads 221, for example.

Alternatively or additionally, the at least one printing assembly 200 is preferably characterized in that the at least one movable supporting body 616 is connected to the at least two side walls 271 via at least one respective guide device 629, which is embodied in particular as at least one rail 629.

Alternatively or additionally, the at least one printing assembly 200 is preferably characterized in that the at least one supporting body 616 is arranged to be movable between at least one use position and at least one throw-off position in and opposite the throw-off direction C, and in that at least one maintenance device 263 and/or cleaning device 263 of printing assembly 200 and/or at least one print head closure 608 and/or at least one nozzle closure 608 of printing assembly 200 is arranged and/or can be arranged movably in a space that is at least partially taken up by this supporting body 616 in its use position, when supporting body 616 is arranged in the throw-off position.

At least one measuring device for measuring a position of the at least one supporting body 616 is preferably arranged along the same in particular linear path, along which the respective supporting body 616 is movably arranged. Such a measuring device is a linear encoder, for example. At least one end position switch is preferably located at at least one end and/or at both ends of this in particular linear path, in particular for shutting down the throw-off drive 614. For example, at least one ball screw having at least one reciprocating ball spindle and/or at least one reciprocating ball nut is provided. The at least one ball screw is preferably a component of the at least one throw-off drive 614 and/or is connected to the at least one throw-off drive 614. For example, the printing assembly has two points of force application for one or more throw-off drives 614 per supporting body 616, in particular on each of its two ends based on transverse direction A. For example, one throw-off drive 614 is provided per supporting body 616. At least one torque transfer device 607 embodied as a synchronous drive 607 is preferably provided, in particular for distributing torque applied by the throw-off drive 614 to two points of force application, where torque is converted into a linear movement of the supporting body 616.

The at least one throw-off drive 614 is an electric motor, for example, and/or is preferably coupled directly or via a gear system to synchronous shaft 607. For example, synchronous shaft 607 extends over at least 80%, more preferably at least 90% and even more preferably at least 100% of the working width of printing assembly 200 in transverse direction A. For example, synchronous shaft 607 is connected directly or via at least one torque transfer device 632, preferably embodied as a belt 632, in particular as a toothed belt 632, to at least one threaded drive, in particular a ball screw, and more preferably to two such threaded drives. These two threaded drives are preferably each associated with one of the two side walls 271 of frame 283. A space-saving arrangement for a deflection of torque can be implemented by a total of four deflecting rollers per belt, the deflecting rollers being arranged such that each is rotated by 90° along the belt. For example, two of the deflecting rollers have one axis of rotation oriented horizontally, and two others of the deflecting rollers have a respective axis of rotation oriented parallel to throw-off direction C. Deflecting rollers should also be understood to be gear wheels. For example, at least one of the deflecting rollers can be displaced orthogonally to its axis of rotation. In this way, on the one hand, the tension of the belt can be adjusted, while on the other hand, the belt can be replaced without completely uninstalling one of the deflecting rollers. Synchronous shaft 307 and belts 632 are each preferably protected by a cover. On activation of the throw-off drive, synchronous shaft 607 is set in rotation so that the two belts drive the two threaded drives and the supporting body 616 is thereby raised at both ends. Positioning aids, which ensure accurate alignment of the at least one supporting body 616 as it is being lowered into its position of use, are preferably provided.

The printing assembly preferably has at least one accessory device 608, which is preferably embodied as a print head closure 608 and/or as a nozzle closure 608. A nozzle closure 608 is preferably a device that serves to cover one or more nozzles of at least one print head 221. A print head closure 608 is preferably a device that serves to cover one or more print heads 221. In this way, for example, one or more nozzles of one or more print heads is/are protected from soiling and/or from drying out, in particular when it can be expected that this nozzle and/or this print head 221 will not be in operation for an extended period of time. This is the case, for example, during a shutdown of printing assembly 200. The at least one print head closure 608 and/or nozzle closure 608 is preferably movable, in particular pivotable, between a readiness position and at least one closure position. The at least one print head closure 608 and/or nozzle closure 608 is preferably pivotable about a pivot axis and/or movable by means of at least one closure drive 606. A plurality of print head closures 608 and/or nozzle closures 608 are preferably jointly movable and/or attached to a jointly movable body, which is movable accordingly. The at least one closure drive 606 is preferably embodied as at least one linear drive, for example as at least one pneumatic cylinder and/or at least one hydraulic cylinder and/or as at least one electric linear drive.

Alternatively or additionally, the at least one printing assembly 200 is preferably characterized in that printing assembly 200 has at least one closure holder 631 per supporting body 616, which is arranged on the at least one crossbar 272 and which forms at least one fifth contact point, in particular, provided for contact with a print head closure 608 and/or nozzle closure 608 that is located on one of the at least one crossbar 272. More preferably, the respective print head closure 608 and/or nozzle closure 608 is located on another of then at least two crossbars 272 and/or is rotatably mounted, in particular, as the closure holder 631 associated with this print head closure 608 and/or nozzle closure 608. More preferably, printing assembly 200 has at least three, more preferably at least six such closure holders 631 arranged on the at least one crossbar 272 per supporting body 616. The at least one closure holder 631 preferably delimits a movement space of the at least one print head closure 608 and/or nozzle closure 608 at least in one direction. More preferably, the at least one closure holder 631 serves as a contact surface of the at least one print head closure 608 and/or nozzle closure 608 in its closure position.

The at least one supporting body 616 can preferably be arranged in at least three intended positions, which are different in terms of their position with respect to throw-off direction C. The at least one supporting body 616 is preferably connected to frame 283 by means of at least one energy chain. The at least one energy chain is thus preferably rigidly connected at one end to the at least one supporting body 616 and at the other end directly or indirectly to the frame 283. At least one fluid line is preferably provided per supporting body 616 in such a way that it extends in transverse direction A over at least 50% of the working width of printing assembly 200, and in that a plurality of, or more preferably each of the print heads 211 arranged on this supporting body 616 is connected to this fluid line by means of a connecting line. The respective connecting line of supporting body 616 is preferably connected to a line system arranged on the frame 283 by means of a flexible partial piece at a respective first end of the respective supporting body 616. More preferably, a connecting line of a supporting body 616 is connected to a connecting line of a neighboring supporting body 616, in particular at a respective second end of the supply line, based on transverse direction A. In this way, with a correspondingly large delivery volume, a continuous flow of printing fluid through the supply line of the two supporting bodies 616 can be achieved. For this purpose, printing fluid from the line system is preferably transported into a supply line of a supporting body 616 and there to the respective print heads 221, and additionally, printing fluid is preferably transported through the supply line of this supporting body 616 into the supply line of the neighboring supporting body 616, where it is transported to the respective print heads 221, and additionally, printing fluid is preferably transported through the supply lines of the two supporting bodies 616 and back into the line system, which in this way must be arranged on only one side of the frame 283.

Alternatively or additionally, the at least one printing assembly 200 is preferably characterized in that the throw-off direction C of the respective supporting body 616 has at least one component oriented parallel to a surface normal of a tangent surface at a point on the transport path intended for printing substrate 02 that is closest to the supporting body 616. More preferably, a deviation in the throw-off direction C from the direction of this respective surface normal amounts to at most 40°, even more preferably at most 25°, even more preferably at most 10° and more preferably still at most 1°.

A first one of these at least three positions provided for the at least one supporting body 616 is preferably a use position. This position is preferably characterized in that with the supporting body 616 arranged in the use position, the print heads 221 arranged in this supporting body 616 are located in their respective printing positions and/or the at least one first contact point 617 located on the at least one first supporting body 616 and the at least second contact point 618 located on the at least one crossbar 272 are in contact with one another, and/or the at least one third contact point 621 located on the at least one supporting body 616 and the at least one fourth contact point 622 located on the at least one crossbar 272 are in contact with one another. The at least one supporting body 616 is arranged in the use position during the printing operation, for example.

A second one of these at least three provided positions of the at least one supporting body 616 is preferably a throw-off position. The throw-off position is preferably characterized in that with the supporting body 616 arranged in the throw-off position, a multi-use area is opened up because the at least one first contact point 617 located on the at least one supporting body 616 and the at least one second contact point 618 located on the at least one crossbar 272 are at a correspondingly great distance from one another, for example, at least 5 cm, preferably at least 10 cm, more preferably at least 15 cm and even more preferably at least 20 cm. This opened-up multi-use area preferably serves to enable the movement of the at least one print head closure 608 and/or nozzle closure 608 and/or to enable the movement of a cleaning device 623 in and/or opposite transverse direction A.

A third one of these at least three intended positions of the at least one supporting body 616 is preferably a safety position. With the supporting body 616 situated in the safety position, at least one nozzle closure 608 and/or at least one print head closure 608 is preferably arranged in its closure position.

For example, after a printing operation, first the at least one supporting body 616 is raised out of its use position in the throw-off direction C. The at least one first contact point 617 located on the at least one supporting body 616 and the at least one second contact point 618 located on the at least one crossbar 272 are thereby moved out of contact, and the result is initially a rolling contact on the at least one supporting roller 601 of the at least one second contact point pair 623. The at least one third contact point 621 located on the at least one supporting body 616 and the at least one fourth contact point 622 located on the at least one crossbar 272 are then preferably also moved out of contact. The multi-use space is opened up by the throw-off movement. The at least one print head closure 608 and/or nozzle closure 608 is then preferably moved, in particular pivoted, out of its readiness position into its closure position.

The at least one print head closure 608 and/or nozzle closure 608 and/or a component that carries this at least one print head closure 608 and/or nozzle closure 608 preferably has at least one movable guide element 633, in particular at least one guide element 633 that is movable jointly with the at least one print head closure 608 and/or nozzle closure 608 and/or with the component that carries this at least one print head closure 608 and/or nozzle closure 608. The at least one cleaning device 263 is preferably supported at least temporarily at and/or on the at least one movable guide element 633, while it is being moved by means of the at least one cleaning drive 604 in and/or opposite transverse direction A and/or along a cleaning path, in particular along at least one guide 603. The at least one cleaning device 263 preferably has at least one supporting roller for this purpose. The at least one cleaning drive 604 has, for example, at least one preferably revolving drawing means, in particular at least one chain, on which or to which the at least one cleaning device 263 is attached. For example, a gearwheel that drives the drawing means, in particular the chain, then induces a revolving movement of the chain so that the cleaning device 263 is moved along the guide 603. For example, the cleaning device 263 has at least one nonwoven and at least one drive for further reeling the at least one nonwoven. Additional devices such as pulling-off devices and/or collecting devices and/or spray nozzles for cleaning fluids and/or for gases are also components of the at least one cleaning device 263.

After use of the at least one cleaning device 263 has been concluded, the at least one print head closure 608 and/or nozzle closure 608, for example, is left in its closure position, and the at least one supporting body 616 is moved opposite the throw-off direction C until the print heads 221 arranged thereon are arranged in a position in which they are covered by the at least one print head closure 608 and/or nozzle closure 608, i.e., preferably enclosed in an airtight manner. The at least one supporting body 616 is then situated in the safety position. The at least one supporting body 616 is preferably supported in its safety position on the print head closure 608 and/or nozzle closure 608 in its closure position, in particular against the force of gravity. The displacement of the at least one print head closure 608 and/or nozzle closure 608 into its closure position, and the displacement of the at least one supporting body 616 into its safety position is possible even independently of and in particular even without activation of the at least one cleaning device 263.

Print head closure 608 and/or nozzle closure 608 is thus preferably mounted, in particular pivotably, at all times on a crossbar 272, and in its closure position it additionally rests on closure holders 631, which are preferably arranged on another crossbar 272, these two crossbars 272 more preferably together delimiting a print head space 609 in and opposite the transport direction, with which even more preferably, at least one print head 221 is associated, with which precisely this print head closure 608 and/or nozzle closure 608 is functionally associated.

At least one cleaning device 263 is preferably provided per print head space 609, and more preferably two cleaning devices 263 per print head space 609 are provided. These can then be used at the same time in different positions with respect to the transverse direction A, thereby reducing the amount of time required. During a printing operation, cleaning devices 263 are preferably located outside of the working width of printing assembly 200 with respect to transverse direction A. More preferably, side walls 271 of frame 283 preferably have recesses, through which the cleaning devices 263 can be at least partially transported. For example, at least one guide element 634 is arranged, in particular, protruding through the respective recess. This at least one guide element 634 is preferably embodied as a rigidly arranged guide element 634. More preferably, one such guide element is provided for each such recess. These guide elements 634, in particular arranged rigidly, together with the movable guide elements 633, preferably form a guide system when print head closures 608 and/or nozzle closures 608 are in their closure position. By means of this guide system, cleaning devices 263 can be moved out of a region outside of the working width of printing assembly 200 and even, for example, outside of frame 283 of printing assembly 200 to print heads 221 and along print heads 221 and then moved back again.

A platform arrangement is provided, for example, creating access for operators. The platforms allow access to cleaning devices 263 and/or to tread surfaces 237 of protective covers 230; 232, 234, 236 and/or to an upper region of dryer unit 300, for example.

In one exemplary embodiment, at least one temperature control device is arranged on the at least one supporting body 616. For example, the at least one temperature control device serves, for example, to induce and/or maintain bending of the at least one supporting body 616 in a controlled manner and/or to compensate for unwanted bending of the at least one supporting body 616. Printing assembly 200 then preferably has the at least one in particular first temperature control device for the targeted creation of a temperature difference between a first location on this at least one supporting body 616 and a second location on this supporting body 616 spaced a distance apart from this first location, at least in the transport direction. A temperature difference between two locations on the at least one first supporting body 616 or also of another supporting body, which are arranged spaced a distance apart from one another, at least in the transport direction, results in different extensions of this support body 616 in transverse direction A, for example, relative to one another at these locations. The result is a sagging of this supporting body 616. This sagging results in a deflection and/or displacement, at least in and/or opposite the transport direction, of such parts of this supporting body 616 that are not arranged to be stationary relative to the frame 283.

The targeted creation of a temperature difference to be selected accordingly enables a targeted displacement of print heads 221 to take place, for example to compensate for color registration and/or register errors that would otherwise occur in particular without having to alter the actuation times of corresponding print heads 221. To be able to set the optimum temperature control, in particular, the respective position and/or sagging of the respective supporting body 616 is preferably measured. Alternatively or additionally, printing assembly 200 is preferably characterized in that at least one first temperature control device is arranged in the first location for the targeted introduction and/or removal of thermal energy. The at least one first temperature control device is preferably embodied as at least one first heating device, in particular as at least one first heating wire. Alternatively or additionally, the at least one first temperature control device has at least one fluid line for at least temperature control fluid, and/or the at least one first temperature control device has at least one Peltier element. The respective temperature control device preferably extends over at least 10%, more preferably over at least 25%, even more preferably over at least 50%, and even more preferably over at least 80% and more preferably still at least 100% of the extension of the respective supporting body 616 in transverse direction A. At least one control and/or regulating device is preferably provided, wherein this at least one control and/or regulating device is preferably arranged such that it is connected to the at least one first temperature control device and/or to at least one first position sensor.

Alternatively or in addition to the temperature control of supporting body 616, the crossbars 272 can also be temperature-controlled accordingly, in particular when a corresponding deformation of the corresponding crossbars 272 can be transferred to corresponding supporting bodies 616 by means of the contact point pairs 619; 623.

While preferred embodiments of a printing assembly, in accordance with the present invention, have been set forth fully and completely hereinabove, it will be apparent to one of skill in the art that changes could be made thereto, without departing from the true spirit and scope thereof, which is accordingly only to be limited by the appended claims.

The invention claimed is:

1. A printing assembly (200), wherein the printing assembly (200) has at least one frame (283), which has at least two side walls (271), between which a transport path provided for the transport of printing substrate (02) extends at least partially, and wherein at least one transport direction is defined by the transport path provided for the transport of printing substrate (02), and wherein the printing assembly (200) has at least two crossbars (272) spaced a distance from one another in the transport direction, each of which extends from one of the side walls (271) to another of the side walls (271), and wherein the printing assembly (200) has at least one supporting body (616), which is movable relative to the frame (283) in at least one throw-off direction (C) and which extends between the side walls (271) at least in a transverse direction (A), and wherein at least two print heads (221) are located on the at least one supporting body (616) and are movable together with the at least one supporting body (616), characterized in that between every two of the at least two crossbars (272) that are adjacent in the transport direction a print head space (609) is formed, in which at least one print head (221) is and/or can be arranged, and in that each of the at least two crossbars (272) has at least one first crossbeam (611) and at least one second crossbeam (612), spaced from the first crossbeam, which together delimit at least one interior space of the respective crossbar (272), at least partially in and opposite the transport direction, and in that at least one component of a gas transport device and/or at least one accessory device (247; 263; 601; 602; 603; 604; 607; 608) for supplying at least one print head (221) with energy and/or process materials and/or printing fluid and/or data and/or at least one gas, and/or at least one internal accessory device (247; 263; 601; 602; 603; 604; 607;

608) for cleaning and/or for maintenance and/or for coverage of at least one print head (221) is located in the respective at least one interior space, and in that at least one spacer (613) is located between the respective at least one first crossbeam (611) and the respective at least one second crossbeam (612), and in that the at least one spacer (613) is spaced from each of the at least two side walls (271) by a distance that corresponds to at least 20% of the working width of the printing assembly (200).

2. The printing assembly according to claim 1, characterized in that the at least one component of the gas transport device is at least one suction box (247).

3. The printing assembly according to claim 1, characterized in that the printing assembly (200) has at least three print heads (221) arranged one after the other with respect to the transport direction, and in that on each of the at least two crossbars (272), at least one first accessory device (247; 263; 601; 602; 603; 604; 607; 608) is arranged, which is associated with at least one front print head (221) arranged in front of this a respective one of the at least two crossbars (272) in the transport direction, and in that on each of the at least two crossbars (272), at least one second accessory device (247; 263; 601; 602; 603; 604; 607; 608) is arranged, which is associated with at least one rear print head (221) arranged behind the respective one of the at least two crossbars (272) in the transport direction.

4. The printing assembly according to claim 3, characterized in that the at least one first accessory device (247; 263; 601; 602; 603; 604; 607; 608) and/or the at least one second accessory device (247; 263; 601; 602; 603; 604; 607; 608) is embodied as at least one supporting element (601; 602) and/or as at least one cleaning device (263) and/or as at least one guide for a cleaning device (263) and/or as at least one cleaning drive (604) for a cleaning device (263) and/or as at least one torque transfer device (607) and/or as at least one print head closure (608) and/or as at least one nozzle closure (608) and/or as at least one suction box (247).

5. The printing assembly according to claim 1, characterized in that each of the at least two crossbars (272) has at least one first crossbeam (611) and at least one second crossbeam (612), spaced from the first crossbeam in and/or opposite the transport direction, which together delimit at least one interior space of the respective crossbar (272) at least partially in and opposite the transport direction, and/or in that the at least two and/or at least three crossbars (272) are each connected to both of the two side walls (271) of the frame (283).

6. The printing assembly according to claim 1, characterized in that the transverse direction (A) is oriented orthogonally to every transport direction defined by the transport path provided for printing substrate (02), and also horizontally, and/or in that the at least one supporting body (616) is linearly movable, and/or in that the throw-off direction (C) has at least one component that points vertically upward, and/or in that the throw-off direction (C) is oriented orthogonally to the transverse direction (A).

7. The printing assembly according to claim 2, characterized in that at least two and/or at least three suction boxes (247) are provided, and in that each of the at least two and/or at least three suction boxes (247) has a respective inlet opening (243) that itself extends in a transverse direction (A) over an inlet length that corresponds to at most 60% of the working width of the printing assembly (200).

8. The printing assembly according to claim 1, characterized in that the respective at least one spacer (613) is in contact with the respective at least one first crossbeam (611) and the respective at least one second crossbeam (612), and/or in that the respective at least one spacer (613) is connected rigidly to the respective at least one first crossbeam (611) and the respective at least one second crossbeam (612).

9. The printing assembly according to claim 1, characterized in that the at least one first crossbeam (611) and/or the at least one second crossbeam (612) extend in the transverse direction (A) over a length that corresponds to at least 80% of the working width of the at least one printing assembly (200), and/or in that the at least one movable supporting body (616) extends in the transverse direction (A) over at least 75% and/or at least 90% and/or at least 100% of the working width of the at least one printing assembly (200).

10. The printing assembly according to claim 1, characterized in that at least one first contact point (617) located on the at least one supporting body (616) and at least one second contact point (618) located on at least one crossbar (272) form at least one first contact point pair (619), which lie opposite one another in the throw-off direction (C) and which are in contact and/or can be brought into contact with one another, and in that at least one third contact point (621) located on the at least one supporting body (616) and at least one fourth contact point (622) located on the at least one crossbar (272) form at least one second contact point pair (623), which are at least temporarily opposite one another, including in at least a supporting direction that is orthogonal to the throw-off direction (C) and orthogonal to the transverse direction (A), and which are in contact and/or can be brought into contact with one another.

11. The printing assembly according to claim 10, characterized in that the at least one second contact point (618) is defined by the at least one crossbar (272) itself and/or by at least one supporting element (602) located on the at least one crossbar (272), and/or in that the at least one third contact point (621) is defined by at least one pivotable and/or rotatable supporting element (601) located on the at least one supporting body (616), and/or in that the at least one fourth contact point (621) is defined by at least one pivotable and/or rotatable supporting element (601) located on the at least one crossbar (272).

12. The printing assembly according to claim 1, characterized in that the at least one supporting body (616) is arranged to be movable in and opposite the throw-off direction (C) between at least one use position and at least one throw-off position, and in that when the supporting body (616) is in its throw-off position, at least one maintenance device (263) and/or cleaning device (263) of the printing assembly (200) and/or at least one print head closure (608) and/or at least one nozzle closure (608) of the printing assembly (200) can be arranged and/or are movably arranged in a space that is at least partially taken up by this supporting body (616) in its use position.

13. The printing assembly according to claim 1, characterized in that the at least one printing assembly (200) has at least three and/or at least four print heads (221) arranged one after the other with respect to the transport direction and/or spaced a distance from one another in the transport direction, and/or in that at least one print head (221) is embodied as an inkjet print head (221), and/or in that during normal printing operation, all print heads (221) are arranged as stationary.

14. The printing assembly according to claim 1, characterized in that the throw-off direction (C) of the respective supporting body (616) has at least one component that is oriented parallel to a surface normal of a tangent surface at a point on a transport path provided for printing substrate (02) that is closest to the supporting body (616).

15. The printing assembly according to claim 1, characterized in that the at least one supporting body (616) can be arranged in at least three intended positions that differ in terms of their position with respect to the throw-off direction (C), and in that a first of these at least three intended positions of the at least one supporting body (616) is a use position, and in that a second of these at least three intended positions of the at least one supporting body (616) is a throw-off position, and in that a third of these at least three intended positions of the at least one supporting body (616) is a safety position.

* * * * *